US007959147B2

(12) United States Patent
Izuchi et al.

(10) Patent No.: US 7,959,147 B2
(45) Date of Patent: Jun. 14, 2011

(54) SHEET FEEDING APPARATUS AND IMAGE RECORDING APPARATUS

(75) Inventors: Masatoshi Izuchi, Ichinomiya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 138 days.

(21) Appl. No.: 11/964,310

(22) Filed: Dec. 26, 2007

(65) Prior Publication Data

US 2008/0157460 A1 Jul. 3, 2008

(30) Foreign Application Priority Data

Dec. 27, 2006 (JP) ..... 2006-352870

(51) Int. Cl.
*B65H 3/44* (2006.01)

(52) U.S. Cl. ..... 271/9.02; 271/9.01; 271/9.04; 271/10.03; 271/10.04; 271/10.13

(58) Field of Classification Search ..... 271/9.01, 271/10.04, 10.13, 114, 10.03, 242, 244; 347/104
See application file for complete search history.

(56) References Cited

U.S. PATENT DOCUMENTS

| | | | | |
|---|---|---|---|---|
| 4,577,849 | A * | 3/1986 | Watanabe | 271/9.02 |
| 4,645,192 | A * | 2/1987 | Watanabe | 271/9.09 |
| 4,722,518 | A * | 2/1988 | Watanabe | 271/9.05 |
| 4,744,687 | A * | 5/1988 | Nukaya et al. | 400/624 |
| 4,822,019 | A * | 4/1989 | Nagira | 271/9.02 |
| 4,978,112 | A * | 12/1990 | Yokoi | 271/9.02 |
| 5,080,515 | A * | 1/1992 | Engelhardt et al. | 400/624 |
| 5,108,084 | A * | 4/1992 | Ishikawa et al. | 271/9.02 |
| 5,184,902 | A | 2/1993 | Harada | |
| 5,954,326 | A * | 9/1999 | Gaarder et al. | 271/9.02 |
| 6,032,942 | A * | 3/2000 | Cho | 271/9.11 |
| 6,312,093 | B1 | 11/2001 | Saijo et al. | |
| 6,962,332 | B2 * | 11/2005 | Su | 271/4.01 |
| 7,431,283 | B2 * | 10/2008 | Hsieh | 271/110 |
| 2003/0227130 | A1 * | 12/2003 | Olson et al. | 271/242 |
| 2006/0071389 | A1 * | 4/2006 | Kozaki et al. | 271/9.11 |

(Continued)

FOREIGN PATENT DOCUMENTS

EP 0830950 A2 3/1998

(Continued)

OTHER PUBLICATIONS

Japanese Patent Office, Notification of Reason for Refusal for Patent Application No. 2006-352870, mailed Oct. 21, 2008. (counterpart to above-captioned U.S. patent application.).

*Primary Examiner* — Jeremy Severson
(74) *Attorney, Agent, or Firm* — Baker Botts L.L.P.

(57) ABSTRACT

A sheet feeding apparatus includes a switchable transmission mechanism disposed between a pickup roller and a driving source, and switches the driving source between a first state for rotating in the forward direction to rotate the pickup roller, and a second state for not rotating the pickup roller, the forward direction is opposite to a direction in which the driving source is rotated to rotate a feeder roller in a sheet feed direction. The sheet feeding apparatus also includes a control portion rotating the driving source in the forward direction to rotate the pickup roller in a sheet supply direction, and switches the switchable transmission mechanism between the first state, when a sheet is supplied from a sheet holding portion, and the second state, when the sheet is fed by the feeder roller.

13 Claims, 29 Drawing Sheets

U.S. PATENT DOCUMENTS

| | | | |
|---|---|---|---|
| 2007/0048058 | A1 | 3/2007 | Koga et al. |
| 2007/0048059 | A1 | 3/2007 | Asada et al. |
| 2007/0057447 | A1 | 3/2007 | Asada et al. |

FOREIGN PATENT DOCUMENTS

| | | | |
|---|---|---|---|
| JP | 60145873 | A | 8/1985 |
| JP | 61149379 | A | 7/1986 |
| JP | 3272880 | A | 12/1991 |
| JP | H04-251753 | A | 9/1992 |
| JP | H06-126949 | A | 5/1994 |
| JP | H09-323458 | A | 12/1997 |
| JP | H10-126570 | A | 5/1998 |
| JP | H11-138782 | A | 5/1999 |
| JP | 2003-089244 | A | 3/2003 |
| JP | 2005-280923 | A | 10/2005 |
| JP | 2007-090761 | A | 4/2007 |

* cited by examiner

SHEET FEEDING APPARATUS AND IMAGE RECORDING APPARATUS

CROSS REFERENCE TO RELATED APPLICATION

The present application claims priority from Japanese Patent Application No. 2006-352870, which was filed on Dec. 27, 2006, the disclosure of which is herein incorporated by reference in its entity.

BACKGROUND OF THE INVENTION

1. Field of the Invention

The present invention relates to a sheet feeding apparatus that supplies a sheet from a sheet holding portion into a feed path, and particularly to a sheet feeding apparatus in which a feeder roller disposed in a feed path and a pickup roller disposed in a sheet holding portion are driven by a single driving source.

2. Description of Related Art

For instance, there is known a sheet feeding apparatus disposed in an inkjet printer and feeding a sheet from a sheet supply tray to a sheet catch tray along a feed path. The inkjet printer includes a recording head and records an image on the sheet supplied from the sheet supply tray by ejecting ink droplets from the recording head onto the sheet. The sheet is supplied from the sheet supply tray into the feed path and then fed along the feed path, by operation of two rollers that may be respectively called pickup roller and feeder roller. To the two rollers, a driving torque or a rotary motion of a motor as a driving source is transmitted. To transmit the driving torque from the motor to each of the two rollers, a transmission mechanism constituted by a combination of a gear, a timing belt, and/or others is employed.

The pickup roller operates to supply the sheet, that is, to feed out the sheet from the sheet supply tray into the feed path. The feeder roller operates to feed the sheet along the feed path. The required properties are different between the pickup roller and the feeder roller. For instance, a required precision in a speed at which the sheet is supplied or fed, and whether a deskew capability is required or not, are different between the pickup roller and the feeder roller. Hence, the pickup roller and the feeder roller are controlled to rotate differently from each other. There is known an arrangement for giving a driving force to each of the two rollers which are controlled to differently rotate, where a driving source is provided for each of the two rollers. There is also known an arrangement for a printer where a driving torque is transmitted from a single driving source to a plurality of driven portions, as disclosed in JP-A-3-272880. Further, JP-A-61-149379 and JP-A-60-145873 disclose an arrangement for rotating one of two rollers depending on a direction in which a driving source is rotated, by use of a one-way clutch or a planetary gear.

With respect to an image recording apparatus such as an inkjet printer, there is a demand for downsizing of the apparatus and speed-up of image recording. To meet the demand for downsizing, the sheet supply tray is downsized or reduced in thickness. Further, a guide is disposed on the sheet supply tray such that the position of the guide is variable on the sheet supply tray so that sheets in a variety of sizes, e.g., sheets in A4, B5 and legal sizes and postcard, can be selectively placed or set on the sheet supply tray. On the other hand, sometimes it is desired to include in an image recording apparatus another sheet supply tray on which a large stack of sheets of a kind that is frequently used, such as of A4 size, can be set.

This sheet supply tray for holding a large stack of sheets will be hereinafter referred to as "sheet supply cassette".

To meet the demand for the speed-up of image recording, there has been proposed an image recording apparatus in which the mode of sheet feeding is selectable, that is, one of a normal feeding mode and a high-speed feeding mode is selected. When the normal feeding mode is selected, image recording is performed to sheets that are one by one supplied into the feed path at a normal speed. When the high-speed feeding mode is selected, on the other hand, image recording is performed to sheets that are supplied into the feed path with a distance between each two sheets consecutively fed being reduced.

The image recording apparatus including the sheet supply cassette on which a large stack of sheets can be set necessarily further includes a transmission mechanism for transmitting a driving torque from a motor as a driving source to another pickup roller corresponding to the sheet supply cassette. On the other hand, the image recording apparatus capable of making a selection between the normal feeding mode and the high-speed feeding mode includes two transmission mechanisms for transmitting driving torques of two motors, respectively, namely, a first transmission mechanism for transmitting to the pickup roller a driving torque of a first motor that is for the normal feeding mode, and a second transmission mechanism for transmitting to the same pickup roller a driving torque of a second motor that is for the high-speed feeding mode.

It is often the case that an image recording apparatus of high-end model is equipped with the sheet supply cassette and the high-speed feeding mode as standard settings, but an image recording apparatus of popular model or entry model is not. Further, depending on preference of a user and irrespective of whether the model is high-end or entry, sometimes an image recording apparatus is equipped with further another sheet supply tray and/or is constructed such that a still higher-speed feeding mode is optionally settable. It is undesirable to enable these various settings by designing for each of the settings a transmission mechanism and a drive switching mechanism, and preparing components, such as a gear and a shaft, exclusively for each model, since it costs high. That is, to reduce the cost of an image recording apparatus, it is desirable to use as many components as possible commonly among various models.

In the image recording apparatus which can be optionally equipped with a sheet supply tray or cassette, and/or in which the high-speed or higher-speed feeding mode is settable, it is desired to transmit a driving torque from a motor to a pickup roller and a feeder roller by means of a simple arrangement, while reducing the cost of the components of the image recording apparatus as well as enhancing the efficiency of assembling of the image recording apparatus.

SUMMARY OF THE INVENTION

This invention has been developed in view of the above-described situations, and it is an object of the invention, therefore, to provide a sheet feeding apparatus which can economically transmit a driving torque from a driving source to a plurality of rollers, or simply enable optional settings, and an image recording apparatus including the sheet feeding apparatus.

To attain the above object, the invention provides a sheet feeding apparatus including: (a) a sheet holding portion which holds a sheet; (b) a feed path which guides the sheet supplied from the sheet holding portion; (c) a driving source which can rotate in two opposite directions; (d) a feeder roller which is disposed in the feed path and rotated by a driving torque of the driving source; (e) a pickup roller which can rotate in contact with the sheet held in the sheet holding portion; (f) a switchable transmission mechanism which is disposed between the pickup roller and the driving source, and is switchable at least between a first state for transmitting to the pickup roller a rotation of the driving source in a forward direction, and a second state for not transmitting a rotation of the driving source to the pickup roller, the forward direction in which the driving source is rotated in the first state being a direction opposite to a direction in which the driving source is rotated to rotate the feeder roller in a sheet feed direction which is a direction to feed the sheet; and (g) a control portion which (i) rotates the driving source in the forward direction to rotate the pickup roller in a sheet supply direction which is a direction to supply the sheet, and switches the switchable transmission mechanism to the first state, when the sheet is supplied from the sheet holding portion, and (ii) rotates the driving source in the direction opposite to the forward direction, and switches the switchable transmission mechanism to the second state, when the sheet is fed by the feeder roller.

The sheet held in the sheet holding portion is supplied into the feed path by the pickup roller, and then fed by the feeder roller. Each of the pickup roller and the feeder roller is rotated by a driving torque from the driving source. The driving torque of the driving source is transmitted to the pickup roller through the switchable transmission mechanism. When the control portion supplies the sheet from the sheet holding portion and then feeds the sheet along the feed path, the control portion (a) switches the switchable transmission mechanism to the first state, as well as rotates the driving source in a direction to rotate the pickup roller in the sheet supply direction to supply the sheet from the sheet holding portion (the direction in which the driving source is rotated when the sheet is supplied from the sheet holding portion is referred to as "forward direction" in this specification), and then (b) rotates the driving source in the direction opposite to the forward direction in order to feed the sheet by the feeder roller. The direction of rotation of the driving source opposite to the forward direction may be referred to as "reverse direction" in this specification. When the control portion switches the switchable transmission mechanism to the second state, a rotation of the driving source is not transmitted to the pickup roller.

It is noted that the forward and reverse directions with respect to rotation of the driving source are relatively defined, and thus either one of the two opposite rotation directions of the driving source may be referred to as forward direction as long as the other of the two opposite directions is referred to as reverse direction.

In a preferable form of the invention, while the switchable transmission mechanism is in the first state, the feeder roller and the pickup roller are rotated in respective directions that are opposite to each other, irrespective of whether the rotation direction of the driving source is forward or reverse. While the pickup roller is rotating in a direction to supply the sheet from the sheet holding portion on the basis of the forward rotation of the driving source, the feeder roller is rotating in order to deskew the sheet, namely, rotating in a direction opposite to a direction in which the feeder roller rotates while the feeder roller is feeding the sheet. While the feeder roller is rotating in the sheet feed direction on the basis of the reverse rotation of the driving source, the feeder roller is feeding the sheet along the feed path.

As described later, sometimes it does not cause any trouble to rotate, while the feeder roller rotates in the direction to feed the sheet, the pickup roller in a direction opposite to the direction in which the pickup roller rotates when supplying a sheet. However, it is desirable that the pickup roller is freely rotatable while the feeder roller rotates in the direction to feed the sheet. One advantage of enabling to establish the second state is to meet this demand, but there are further advantages thereof. For instance, it is possible to enable to transmit a rotation of the driving source to an operable device other than the pickup roller while the second state is established. One example of such a case is described below as one embodiment of the invention where a sheet supply cassette is optionally included and a rotation of the driving source is transmitted to another pickup roller that is disposed to supply a sheet from the sheet supply cassette.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 24-28 schematically illustrate how the sheet is fed by execution of the control routine, in which FIG. 24 shows an initial stage where the sheet is about to be supplied from the sheet supply tray, and FIGS. 25-28 sequentially show the following stages.

DETAILED DESCRIPTION OF PREFERRED EMBODIMENT

Hereinafter, there will be described one presently preferred embodiment of the invention, by referring to the accompanying drawings.

Figure 1:
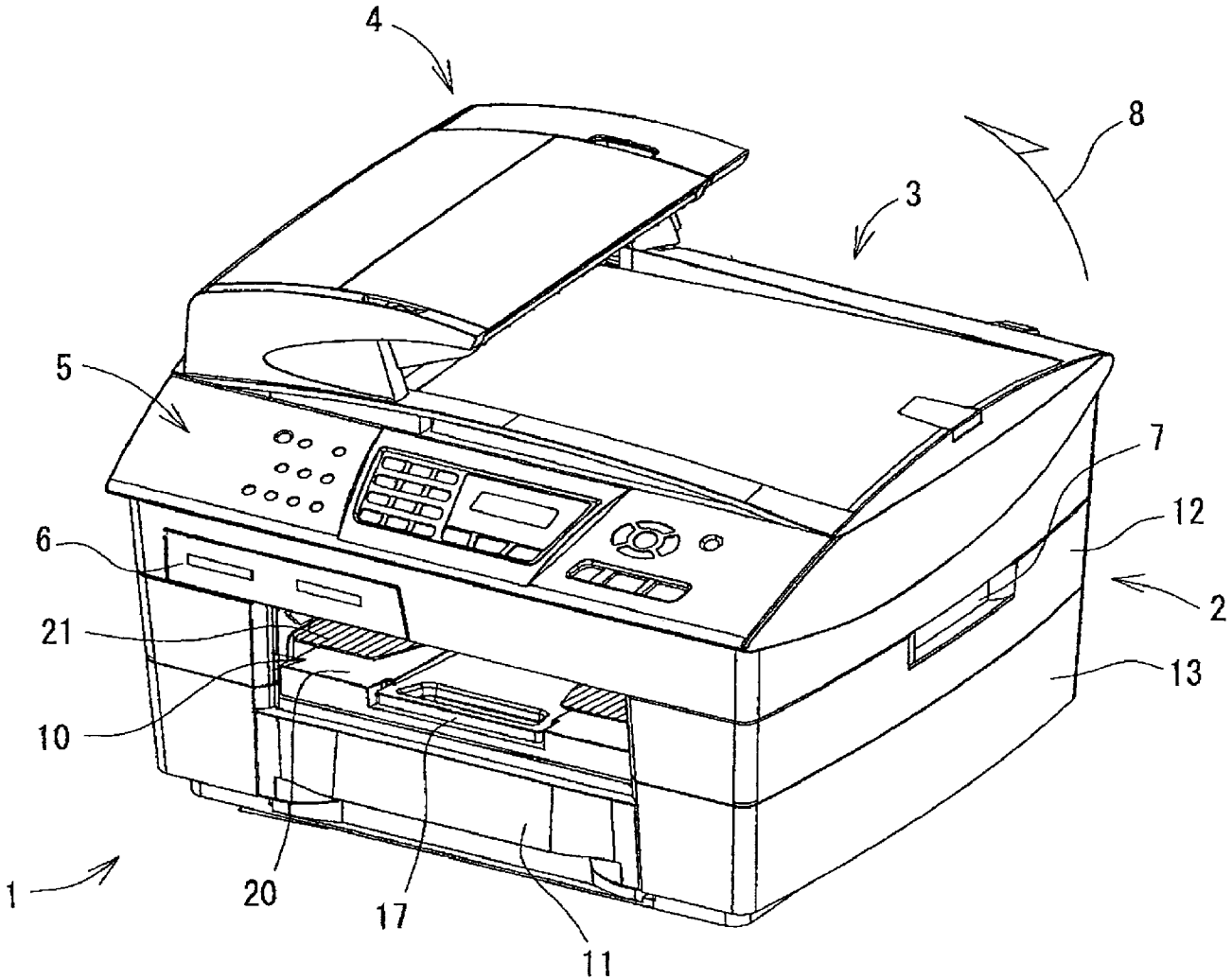
FIG. 1 is an external perspective view of a multifunction apparatus according to one embodiment of the invention.

In FIG. 1, reference numeral 1 generally denotes a multifunction apparatus 1 as one form of an image recording apparatus according to the invention. The multifunction apparatus 1 is a multifunction device (MFD) having a printer function, a scanner function, a copy function, and a facsimile function. A lower portion and an upper portion of the multifunction apparatus 1 are constituted by a printer portion 2 and a scanner portion 3, respectively. The printer portion 2 of the multifunction apparatus 1 corresponds to the image recording apparatus according to the invention. That is, in the image recording apparatus of the invention, functions other than the printer function are optionally included. For instance, the image recording apparatus of the invention may take form of a printer of single function that does not have the scanner portion 3, that is, does not have the scanner function and the copy function.

The printer portion 2 operates to record an image or a document, on a recording sheet. Data of the image or document recorded on the recording sheet 9 is transmitted from an external information apparatus, which may be a computer or a digital camera, for instance. It is also possible to read image data from a storage medium inserted in the multifunction apparatus 1, and record an image on a recording sheet based on the image data by operating the printer portion 2. As the storage medium, various kinds of memory cards can be used. Further, it is also possible to read image data by the scanner portion 3, and record an image on a recording sheet based on the thus read image data by operating the printer portion 2.

The printer portion 2 has a sheet feeding apparatus according to the invention. At a front side of the multifunction apparatus 1 and in the printer portion 2, an opening 10 is formed. Inside the opening 10, a sheet supply tray 20 and a sheet catch tray 21 are disposed in vertical relation to each other, namely, the sheet catch tray 21 is over the sheet supply tray 20. The sheet supply tray 20 is one form of a first sheet holding portion according to the invention. The sheet supply tray 20 holds a recoding sheet. More specifically, the sheet supply tray 20 can hold a plurality of recording sheets 9 (shown in FIGS. 2 and 24-28) that are stacked and in various sizes not larger than A4 size, for instance, recording sheets of B5 size or postcards. The sheet supply tray 20 has an extension tray 17, which can be pulled to the front side of the multifunction apparatus 1 in order to enlarge a sheet supporting area of the sheet supply tray 20. By the provision of such an extension tray 17, the sheet supply tray 20 can hold a recording sheet of legal size. The recording sheet 9 held in the sheet supply tray 20 is supplied or fed out into the inside of the printer portion 2. A desired image is recorded on the thus supplied recording sheet 9, and then the recording sheet 9 is ejected onto the sheet catch tray 21.

Under the sheet supply tray 20, there is disposed a sheet supply cassette 11. The sheet supply cassette 11 is one form of a second sheet holding portion according to the invention. The multifunction apparatus 1 has housings 12, 13 that are vertically arranged. The housing 13 has an opening at its front side into which the sheet supply cassette 11 is extractably insertable, but the front opening of the housing 13 is not shown in FIG. 1. The sheet supply cassette 11 can hold a stack of recording sheets in A4 size, legal size, or B5 size. The number of recoding sheets that the sheet supply cassette 11 can hold is about several times to ten times the number of recording sheets that the sheet supply tray 20 can hold, but not limited thereto. Generally, the sheet supply cassette 11 holds recording sheets of a kind that is frequently used. In this embodiment, the housing 13 with the sheet supply cassette 11 is detachably attachable to the housing 12. Hence, depending on the option settings and the model of the multifunction apparatus 1, the housing 13 with the sheet supply cassette 11 may not be included in the multifunction apparatus 1. Alternatively, the housing 13 may be formed integrally with the housing 12 such that it is impossible to detach the housing 13 from the housing 12.

The scanner portion 3 constituting an upper portion of the multifunction apparatus 1 includes a flatbed scanner and an auto document feeder 4 that is an automatic document feeding mechanism. Since the scanner portion 3 is not directly relevant to the invention, detailed description thereof is omitted.

At a front side of the upper portion of the multifunction apparatus 1, an operation panel 5 is disposed. In the operation panel 5, various kinds of manual operation buttons and a liquid crystal display are disposed. The manual operation buttons include, for instance, a power button operated to turn on and off the multifunction apparatus 1, a start button operated to input an instruction to start reading or recording an image, a stop button operated to input an instruction to stop an operation, a mode selector button operated to selectively establish one of a plurality of modes, such as copy mode, scanner mode, and facsimile mode, and a numeric keypad operated to make various kinds of settings such as conditions of image recording or image reading and to input a facsimile number. The multifunction apparatus 1 operates in accordance with instructions inputted through the operation panel 5. In the case where the multifunction apparatus 1 is connected with an external information apparatus, the multifunction apparatus 1 can operate in accordance with an instruction received from the external information apparatus through software such as a printer driver or a scanner driver.

At the front side of the multifunction apparatus 1, a slot portion 6 is disposed. Into the slot portion 6, a plurality of kinds of small memory cards are insertable. Data of a plurality of images stored in a small memory card inserted in the slot portion 6 is read out when a predetermined instruction is inputted through the operation panel 5. Information related to the data of the images thus read is presented on the liquid crystal display in the operation panel 5. Based on the presented information, a desired one of the images can be recorded by the printer portion 2 on the recording sheet 9.

Figure 2:
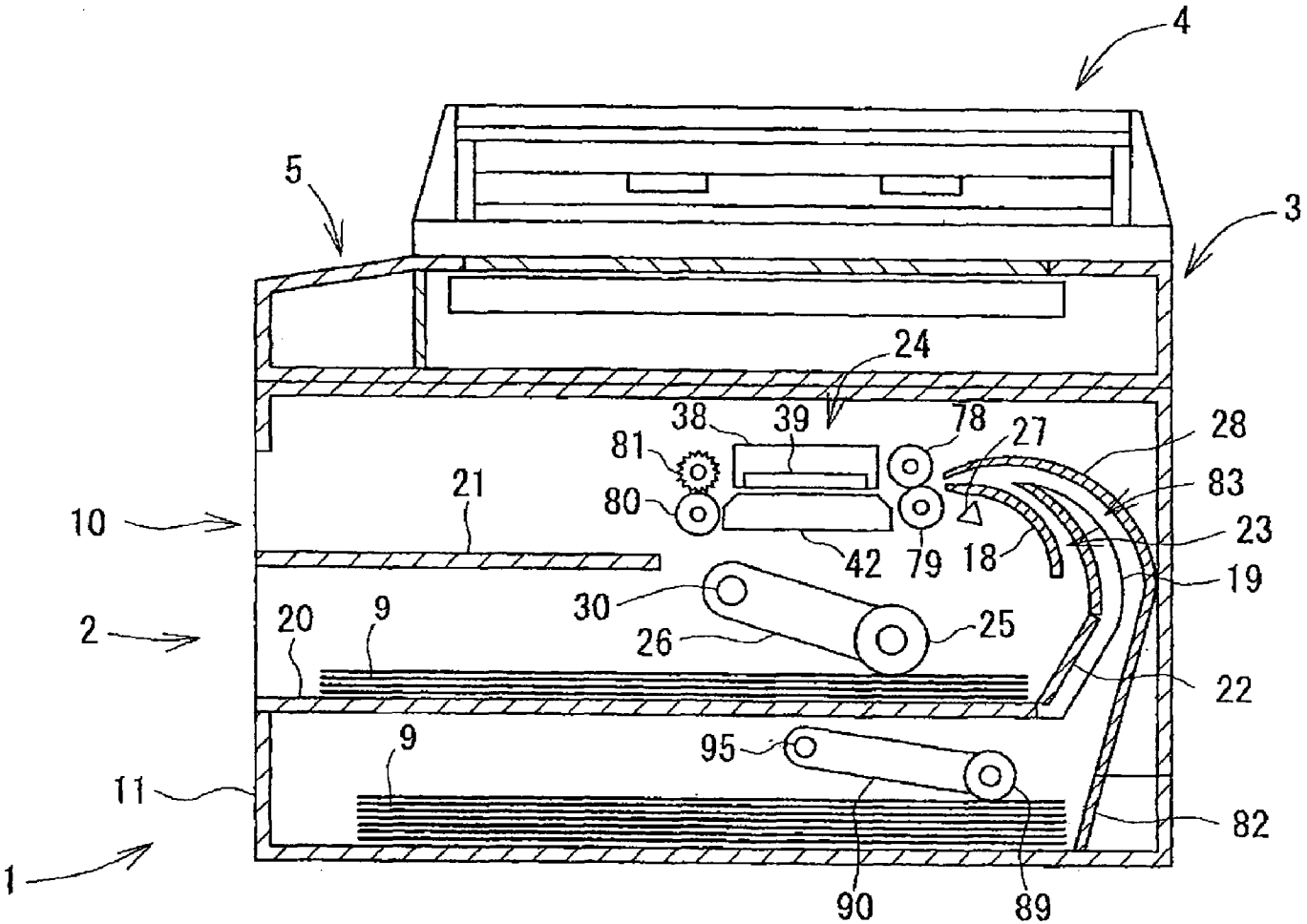
FIG. 2 is a vertical cross-sectional view schematically showing an internal structure of the multifunction apparatus.

There will be now described an internal structure of the multifunction apparatus 1. FIG. 2 is a vertical cross-sectional view that schematically shows the internal structure of the multifunction apparatus 1. As FIG. 2 shows, a first separator plate 22 is disposed on the rear side of the sheet supply tray 20. A front end or a leading edge of each of the stack of recording sheets 9 held in the sheet supply tray 20 is contacted with an inner surface of the first separator plate 22, which inner surface inclines rearward. That is, when a topmost one of the stacked recording sheets 9 is supplied or fed out from the sheet supply tray 20, the topmost recording sheet 9 is separated from the rest of the recording sheets and guided into a first feed path 23, by the first separator plate 22.

The first feed path 23 extends from the first separator plate 22 initially upward and then frontward, and ends at the sheet catch tray 21. On the upstream side of the sheet catch tray 21 with respect to a direction in which the recording sheet 9 is fed (which direction will be hereinafter referred to as "feeding direction"), an image recording unit 24 is disposed. The recording sheet 9 supplied into the first feed path 23 from the sheet supply tray 20 is then guided upward from a lower side by and along the first feed path 23 to a position corresponding to the image recording unit 24, during which the recording sheet 9 is turned over. At the position corresponding to the image recording unit 24, the recording sheet 9 is subjected to image recording, that is, an image is recorded on the recording sheet 9 by the image recording unit 24. Then, the recording sheet 9 is ejected onto the sheet catch tray 21.

Over the sheet supply tray 20, a first pickup roller 25 is disposed. The first pickup roller 25 is supported at a distal end of a first swing arm 26 such that the first pickup roller 25 is rotatable. A pivot point of the first swing arm 26 is provided by a pivot shaft 30, that is, the first swing arm 26 is pivotable around the pivot shaft 30 and thus vertically movable such that the first pickup roller 25 can be brought into contact with, and separated away from, the sheet supply tray 20. The first swing arm 26 is held biased downward, that is, in a direction to contact the sheet supply tray 20, by its own weight or by a force from a spring or others. The first swing arm 26 retracts upward when the sheet supply tray 20 is inserted and pulled out. When the first swing arm 26 moves downward, the first pickup roller 25 at the distal end of the first swing arm 26 is brought into contact with the topmost one of the recording sheets 9 on the sheet supply tray 20.

Figure 7:
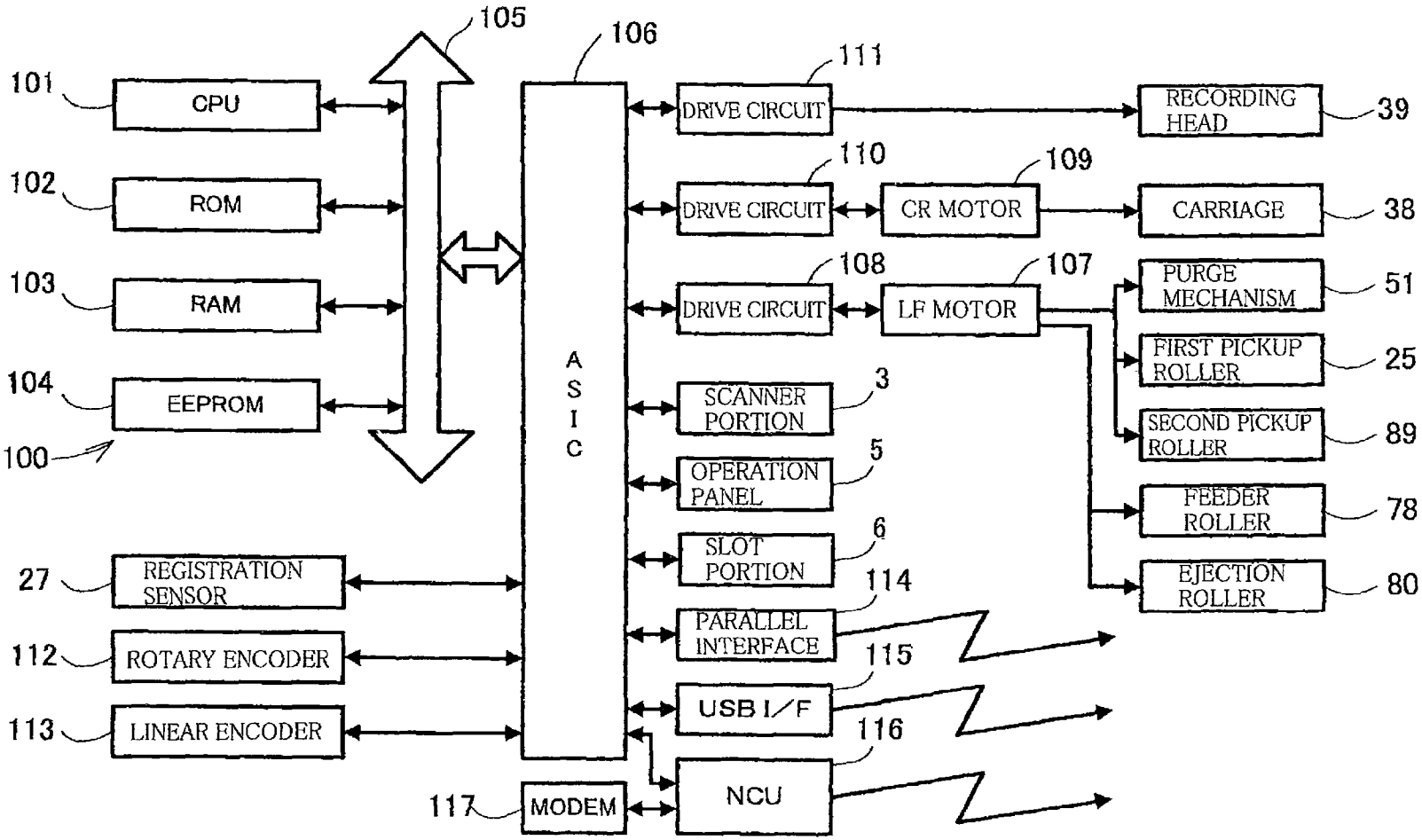
FIG. 7 is a block diagram of a control portion of the multifunction apparatus.

The first pickup roller 25 receives a driving torque from a LF motor 107 (Line Feed Motor) shown in FIG. 7 and is rotated thereby. The LF motor 107 is one form of a driving source according to the invention. A transmission path along which the driving torque is transmitted from the LF motor 107 to the first pickup roller 25 will be described later. When the first pickup roller 25 rotates, a frictional force occurs between a circumferential surface of the first pickup roller 25 and the topmost recording sheet, thereby feeding the topmost recording sheet 9 out toward the first separator plate 22. Then, the leading edge of the recording sheet 9 contacts the first separator plate 22, whereby the recording sheet 9 is guided into the first feed path 23. It is sometimes the case that when the topmost recording sheet 9 is supplied or fed out in this way by the first pickup roller 25, multi-feeding occurs, that is, the next recording sheet, which is a recording sheet immediately under the topmost recording sheet 9, is together fed out due to the friction or an electrostatic force. According to the present embodiment, however, the contact of the next recording sheet with the first separator plate 22 inhibits the next recording sheet 9 from being fed into the first feed path 23, and only the topmost recording sheet 9 is introduced into the first feed path 23.

The first feed path 23 is defined between an outer guide surface and an inner guide surface that are opposed to each other with a spacing therebetween, except a part where the image recording unit 24 is disposed. For instance, a portion of the first feed path 23 at the rear side of the multifunction apparatus 1 where the first feed path 23 is curved is defined between first and second guide members 18, 19 that are opposed to each other with a spacing therebetween and are fixed to a frame of the multifunction apparatus 1. Although not shown in FIG. 2, a roller for smoothing feeding of the recording sheet is disposed at the curved portion of the first feed path 23 such that circumferential surface of the roller protrudes from the outer guide surface and the roller is rotatable around an axis that extends in a lateral direction of the first feed path 23.

On the downstream side, in the feeding direction, of the curved portion of the first feed path 23, the image recording unit 24 is disposed. The image recording unit 24 includes a carriage 38 and a recording head 39 mounted on the carriage 38. The carriage 38 reciprocates in a main scanning direction, which is a direction intersecting the feeding direction. In this specific example, the main scanning direction is perpendicular to the feeding direction. To the recording head 39, cyan (C), magenta (M), yellow (Y), and black (Bk) inks are supplied from respective ink cartridges via ink tubes 41 shown in FIG. 3. Although not shown in FIG. 2, the ink cartridges are disposed in the multifunction apparatus 1 separately from the recording head 39. While the carriage 38 is reciprocated, the recording head 39 selectively ejects the inks in the form of minute droplets, thereby forming an image on the recording sheet 9 while the recording sheet 9 is fed over a platen 42.

Figure 3:
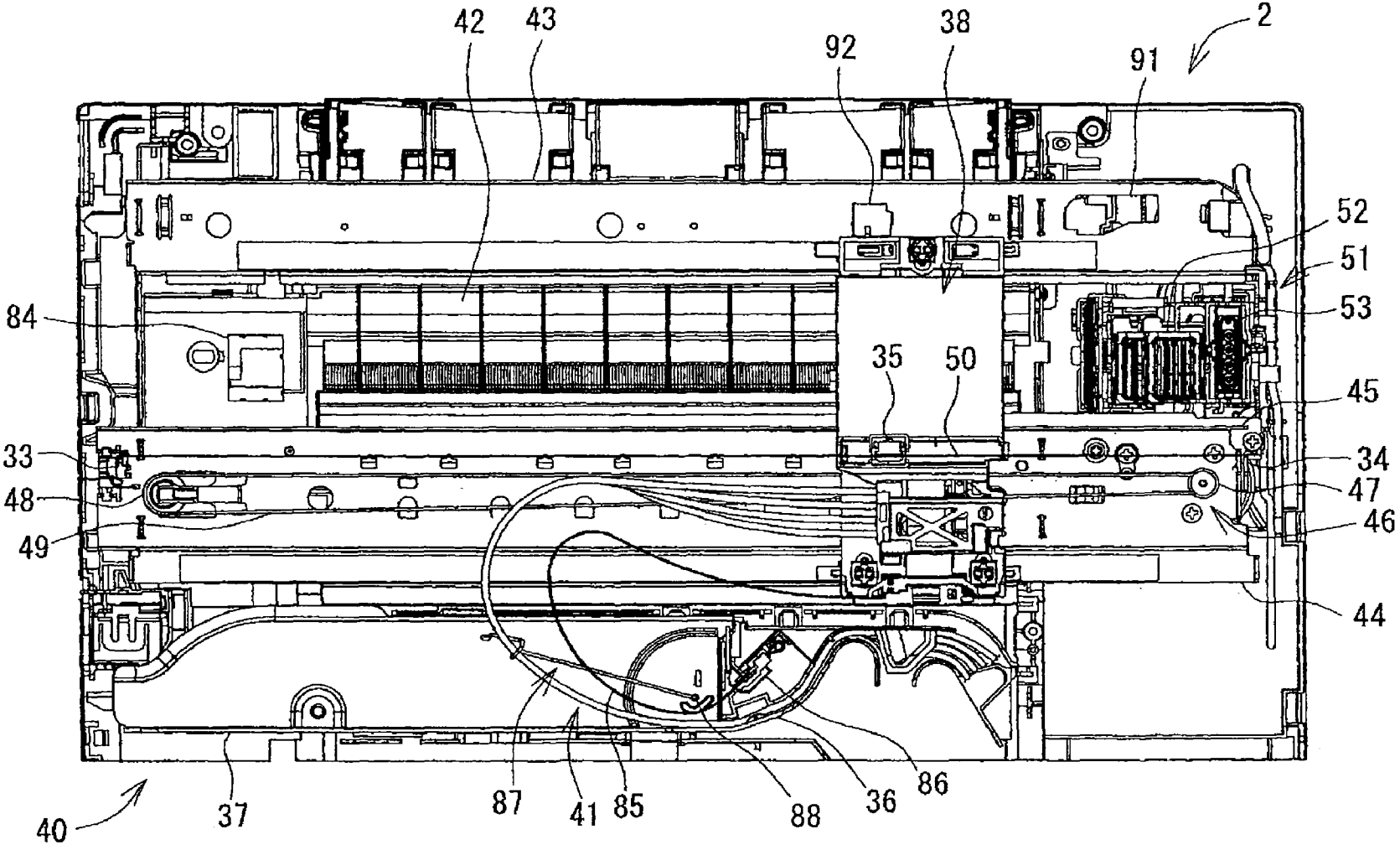
FIG. 3 is a plan view showing a principal structure of a printer portion of the multifunction apparatus.

FIG. 3 is a plan view showing a principal structure of the printer portion 2. FIG. 3 mainly shows substantially a rear half of the printer portion 2. As shown in FIG. 3, a pair of guide rails 43, 44 are disposed over the first feed path 23, with a spacing between the guide rails 43, 44 in the feeding direction, which is from the upper side to the lower side as seen in FIG. 3. The guide rails 43, 44 extend in a direction perpendicular to the feeding direction, or in a lateral direction as seen in FIG. 3. The guide rails 43, 44 are disposed in the housing of the printer portion 2, and constitute a part of a frame 40 that supports components constituting the printer portion 2. The carriage 38 is attached to the guide rails 43, 44 thereacross such that the carriage 38 is slidable in the direction perpendicular to the feeding direction.

The guide rail 43 is one of the two guide rails 43, 44 that is disposed on the upperstream side than the other guide rail 44 with respect to the feeding direction. The guide rail 43 is an elongate plate member, a length or a dimension of which in the lateral direction of the first feed path 23 (i.e., the lateral direction as seen in FIG. 3) is larger than a range of reciprocation of the carriage 38. The guide rail 44 is the one of the two guide rails 43, 44 that is disposed on the downstream side with respect to the feeding direction. The guide rail 44 is an elongate plate member, a length of a dimension of which in the lateral direction of the first feed path 23 is substantially the same as that of the guide rail 43. On of two opposite ends of the carriage 38 on the upperstream side in the feeding direction is attached to the guide rail 43, and the other end of the carriage 38 on the downstream side in the same direction is attached to the guide rail 44. Being thus attached to the guide rails 43, 44, the carriage 38 can slide in the longitudinal direction of the guide rails 43, 44. An edge portion 45 of the guide rail 44 on the upstream side in the feeding direction is bent substantially vertically upward. The carriage 38 is made movable relative to the guide rail 44, by an arrangement, for instance, such that the carriage 38 has a pair of rollers that hold the edge portion 45 of the guide rail 44 from the opposite sides. Thus holding the edge portion 45, the carriage 38 is positioned in the feeding direction while allowed to slide in the direction perpendicular to the feeding direction.

On an upper surface of the guide rail 44, a belt drive mechanism 46 is disposed. The belt drive mechanism 46 includes a drive pulley 47, a driven pulley 48, and a timing belt 49. The drive pulley 47 and the driven pulley 48 are respectively disposed at two longitudinal end portions of the guide rail 44 to be rotatable around respective rotation shafts extending in a vertical direction of the multifunction apparatus 1, which is perpendicular to a surface of the sheet on which FIG. 3 is presented. The timing belt 49 is an endless belt that is wound around the drive and driven pulleys 47, 48 and has teeth on an inner surface thereof. To the rotation shaft of the drive pulley 47, a driving torque of a CR motor 109 (shown in FIG. 7) is transmitted. A rotation of the drive pulley 47 circulates the timing belt 49. It is noted that the timing belt 49 may not be an endless belt, but may be a belt having two ends, which are fixed to the carriage 38.

The carriage 38 is coupled at its bottom side to the timing belt 49. The circulation of the timing belt 49 reciprocates the carriage 38 in sliding contact with the guide rails 43, 44. The recording head 39 reciprocates with the carriage 38 in the lateral direction of the first feed path 23 that corresponds to the main scanning direction.

On the guide rail 44, an encoder strip 50 of a linear encoder 113 (shown in FIG. 7) is disposed. The encoder strip 50 is a band-like member. At two ends of the guide rail 44 in its longitudinal direction, i.e., the direction in which the carriage 38 reciprocates, supporters 33, 34 are respectively disposed. The supporters 33, 34 stand upright from the upper surface of the guide rail 44. To the supporters 33, 34, two opposite ends of the encoder strip 50 are respectively fixed.

On the encoder strip 50 is put a pattern such that a light-blocking portion where light can not pass through and a light-transmissive portion where light is allowed to pass through are alternately arranged at a constant pitch along the longitudinal direction of the encoder strip 50. On an upper surface of the carriage 38 and at a position corresponding to the encoder strip 50, an optical sensor 35 is disposed. The optical sensor 35 is a light-transmission sensor that has a light emitting element and a light receiving element. The optical sensor 35 reciprocates with the carriage 38 along the longitudinal direction of the encoder strip 50. During this reciprocation, the optical sensor 35 detects the pattern of the encoder strip 50. Although not shown in FIG. 3, on the carriage 38 are mounted a head control board for controlling the ejection of ink droplets, and a head cover that covers the head control board. On the basis of a signal indicative of the pattern being detected by the optical sensor 35, the head control board outputs a pulse signal, from which the position of the carriage 38 is determined. The reciprocation of the carriage 38 is controlled on the basis of the position thereof thus determined.

As FIGS. 2 and 3 show, the platen 42 is disposed under the first feed path 23. The platen 42 is opposed to the recording head 39 with a spacing therebetween. The recording sheet 9 being fed passes by a middle portion of the range of reciprocation of the carriage 38, and the platen 42 extends across the entirety of the middle portion of the range. A longitudinal dimension of the platen 42 is sufficiently larger than a width of a recording sheet of the kind having the greatest width among all the kinds of recording sheets that the sheet feeding apparatus can handle, in order that a recording sheet of any size is supportable by the platen 42 across the entire width thereof as long as the sheet feeding apparatus can handle the recording sheet.

Figure 4:
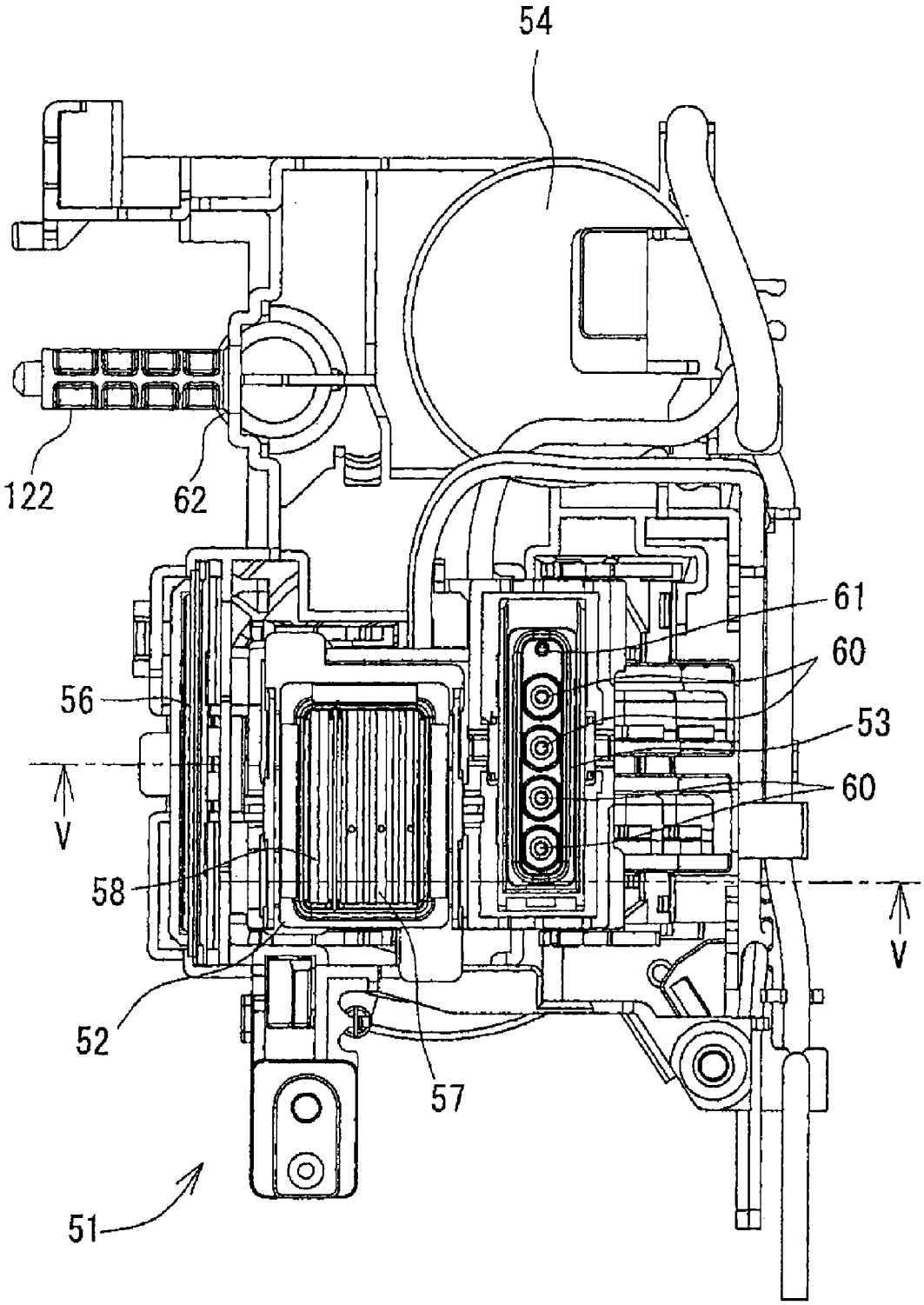
FIG. 4 is a plan view of a purge mechanism in the printer portion of the multifunction apparatus.
Figure 5:
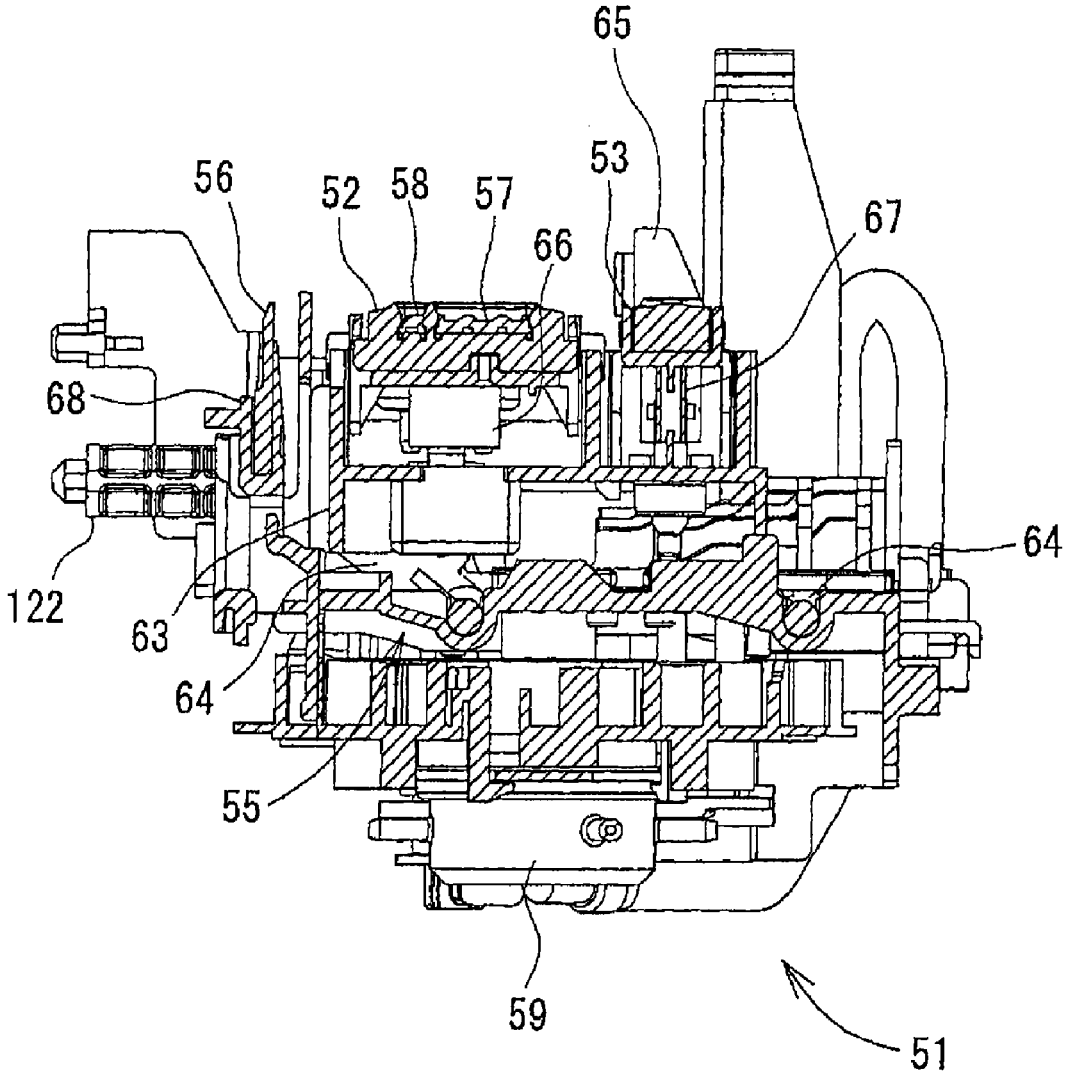
FIG. 5 is a cross-sectional view taken along line 5-5 in FIG. 4, where a nozzle cap and an air-outlet cap in the purge mechanism are not lifted.
Figure 6:
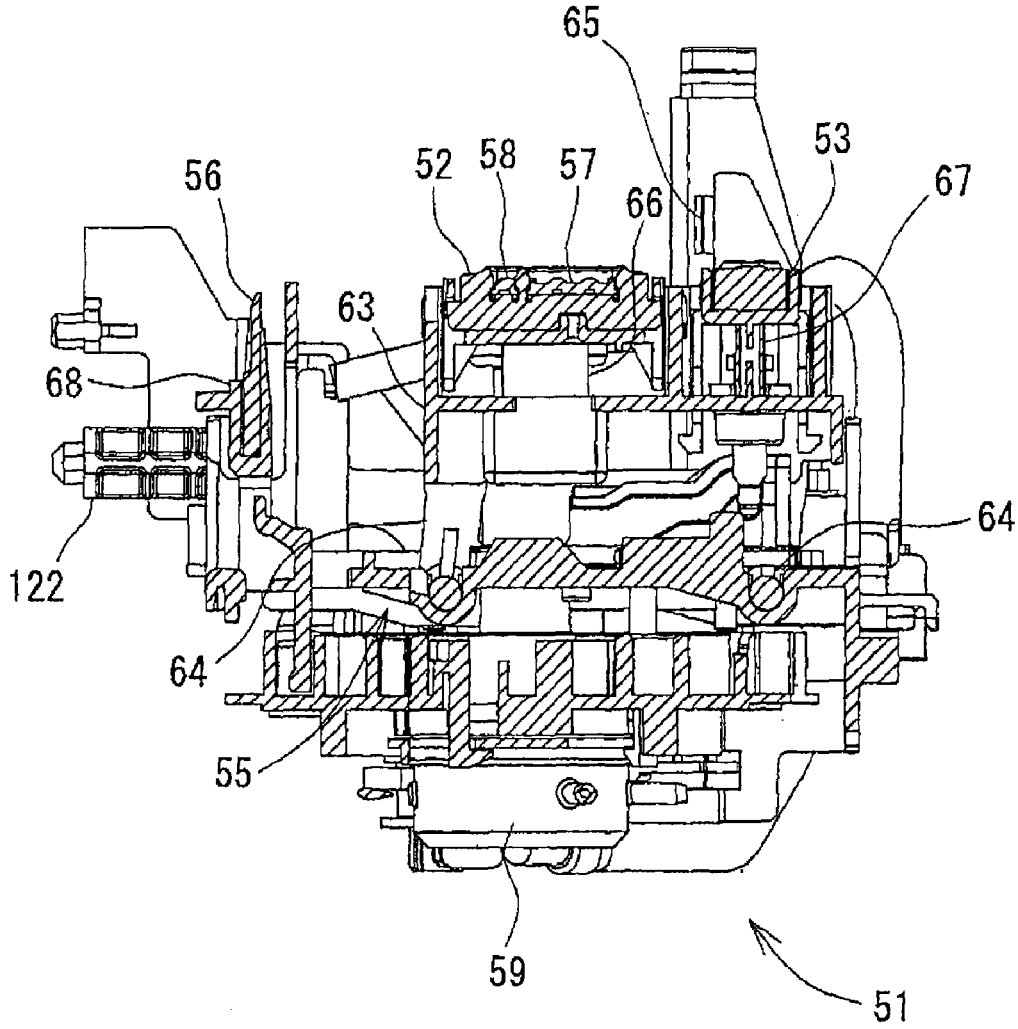
FIG. 6 is a cross-sectional view corresponding to FIG. 5 but in a state where the nozzle cap and the air-outlet cap are lifted.

As FIG. 3 shows, at a position outside the range of passage of the recording sheet, that is, at a position outside an image recording range across which an image is recorded by the recording head 39, a maintenance unit including a purge mechanism 51 and a waste-ink tray 84 is disposed. FIG. 4 is a plan view of the purge mechanism 51. FIG. 5 is a cross-sectional view taken along line 5-5 in FIG. 4, where a nozzle cap 52 and an air-outlet cap 53 of the purge mechanism 51 are not lifted. FIG. 6 is a cross-sectional view corresponding to FIG. 5 but in a state where the nozzle cap 52 and air-outlet cap 53 are lifted.

The purge mechanism 51 sucks and removes bubbles and foreign matter from nozzles formed in the recording head 39. As FIGS. 4-6 show, the purge mechanism 51 has a nozzle cap 52, an air-outlet cap 53, a pump 54, a lifting mechanism 55, and a wiper blade 56. The nozzle cap 52 covers nozzles (not shown) open in a nozzle surface of the recording head 39, which is constituted by an under surface of the recording head 39. The air-outlet cap 53 covers four air outlets (not shown) open in the nozzle surface. The pump 54 is connected to the nozzle cap 52 or the air-outlet cap 53 when bubbles and foreign matter are to be sucked. The lifting mechanism 55 moves the nozzle cap 52 and the air-outlet cap 53 into contact with and away from the recording head 39. The wiper blade 56 wipes the nozzle surface of the recording head 39.

The nozzle cap 52 is formed of rubber and can establish a sealing engagement with the nozzle surface of the recording head 39 around the nozzles. A space inside the nozzle cap 52 is divided into two smaller spaces, one of which corresponds to nozzles for the color (CMY) inks, and the other of which corresponds to nozzles for the black (Bk) ink. At positions on an inner surface of the nozzle cap 52 corresponding to the two smaller spaces, respectively, support members 57, 58 are fitted. The support members 57, 58 function to prevent buckling or inclination of a lip portion of the nozzle cap 52. Although not shown in FIGS. 4-6, an air inlet opens in the nozzle cap 52 at a bottom of each of the two smaller spaces. Each air inlet is connectable to the pump 54 via a port switching mechanism 59 that switches a port by operation of a cam.

The air-outlet cap 53 is formed of rubber and can establish a sealing engagement with the nozzle surface of the recording head 39 around the air outlets. Inside the air-outlet cap 53, four push rods 60 extend vertically upward to correspond to the respective air outlets for the C, M, Y, and Bk inks. When each push rod 60 is inserted into the corresponding air outlet, a check valve of the air outlet opens. The push rods 60 are disposed to be able to upward advance out of the air-outlet cap 53. For instance, among the four push rods 60, three of them 60 for the color (C, M, and Y) inks are together advanced upward out of the air-outlet cap 53, and the other push rod 60 for the black (Bk) ink is advanced upward out of the air-outlet cap 53 independently of the other three push rods 60. When the three push rods 60 for the CMY inks or the push rod 60 for the Bk ink, or all of the push rods 60, are upward advanced out of the air-outlet cap 53, the push rod(s) 60 are/is inserted into the corresponding air outlet(s) formed in the recording head 39. At a bottom of the air-outlet cap 53, there opens an air inlet 61, which is connectable to the pump 54 via the port switching mechanism 59.

The port switching mechanism 59 selectively makes a switch between (a) a state where a suction passage in communication with the air inlets of the nozzle cap 52 is connected to the pump 54, and a suction passage in communication with the air inlet 61 of the air-outlet cap 53 is disconnected from the pump 54, and (b) a state where the suction passage in communication with the air inlets of the nozzle cap 52 is disconnected from the pump 54, and the suction passage in communication with the air inlet 61 of the air-outlet cap 53 is connected to the pump 54.

The pump 54 is of so-called rotary type and has a pump gear that is rotated when the pump 54 is operated to suck bubbles and foreign matter. To the pump gear, a driving torque is transmitted via a bevel gear 62. In FIGS. 4-6, the pump gear and details of a transmission mechanism for transmitting the driving torque to the pump gear are not shown; in brief, on the basis of the driving torque transmitted to the bevel gear 62, the pump gear is driven and the pump 54 performs a sucking operation. On the upper side of the bevel gear 62, a shaft 122 horizontally extends. The shaft 122 supports first to fourth transmission gears 123-126 (described later) such that the transmission gears 123-126 are rotatable around the shaft 122.

The lifting mechanism 55 translates a holder 63 between a standby position and a contact position by a pair of isometric links 64 disposed at the right-hand side and the left-hand side, respectively. FIGS. 5 and 6 respectively show the holder 63 located at the standby position and at the contact position. The holder 63 is translated by the isometric links 64 in the lateral direction as seen in FIGS. 5 and 6 (i.e., the direction in which the carriage 38 reciprocates), in a manner to draw a circular-arc shaped locus. Although not shown in FIGS. 5 and 6, the holder 63 is normally held at the standby position by being biased by a spring. The holder 63 has a contact lever 65 protruding vertically upward. When the carriage 38 pushes the contact lever 65 rightward as seen in FIG. 5, the holder 63 is moved to the contact position against the biasing force of the spring. On the holder 63, the nozzle cap 52 and the air-outlet cap 53 are disposed such that these caps 52 and 53 are biased upward by coil springs 66, 67, respectively. When the holder 63 is moved to the contact position, the nozzle cap 52 and the air-outlet cap 53 are brought into contact with the nozzle surface of the recording head 39 around the nozzles and around the air outlets, respectively. While the holder 63 is at the contact position, the coil springs 66, 67 elastically press the nozzle cap 52 and the air-outlet cap 53 onto the nozzle surface of the recording head 39 and are compressed thereby. Thus, the nozzle cap 52 and the air-outlet cap 53 air-tightly contact the recording head 39 around the nozzles and the air outlets, respectively.

The wiper blade 56 is disposed on a wiper holder 68 such that the wiper blade 56 can protrude from and retract into the wiper holder 68. The wiper blade 56 is formed of rubber and has a length corresponding to that of the nozzle surface of the recording head 39. When the wiper blade 56 is made to protrude from the wiper holder 68, a tip or an upper end of the wiper blade 56 contacts the nozzle surface of the recording head 39 across the entire length thereof in the feeding direction. As the recording head 39 is laterally moved with the carriage 38 with the wiper blade 56 in contact with the nozzle surface of the recording head 39, the wiper blade 56 wipes off inks adhering to the nozzle surface. The wiper blade 56 is protruded and retracted by a cam mechanism not shown. The cam mechanism makes the wiper blade 56 protrude when the recording head 39 is to be slid toward the image recording range after purging has been implemented.

When bubbles and others are to be removed from the recording head 39 by sucking them, the recording head 39 is moved in order that the carriage 38 is located over the nozzle cap 52 and the air-outlet cap 53, whereby the contact lever 65 is pushed by the carriage 38 and thus the nozzle cap 52 and the air-outlet cap 53 are moved to the contact position by the operation of the lifting mechanism 55 and brought into contact with the recording head 39. Thus, a sealing engagement is established between the nozzle cap 52 and the recording head 39 around the nozzles, and between the air-outlet cap 53 and the recording head 39 around the air outlets. The port switching mechanism 59 switches the connecting/disconnecting state of the nozzle cap 52 and the air-outlet cap 53 with/from the pump 54 in a predetermined manner. For instance, when the inks are to be sucked from the nozzles of the recording head 39, the nozzle cap 52 is connected to the pump 54 and the air-outlet cap 53 is disconnected from the pump 54. In this state, a driving torque is transmitted from the LF motor 107 to the bevel gear 62 of the pump 54, whereby the pump 54 performs a sucking operation. By the sucking operation of the pump 54, a negative pressure is produced inside the nozzle cap 52, thereby sucking the inks from the nozzles of the recording head 39. The bubbles and foreign matter in the nozzles are sucked together with the inks and removed thereby. Thereafter, as the carriage 38 is moved off from the contact lever 65, the nozzle cap 52 and the air-outlet cap 53 are moved to the standby position by the operation of the lifting mechanism 55. Further, the wiper blade 56 is brought into contact with the nozzle surface of the recording head 39 that is being slid with the carriage 38 on which the recording head 39 is mounted, in order to wipe off the inks adhering to the nozzle surface of the recording head 39.

As FIG. 2 shows, on the upstream side of the image recording unit 24, a pair of rollers 78, 79, namely, a feeder roller 78 and a pinch roller 79, are disposed. The feeder roller 78 and the pinch roller 79 nip therebetween the recording sheet 9 having been fed thereto along the first feed path 23, and feed the recording sheet 9 to a position over the platen 42. To the feeder roller 78, a driving torque is transmitted from the LF motor 107 via a transmission path, whereby the feeder roller 78 is intermittently driven at a constant pitch corresponding to a predetermined line feed width. The pinch roller 79 is movable in a direction toward and away from the feeder roller 78, and held biased in a direction to contact the feeder roller 78 by a coil spring. When the recording sheet 9 is fed into the nip between the feeder roller 78 and the pinch roller 79, the pinch roller 79 presses the recording sheet 9 onto the feeder roller 78 while retracting by an amount corresponding to a thickness of the recording sheet 9 against the biasing force of the coil spring. Hence, the recording sheet 9 can be fed with stability.

On the downstream side of the image recording unit 24, a pair of rollers, namely, an ejection roller 80 and a gear roller 81, are disposed. The ejection roller 80 and the gear roller 81 nip therebetween the recording sheet 9 on which an image has been recorded, and feed the recording sheet 9 to the sheet catch tray 21. The feeder roller 78 and the ejection roller 80 are intermittently driven at the constant pitch corresponding to the line feed width, by a driving torque from the LF motor 107. The rotations of the feeder roller 78 and the ejection roller 80 are synchronized. The feeder roller 78 is provided with a rotary encoder 112 (shown in FIG. 7). The rotary encoder 112 includes an encoder disk that rotates with the feeder roller 78, and an optical sensor that detects a pattern of the encoder disk. On the basis of a signal indicative of the detection by the optical sensor, rotations of the feeder roller 78 and the ejection roller 80 are controlled. It is noted that the rotary encoder 112 is not depicted in FIG. 3.

Since the gear roller 81 contacts the recording sheet 9 on which an image has been recorded, teeth like those of a spur are formed on a circumferential surface of the gear roller 81 so as not to degrade the image recorded on the recording sheet 9 by the contact of the gear roller 81 with the recording sheet 9. The gear roller 81 is movable toward and away from the ejection roller 80, and held biased by a coil spring in a direction to contact the ejection roller 80. When a recording sheet 9 is fed into the nip between the ejection roller 80 and the gear roller 81, the gear roller 81 presses the recording sheet 9 onto the ejection roller 80 while retracting by an amount corresponding to a thickness of the recording sheet 9 against the biasing force of the coil spring. Hence, the recording sheet 9 can be fed with stability.

As FIG. 2 shows, under the sheet supply tray 20 is disposed or inserted the sheet supply cassette 11. The sheet supply cassette 11 is a box-like member open at its upper side, and holds or accommodates therein a plurality of recording sheets 9 stacked. On the rear side of the sheet supply cassette 11, a second separator plate 82 is disposed. A leading edge of each of the recording sheets 9 held in the sheet supply cassette 11 is contacted with an inner surface of the second separator plate 82, which inner surface inclines rearward. That is, when a topmost one of the stacked recording sheets 9 is supplied or fed out from the sheet supply cassette 11, the topmost recording sheet 9 is separated from the rest of the recording sheets and upward guided, by the second separator plate 82.

From the second separator plate 82, a second feed path 83 extends upward. The second feed path 83 then turns to the front side of the multifunction apparatus 1, and is connected with the first feed path 23 at a position upstream of the feeder roller 78 with respect to the feeding direction. The second feed path 83 is defined between the second guide member 19 and a third guide member 28 disposed on the outer or rear side of the second guide member 19. That is, an inner guide surface of the second feed path 83 is provided by a rear surface of the second guide member 19, a front surface of which provides the outer guide surface of the first feed path 23. Each of the recording sheets 9 accommodated in the sheet supply cassette 11 is guided upward in a U-turn manner by and along the second feed path 83 into the first feed path 23. Then, an image is recorded on the recording sheet 9 by the image recording unit 24, after which the recording sheet 9 is ejected onto the sheet catch tray 21.

In the first feed path 23, a registration sensor 27 is disposed, at a position between a point where the first and second feed paths 23, 83 join and a point where the feeder roller 78 and the pinch roller 79 are disposed. Although details are not shown in FIG. 2, the registration sensor 27 is a mechanical switch having a detecting element that can advance into and retract from the first feed path 23. The detecting element is biased by a spring to be held advanced into the first feed path 23. When a recoding sheet contacts the detecting element while fed in the first feed path 23, the detecting element retracts from the first feed path 23 against the biasing force of the spring. Such advancing and retracting movements of the detecting element are detected by the optical sensor. The registration sensor 27 outputs an electrical signal (an ON signal) upon detection of a recording sheet.

Over the sheet supply cassette 11, a second pickup roller 89 is disposed to supply recording sheets 9 stacked on the sheet supply cassette 11 into the second feed path 83. A rotation shaft of the second pickup roller 89 is supported at a distal end of a second swing arm 90. To the second pickup roller 89, a driving torque of the LF motor 107 (shown in FIG. 7) is transmitted and rotated thereby. A transmission path along which the driving torque is transmitted from the LF motor 107 to the second pickup roller 89 will be described later.

The second swing arm 90 is pivotable around a pivot shaft 95 to be vertically movable toward and away from an inner bottom surface of the sheet supply cassette 11. The second swing arm 90 is held biased by its own weight or a biasing force of a spring or others in a direction to contact the sheet supply cassette 11. The second swing arm 90 retracts upward when the sheet supply cassette 11 is inserted and pulled out. When the second swing arm 90 moves downward, the second pickup roller 89 at the distal end of the second swing arm 90 is brought into contact with the stack of recording sheets 9 accommodated in the sheet supply cassette 11. When the second pickup roller 89 is rotated in this state, a topmost one of the stacked recording sheets 9 is supplied or fed out toward the second separator plate 82 by friction between a circumferential surface of the second pickup roller 89 and the topmost recording sheet. The recording sheet 9 fed out comes to contact at its leading edge with the second separator plate 82 and is thereby guided upward into the second feed path 83. At this time, multi-feeding sometimes occurs, that is, when the topmost recording sheet 9 is fed out by the second pickup roller 89, the next recording sheet 9 immediately under the topmost recording sheet 9 may be together fed out due to friction or an electrostatic force. However, the next recording sheet 9 inhibited from further proceed by its contact with the second separator plate 82.

FIG. 7 is a block diagram of a control portion 100 of the multifunction apparatus 1. The control portion 100 generally controls operation of the multifunction apparatus 1 including operations of the scanner portion 3 and the printer portion 2. The control portion 100 is constituted by a mainboard connected to a flat cable 85, and controls rotation of the LF motor 107 as a driving source, and switching of a drive switching mechanism described later. It is noted that since the structure of the scanner portion 3 is not directly relevant to the invention, detailed description thereof is omitted. As shown in FIG. 7, the control portion 100 is constituted by a microcomputer mainly constituted by a CPU (Central Processing Unit) 101, a ROM (Read Only Memory) 102, a RAM (Random Access Memory) 103, and an EEPROM (Electrically Erasable and Programmable ROM) 104, and is connected to an ASIC (Application Specific Integrated Circuit) 106 through a bus 105.

The ROM 102 stores programs for controlling various operations of the multifunction apparatus 1, and others. The RAM 103 is used as a storage area or a work area for temporarily storing various kinds of data that are used when the CPU 101 executes the programs. The EEPROM 104 stores settings, flags, and others that should be held even after the multifunction apparatus is turned off.

In the printer portion 2, each recording sheet 9 supplied from the sheet supply tray 20 is fed in a selected one of two feeding modes, namely, a normal feeding mode and a high-speed feeding mode. That is, when the printer portion 2 is in the normal feeding mode, recording sheets 9 are one by one supplied from the sheet supply tray 20 into the first feed path 23 and then each recording sheet is subjected to deskewing by the feeder roller 78 and the pinch roller 79. Thereafter, the recording sheet 9 is fed to a position over the platen 42 where image recording is performed, after which the image recording sheet 9 is ejected onto the sheet catch tray 21. Then, the next recording sheet 9 is supplied from the sheet supply tray 20, and the same processing is repeated for the next recording sheet 9. When the printer portion 2 is in the high-speed feeding mode, recording sheets 9 are consecutively supplied from the sheet supply tray 20 into the first feed path 23. That is, as soon as a first recording sheet 9 has been supplied from the sheet supply tray 20, the next recording sheet 9 is supplied from the sheet supply tray 20. Since a speed of rotation of the feeder roller 78 is set higher than that of the first pickup roller 25, the first recording sheet nipped between the feeder roller 78 and the pinch roller 79 is fed in the first feed path 23 at a speed higher than a speed at which the next recording sheet 9 is fed, thereby producing a predetermined distance between the first and next recording sheets 9. It is noted that in the high-speed feeding mode, the feeder roller 78 and the pinch roller 79 do not operate to deskew the recording sheets.

Images are consecutively recorded on the recording sheets 9 that are sequentially fed with each two recording sheets 9 consecutively fed being separated from each other by the predetermined distance.

Programs for controlling operations of the LF motor 107 and other members in the normal and high-speed feeding modes are respectively stored in the ROM 102. A program for controlling feeding of recording sheets 9 from the sheet supply cassette 11 and a program for controlling a purging operation are also stored in the ROM 102. When image recording is to be performed, the user sets recording conditions that are held in the RAM 103 for a predetermined time period. Thereafter when an instruction to start the image recording is inputted, the CPU 101 operates the printer portion 2 to perform the image recording, that is, controls the operations of the LF motor 107 and other members on the basis of the recording conditions held in the RAM 103. The recording conditions include: which one of the sheet supply tray 20 and the sheet supply cassette 11 is selected as the sheet holding portion from which recording sheets 9 are to be supplied; which one of the normal feeding mode and the high-speed feeding mode is selected as the feeding mode in which the recording sheets 9 are to be fed; and a resolution at which images are to be recorded.

The ASIC 106 generates, for instance, a phase excitation signal for energizing the LF motor 107 in accordance with an instruction from the CPU 101, and outputs the signal to a drive circuit 108 of the LF motor 107 to control rotation of the LF motor 107. The LF motor 107 is rotatable in two opposite directions, namely, in a forward direction and a reverse direction.

The drive circuit 108 is for driving the LF motor 107, by receiving the signal outputted from the ASIC 106, and generating an electrical signal based on which the LF motor 107 is rotated. The LF motor 107 receives the electrical signal and accordingly rotates. The torque of the LF motor 107 is transmitted to the first pickup roller 25, the purge mechanism 51, the feeder roller 78, the ejection roller 80, and the second pickup roller 89, via a drive switching mechanism and transmission assemblies. The drive switching mechanism and transmission assemblies will be described later.

The ASIC 106 generates a phase excitation signal for energizing the CR motor 109 in accordance with an instruction from the CPU 101, and outputs the signal to a drive circuit 110 of the CR motor 109, thereby controlling rotation of the CR motor 109.

The drive circuit 110 is for driving the CR motor 109. The drive circuit 110 receives the signal outputted from the ASIC 106 and generates an electrical signal based on which the CR motor 109 is rotated. The CR motor 109 receives the electrical signal and accordingly rotates. The torque of the CR motor 109 is transmitted to the carriage 38 via the belt drive mechanism 46, thereby reciprocating the carriage 38. In this way, reciprocation of the carriage 38 is controlled by the control portion 100.

A drive circuit 111 is for selectively ejecting droplets of the four inks of respective colors from the recording head 39 onto a recording sheet at predetermined timings. More specifically, the ASIC 106 generates a signal on the basis of a drive control procedure outputted from the CPU 101, and outputs the signal to the drive circuit 111 which accordingly controls an operation of the recording head 39. The drive circuit 111 is mounted on the head control board. The signal is transmitted from the mainboard constituting the control portion 100 to the head control board, through the flat cable 85.

To the ASIC 106 are connected the registration sensor 27 that detects a recording sheet 9 in the first feed path 23, the rotary encoder 112 that detects an amount of rotation of the feeder roller 78, and the linear encoder 113 that detects the position of the carriage 38. When the multifunction apparatus 1 is turned on, the carriage 38 is moved to one of two longitudinal ends of the guide rails 43, 44, and the position of the carriage 38 as detected by the linear encoder 113 and stored is initialized or reset to an initial position. When the carriage 38 moves in sliding contact with the guide rails 43, 44 from the initial position, the optical sensor 35 disposed in the carriage 38 detects the pattern of the encoder strip 50, and the control portion 100 counts pulse signals corresponding to the detected pattern. The count of the pulse signals represents an amount of movement of the carriage 38. Based on the amount of movement of the carriage 38, the control portion 100 controls the operation of the CR motor 109 so as to control the reciprocation of the carriage 38.

To the ASIC 106 are also connected the scanner portion 3, the operation panel 5 through which instructions related to operations of the multifunction apparatus 1 are inputted, the slot portion 6 in which various kinds of small memory cards are inserted, and a parallel interface 114 and a USB interface 115 for enabling data communication with an external information apparatus such as personal computer via a parallel cable and a USB cable, respectively, and others. Further, a NCU (Network Control Unit) 116 and a modem 117 are connected to the ASIC 106 in order to enable the facsimile function.

There will be now described the drive switching mechanism for switching an object to which a driving torque of the LF motor 107 is transmitted, among the first pickup roller 25, the purge mechanism 51, and the second pickup roller 89. A state where a driving torque of the LF motor 107 is transmittable to the first pickup roller 25 corresponds to a first state according to the invention, and a state where a driving torque of the LF motor 107 is transmittable to the second pickup roller 89 corresponds to a second state according to the invention. In the second state, a driving torque of the LF motor 107 is not transmitted to the first pickup roller 25.

Figure 8:
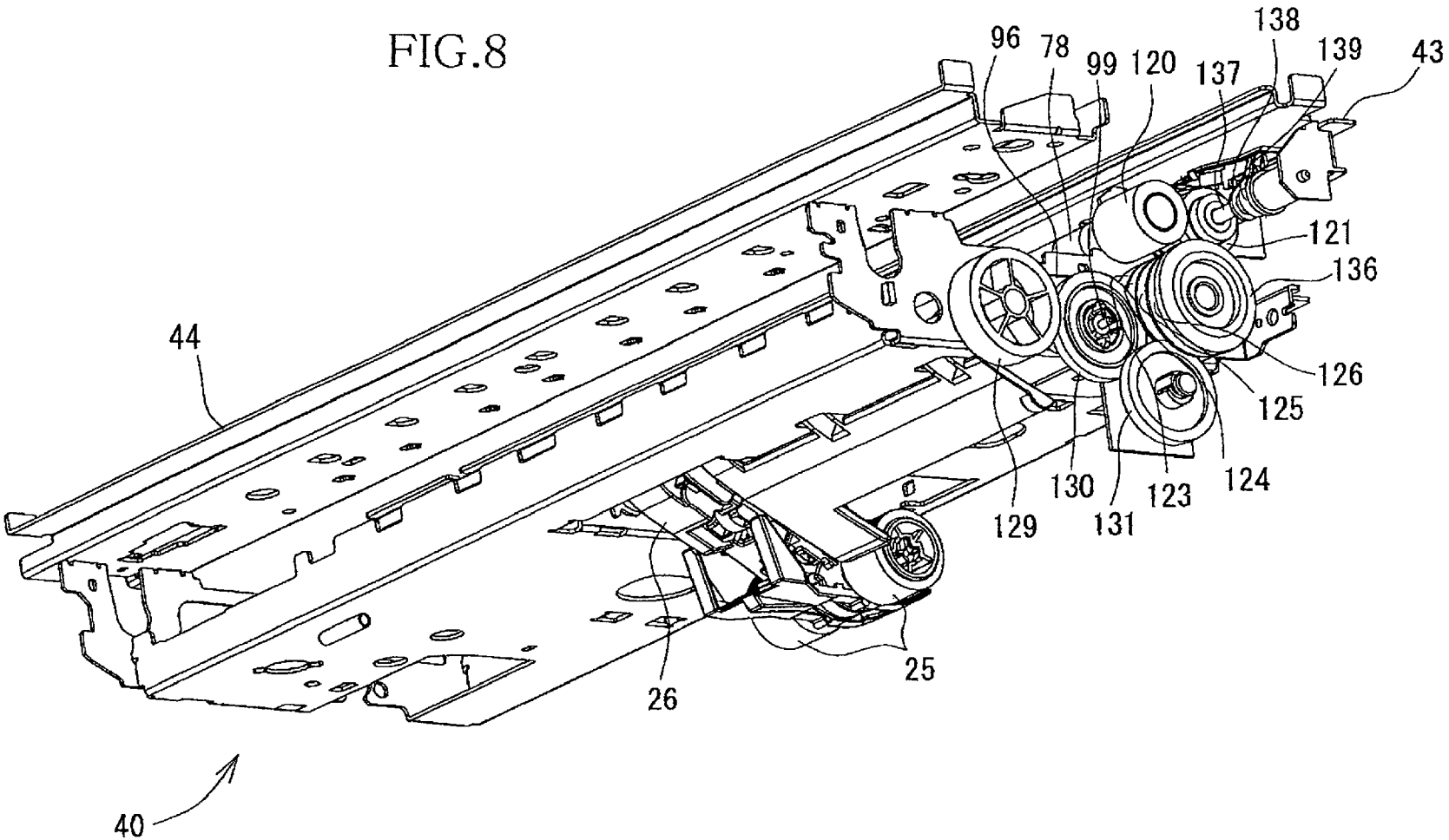
FIG. 8 is a perspective view showing a transmission path along which a driving torque is transmitted to a first pickup roller in the printer portion.
Figure 9:
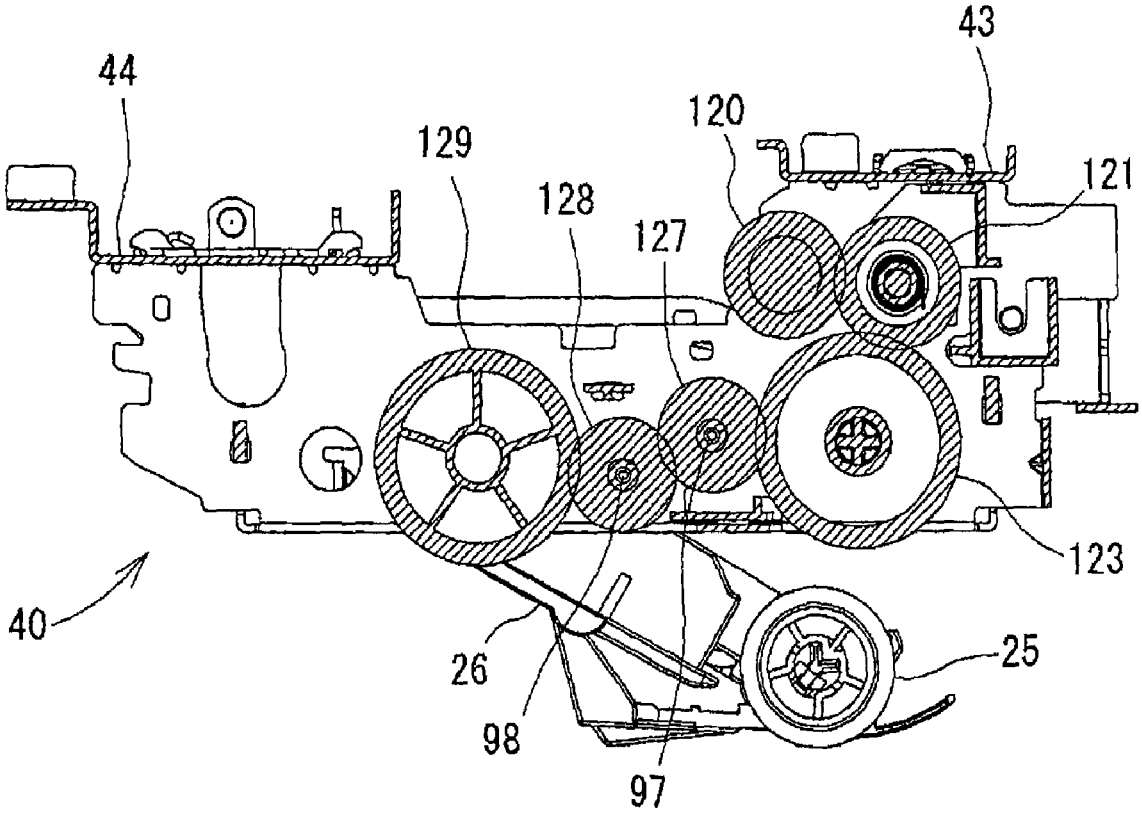
FIG. 9 is a cross-sectional view of the transmission path to the first pickup roller when the printer portion is placed in a normal feeding mode.
Figure 10:
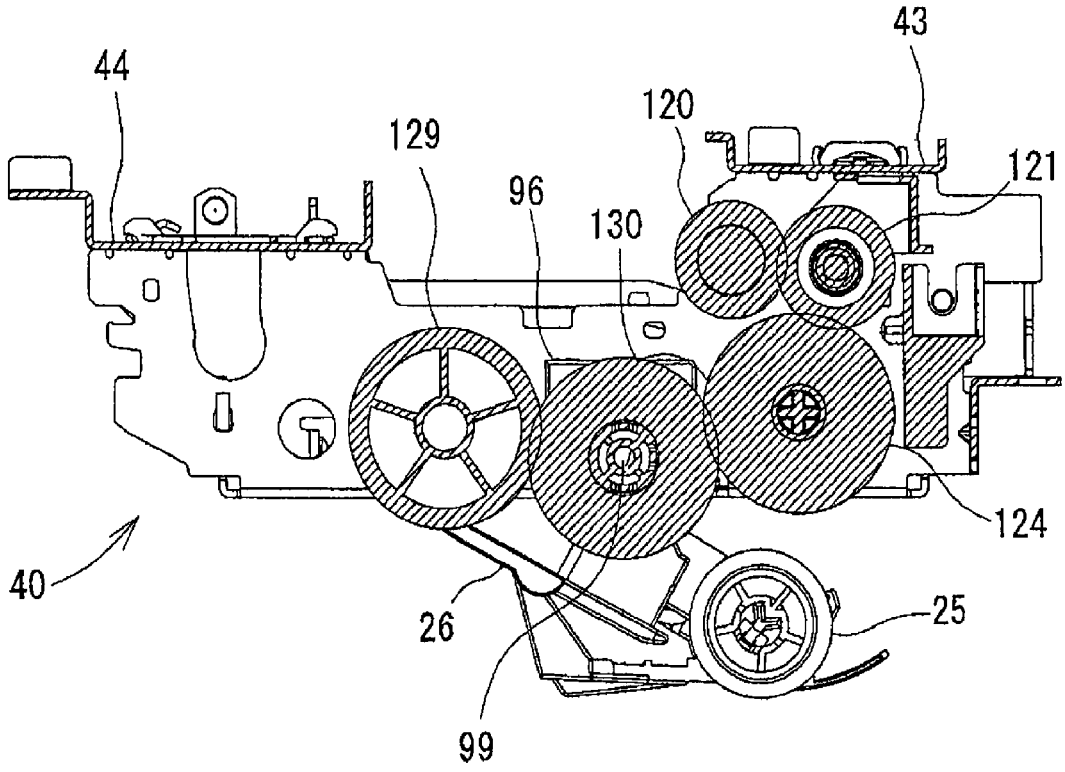
FIG. 10 is a cross-sectional view of the transmission path to the first pickup roller when the printer portion is placed in a high-speed feeding mode.
Figure 11:
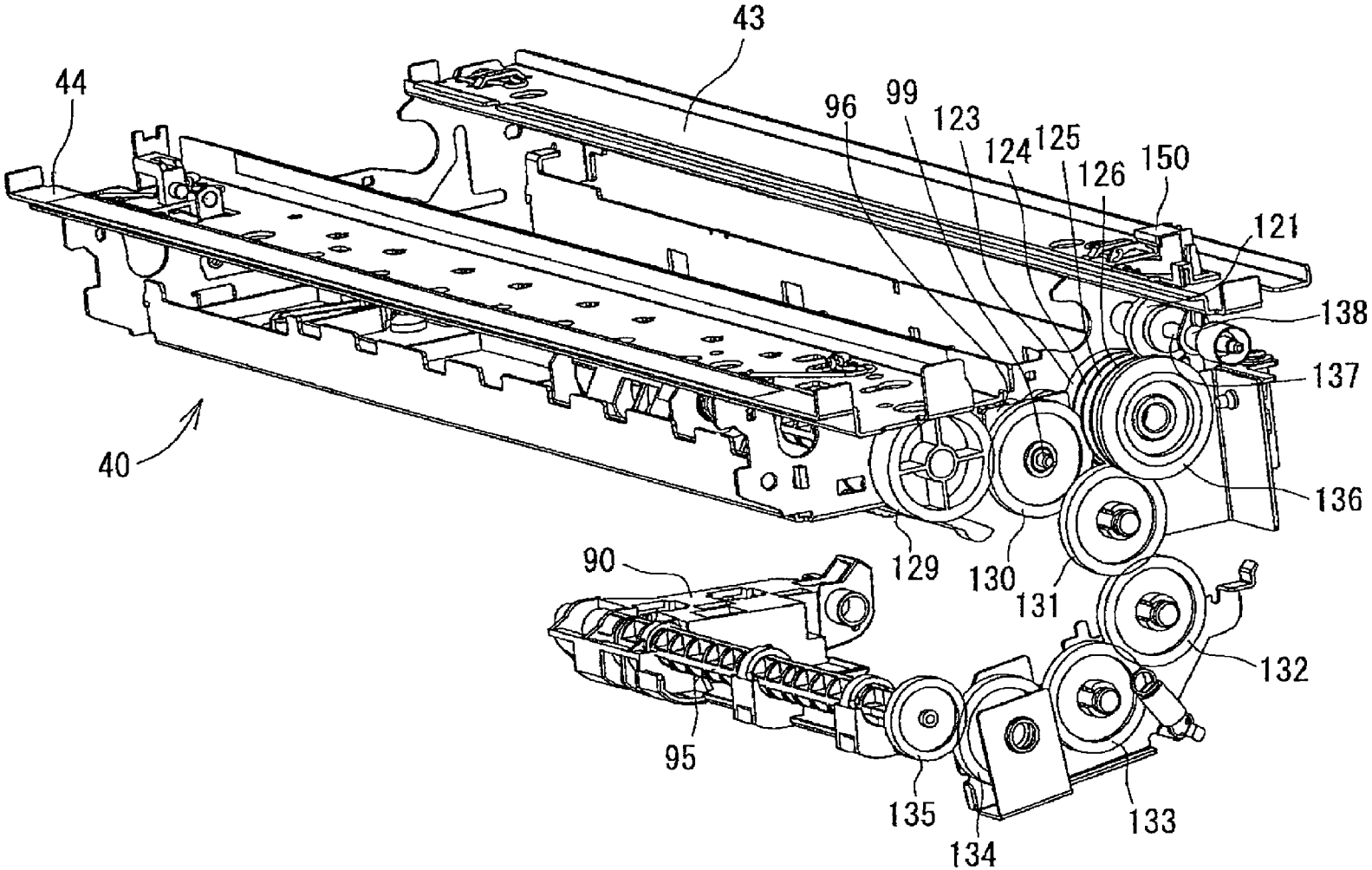
FIG. 11 is a perspective view of a transmission path to a second pickup roller in the printer portion.
Figure 12:
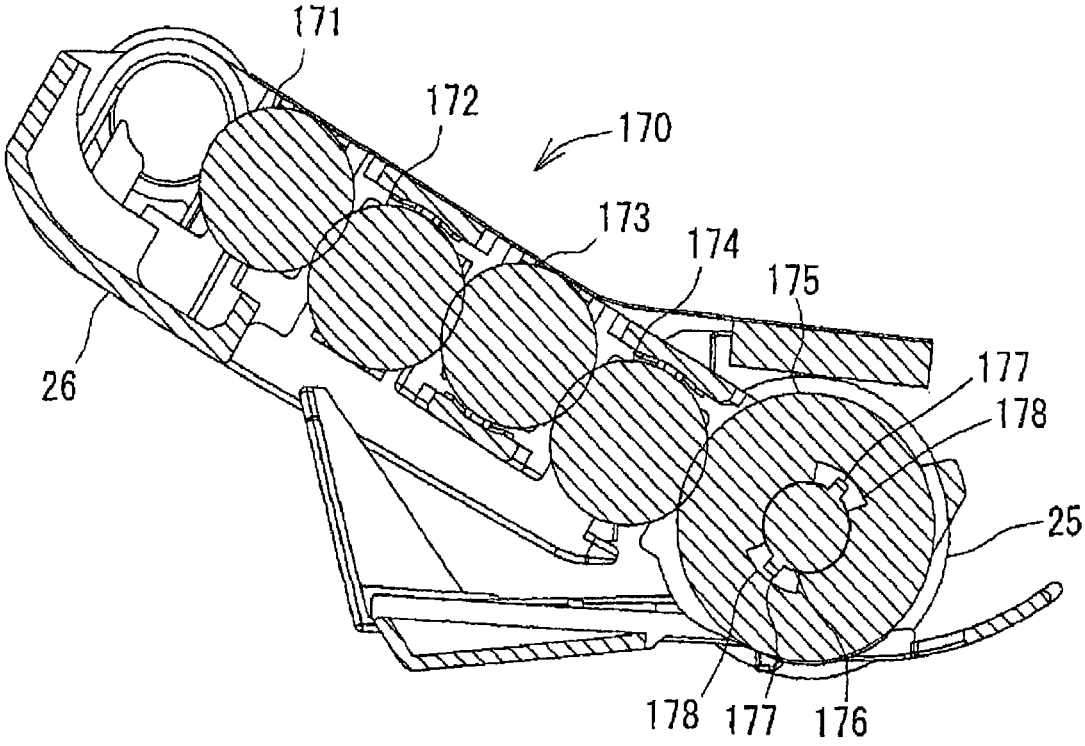
FIG. 12 is a cross-sectional view of a first transmission assembly in the printer portion.
Figure 13:
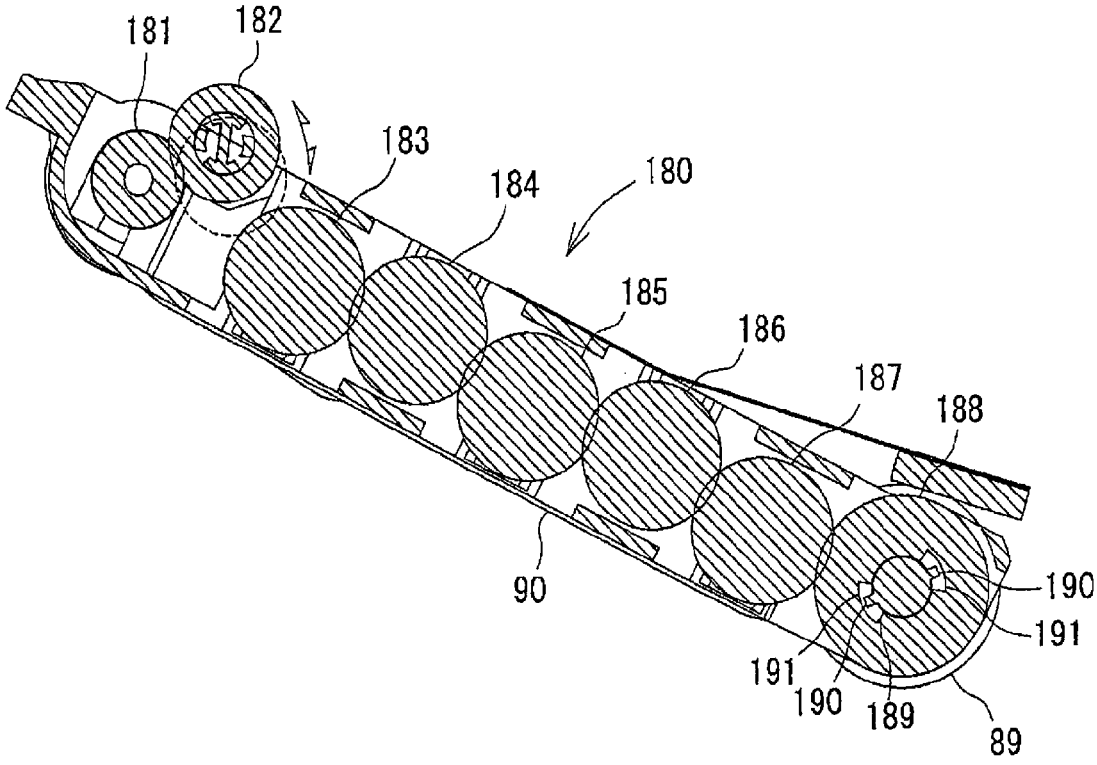
FIG. 13 is a cross-sectional view of a second transmission assembly in the printer portion.

FIG. 8 is a perspective view showing a transmission path along which a driving torque of the LF motor 107 is transmitted to the first pickup roller 25. FIG. 9 is a cross-sectional view of a transmission path along which a driving torque of the LF motor 107 is transmitted to the first pickup roller 25 in the normal feeding mode. FIG. 10 is a cross-sectional view of a transmission path along which a driving torque of the LF motor 107 is transmitted to the first pickup roller 25 in the high-speed feeding mode. FIG. 11 is a perspective view of a transmission path along which a driving torque of the LF motor 107 is transmitted to the second pickup roller 89. FIG. 12 is a cross-sectional view of a first transmission assembly 170. FIG. 13 is a cross-sectional view of a second transmission assembly 180. It is noted that each of the gears shown in the drawings is a spur gear unless otherwise stated, but teeth of the gears are not depicted.

FIG. 8 is a perspective view of the frame 40 as seen from a lower side. In FIG. 8, the carriage 38, the recording head 39, the ink tubes 41, the platen 42, the belt drive mechanism 46, the purge mechanism 51, and the ejection roller 80 are not depicted. As FIG. 8 shows, at a right one (as seen in FIG. 8) of two axial ends of the feeder roller 78, a drive gear 120 is disposed to rotate integrally with the feeder roller 78. The drive gear 120 is one form of a first gear according to the invention. Although the LF motor 107 is disposed at the other axial end of the feeder roller 78 on the opposite side, i.e., the left side as seen in FIG. 8, the LF motor 107 is not shown in FIG. 8 since the frame 40 is in the way. A driving torque is transmitted from a drive shaft of the LF motor 107 to the left side of the feeder roller 78 via a reduction gear (not shown). That is, a rotation of the drive shaft of the LF motor 107 is transmitted to the drive gear 120 via the reduction gear and the feeder roller 78, so as to rotate the drive gear 120.

On the rear side of the drive gear 120, a switch gear 121 is disposed. The switch gear 121 is one form of a third gear according to the invention. The switch gear 121 is normally in engagement with the drive gear 120. An axis of the switch gear 121 is parallel with that of the drive gear 120, and the switch gear 121 can be translated relative to the drive gear 120. A length of the drive gear 120 in a direction of its axis corresponds to a range of translation of the switch gear 121, and the drive gear 120 and the switch gear 121 are held engaged with each other across the entire range of translation of the switch gear 121.

Obliquely under the drive gear 120, the first to fourth transmission gears 123-126 arranged in a row are mounted on the shaft 122 that extends parallel to the axis of the drive gear 120. The shaft 122 is disposed in the purge mechanism 51, as shown in FIG. 4 but not shown in FIG. 8. However, the shaft 122 may be disposed on the frame 40.

The transmission gears 123-126 transmit a driving force to respective driven portions. More specifically, the first transmission gear 123 and the second transmission gear 124 transmit a driving torque of the LF motor 107 to the first pickup roller 25 in the normal feeding mode and in the high-speed feeding mode, respectively. The third transmission gear 125 transmits a driving torque of the LF motor 107 to the second pickup roller 89. The fourth transmission gear 126 transmits a driving torque of the LF motor 107 to the purge mechanism 51. The transmission gears 123-126 have a same diameter, and the switch gear 121 is selectively meshed with one of the transmission gears 123-126. That is, the switch gear 121 is engageable with and disengageable from the transmission gears 123-126. The first transmission gear 123 is one form of a second gear according to the invention. The third transmission gear 125 is one form of the fourth gear according to the invention. The state where the switch gear 121 is in meshing engagement with the first transmission gear 123 corresponds to the first state according to the invention. The state where the switch gear 121 is in meshing engagement with the third transmission gear 125 corresponds to the second state according to the invention.

As FIG. 9 shows, when the switch gear 121 is in meshing engagement with the first transmission gear 123, a driving torque of the LF motor 107 is transmitted from the first transmission gear 123 to a transmission gear 129 via intermediate gears 127, 128. The transmission gear 129 is disposed coaxially with the pivot shaft 30 of the first swing arm 26. Rotation shafts of the intermediate gears 127, 128 are supported by the frame 40. In the first swing arm 26, there is disposed a first transmission assembly 170 constituted by a plurality of gears that are arranged in series toward the first pickup roller 25, in engagement with one another. An uppermost one of the gears constituting the first transmission assembly 170, that is, one of the gears of the first transmission assembly 170 nearest to the pivot shaft 30, and the transmission gear 129, are fixed on the same shaft, namely, the pivot shaft 30, and thus integrally rotatable. Hence, a rotation of the transmission gear 129 is transmitted to the first pickup roller 25 via the first transmission assembly 170 in order to drive the first pickup roller 25. The structure of the first transmission assembly 170 will be described in more detail later.

As FIG. 10 shows, when the switch gear 121 is in meshing engagement with the second transmission gear 124, a driving torque of the LF motor 107 is transmitted from the second transmission gear 124 to the transmission gear 129 disposed coaxially with the pivot shaft 30 of the first swing arm 26 via an intermediate gear 130, a rotation shaft of which is supported by the frame 40. A transmission path along which the driving torque is transmitted from the transmission gear 129 to the first pickup roller 25 in the case shown in FIG. 10 is constituted by the first transmission assembly 170, just like the case described above with respect to FIG. 9. That is, both of the first and second transmission gears 123, 124 transmit a driving torque to the first pickup roller 25. However, from the first transmission gear 123, a driving torque is transmitted to the transmission gear 129 via two intermediate gears 127, 128, and from the second transmission gear 124, a driving torque is transmitted to the transmission gear 129 via a single intermediate gear 130. Thus, where a rotation of the drive gear 120 in a direction is transmitted to the first pickup roller 25 via the first transmission gear 123, the first pickup roller 25 rotates in one of two opposite directions; on the other hand, where a rotation of the drive gear 120 in the same direction is transmitted to the first pickup roller 25 via the second transmission gear 124, the first pickup roller 25 rotates in the other of the two opposite directions.

As FIGS. 8-11 show, the intermediate gears 127, 128 that transmit a driving torque from the first transmission gear 123 to the transmission gear 129, and the intermediate gear 130 that transmits a driving torque from the second transmission gear 124 to the transmission gear 129, are mounted on respective rotation axes that are supported by a holding member 96 disposed at a side of the frame 40. As shown in FIGS. 8 and 11, the intermediate gears 127, 128 are disposed on a side of the holding member 96 that is opposite to the side on which the intermediate gear 130 is disposed. That is, the intermediate gears 127, 128 are on the side of the frame 40 with respect to the holding member 96, that is, the intermediate gears 127, 128 are on the inner side of the holding member 96 and positionally correspond to the first transmission gear 123. On the other hand, the intermediate gear 130 is disposed on the opposite or outer side of the holding member 96 and positionally corresponds to the second transmission gear 124. That is, the holding member 96 is disposed between the first and second transmission gears 123, 124. As FIG. 9 shows, the intermediate gears 127, 128 are mounted on respective support shafts 97, 98 that horizontally extend from the holding member 96 toward the frame 40. Further, as FIG. 10 shows, the intermediate gear 130 is mounted on a support shaft 99 that horizontally extends from the holding member 96 outward.

FIG. 11 is a perspective view of the frame 40 as seen from the upper side. In FIG. 11, the carriage 38, the recording head 39, the ink tubes 41, the platen 42, the belt drive mechanism 46, the purge mechanism 51, the ejection roller 80, the feeder roller 78, and the drive gear 120 are not depicted. As shown in FIG. 11, when the switch gear 121 is in meshing engagement with the third transmission gear 125, a driving torque of the LF motor 107 is transmitted from the third transmission gear 125 to another transmission gear 135 disposed coaxially with the pivot shaft 95 of the second swing arm 90 via intermediate gears 131-134 that are arranged in series in meshing engagement with one another. The intermediate gears 131-134 are mounted on respective rotation shafts supported by the frame 40. In the second swing arm 90 is disposed a second transmission assembly 180, which is constituted by a plurality of transmission gears arranged in series toward the second pickup roller 89, in meshing engagement with one another, as shown in FIG. 13. The transmission gear 135 and one 181 of the transmission gears constituting the second transmission assembly 180, which one is on the side of the pivot shaft 95, are fixed on a same shaft to be integrally rotatable. It is noted that in FIG. 11 the second pickup roller 89 is not depicted. By the above-described arrangement, a rotation of the transmission gear 135 is transmitted to the second pickup roller 89 via the second transmission assembly 180 in order to drive the second pickup roller 89.

As FIG. 12 shows, the first transmission assembly 170 includes a plurality of transmission gears 171-175 supported by the first swing arm 26. As described above, the first transmission assembly 170 receives a driving torque of the LF motor 107 via the drive switching mechanism, and transmits the driving torque to the first pickup roller 25. The transmission gears 171-175 are arranged in series from the side of a proximal end of the first swing arm 26 to the distal end thereof such that the transmission gears 171-175 are in meshing engagement with one another. Hence, rotations of the transmission gears 171-174 are sequentially transmitted to the adjacent, engaged transmission gears 172-175. In FIG. 12, a gear that is mounted on the pivot shaft 30 of the first swing arm 26 and rotates in synchronization with the transmission gear 129 (shown in FIG. 8) is not depicted. This gear not depicted in FIG. 12 rotates with the transmission gear 129, and the rotation of the gear is transmitted to the transmission gears 171-175 sequentially.

The transmission gear 175 is mounted on a rotation shaft 176 of the first pickup roller 25 such that the transmission gear 175 is rotatable relative to the rotation shaft 176. From the rotation shaft 176, keys 177 protrude radially outward. On an inner circumferential surface of the transmission gear 175, recesses 178 are formed to positionally correspond to the keys 177. A length or a dimension of each of the recesses 178 in a circumferential direction of the transmission gear 175 is sufficiently large with respect to that of each of the keys 177. That is, the keys 177 are fitted in the respective recesses 178 with a play in the circumferential direction. When the transmission gear 175 rotates, each key 177 comes to contact with a wall at a circumferential end of the corresponding recess 178, and thus a rotation of the transmission gear 175 is transmitted to the rotation shaft 176. Thus, when the transmission gear 175 rotates, the first pickup roller 25 also rotates. A direction in which the first pickup roller 25 rotates is opposite, with respect to the feeding direction, to a direction in which the feeder roller 78 rotates. That is, when the first pickup roller 25 rotates in a sheet supply direction (counterclockwise as seen in FIG. 12) which is a direction to supply or feed a recording sheet, the feeder roller 78 rotates in a direction (counterclockwise direction as seen in FIG. 2) opposite to a sheet feed direction which is a direction in which the feeder roller 78 rotates to feed a recording sheet. When the first pickup roller 25 rotates in a direction (clockwise as seen in FIG. 12) opposite to the sheet supply direction, the feeder roller 78 rotates in the sheet feed direction (clockwise as seen in FIG. 2). While the LF motor 107 is rotated, when the direction of the rotation of the LF motor 107 is switched or reversed and the rotation direction of the transmission gear 175 is accordingly switched or reversed, the rotation of the transmission gear 175 in the reverse direction is not immediately transmitted to the rotation shaft 176 due to the play of the fitting between the keys 177 and the recesses 178. That is, the reverse rotation of the transmission gear 175 is not transmitted to the first pickup roller 25 until the transmission gear 175 has rotated by an angle corresponding to the play.

As FIG. 13 shows, the second transmission assembly 180 includes the transmission gear 181 mounted on the pivot shaft 95, a planetary gear 182, and a plurality of transmission gears 183-188 supported by the second swing arm 90. As described above, the second transmission assembly 180 receives a driving torque of the LF motor 107 via the drive switching mechanism, and transmits the driving torque to the second pickup roller 89. The transmission gear 181 is mounted on the pivot shaft 95 of the second swing arm 90 and rotates in synchronization with rotation of the transmission gear 135 (shown in FIG. 11). The planetary gear 182 moves around the transmission gear 181 as a sun gear, while rotating on its own axis in meshing engagement with the transmission gear 181. Although details are not shown in FIG. 13, the planetary gear 182 is supported by an arm that is supported by a shaft of the transmission gear 181 such that the arm is pivotable around the shaft of the transmission gear 181, and thus the planetary gear 182 can move around the transmission gear 181. By moving around the transmission gear 181, the planetary gear 182 is engaged with, and disengaged from, the transmission gear 181. The planetary gear 182 moves between a position indicated by a solid line and a position indicated by a broken line in FIG. 13, depending on a direction of a rotation of the transmission gear 181. The planetary gear 182 is not engaged with the transmission gear 183 when at the position indicated by the solid line, and is engaged therewith when at the position indicated by the broken line. By the movement of the planetary gear 182 around the transmission gear 181, a rotation of only one direction is transmitted from the transmission gear 181 to the transmission gear 183. The transmission gears 183-188 are arranged in series from a proximal end of the second swing arm 90 toward the distal end thereof in meshing engagement with one another. Thus, rotations of the transmission gears 183-187 are sequentially transmitted to the adjacent, engaged transmission gears 184-188.

The transmission gear 188 is mounted on a rotation shaft 189 of the second pickup roller 89 such that the transmission gear 188 is rotatable relative to the rotation shaft 189. From the rotation shaft 189, keys 190 protrude radially outward. On an inner circumferential surface of the transmission gear 188, recesses 191 are formed to positionally correspond to the keys 190. A length or a dimension of each of the recesses 191 in a circumferential direction of the transmission gear 188 is sufficiently large with respect to that of each of the keys 190. That is, the keys 190 are fitted in the respective recesses 191 with a play in the circumferential direction. When the transmission gear 188 rotates, each key 190 comes to contact with a wall at a circumferential end of the corresponding recess 191, and thus a rotation of the transmission gear 188 is transmitted to the rotation shaft 189. Hence, when the transmission gear 188 rotates, the second pickup roller 89 also rotates. A direction in which the second pickup roller 89 rotates is opposite, with respect to the feeding direction, to a direction in which the feeder roller 78 rotates. That is, when the second pickup roller 89 rotates in the sheet supply direction (counterclockwise as seen in FIG. 13) to supply a recording sheet, the feeder roller 78 rotates in the direction (counterclockwise direction as seen in FIG. 2) opposite to the sheet feed direction. It is noted that since the second transmission assembly 180 does not transmit to the second pickup roller 89 the rotation of the LF motor 107 in the direction opposite to the sheet supply direction, the planetary gear 182 is disengaged from the transmission gear 183 and the second pickup roller 89 does not rotate when the feeder roller 78 rotates in the sheet feed direction (clockwise as seen in FIG. 2). That is, the second transmission assembly 180 receives an output of the LF motor 107 and transmits to the second pickup roller 89 a driving torque of the sheet supply direction, but does not transmit to the second pickup roller 89 a driving torque of the direction opposite to the sheet supply direction. Since the keys 190 are fitted in the recesses 191 with the play, even while a driving torque is transmitted to the transmission gear 188 and the second pickup roller 89 is accordingly rotated in a direction, the second pickup roller 89 can rotate in the opposite direction by an angle corresponding to the play.

Figure 14:
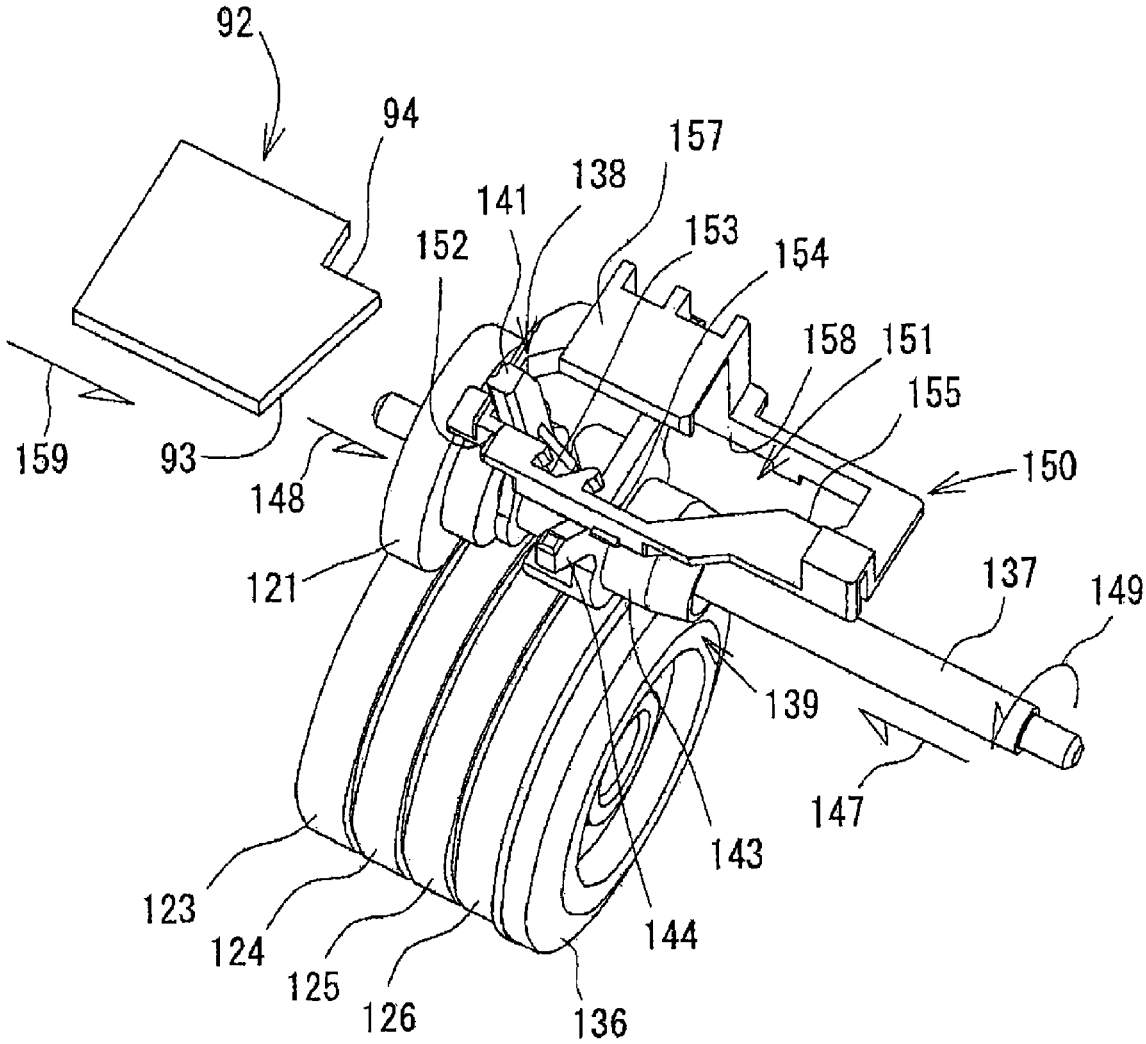
FIG. 14 is a perspective view in which a switch gear is engaged with a first transmission gear.
Figure 15:
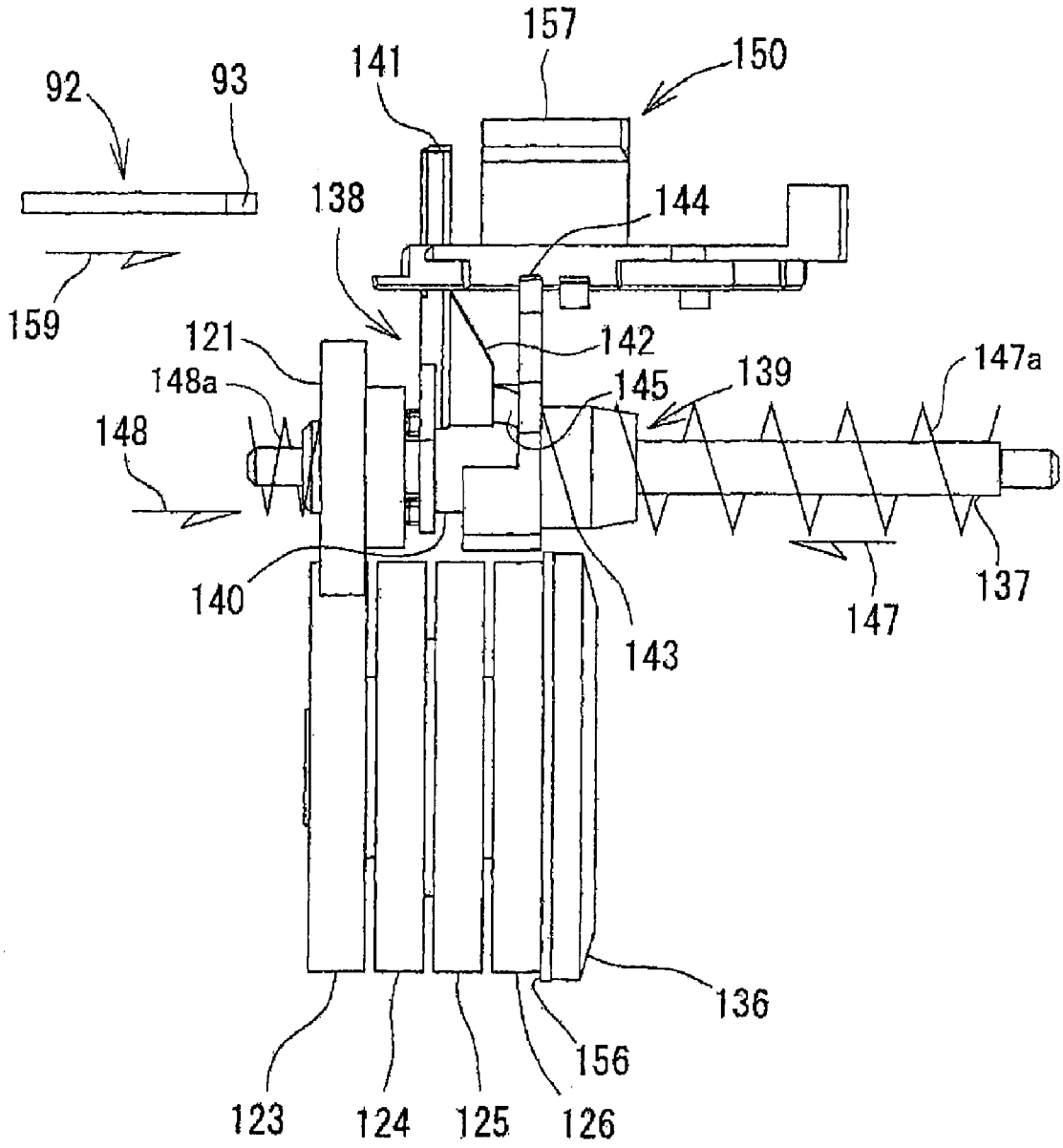
FIG. 15 is a front elevational view corresponding to FIG. 14.
Figure 16:
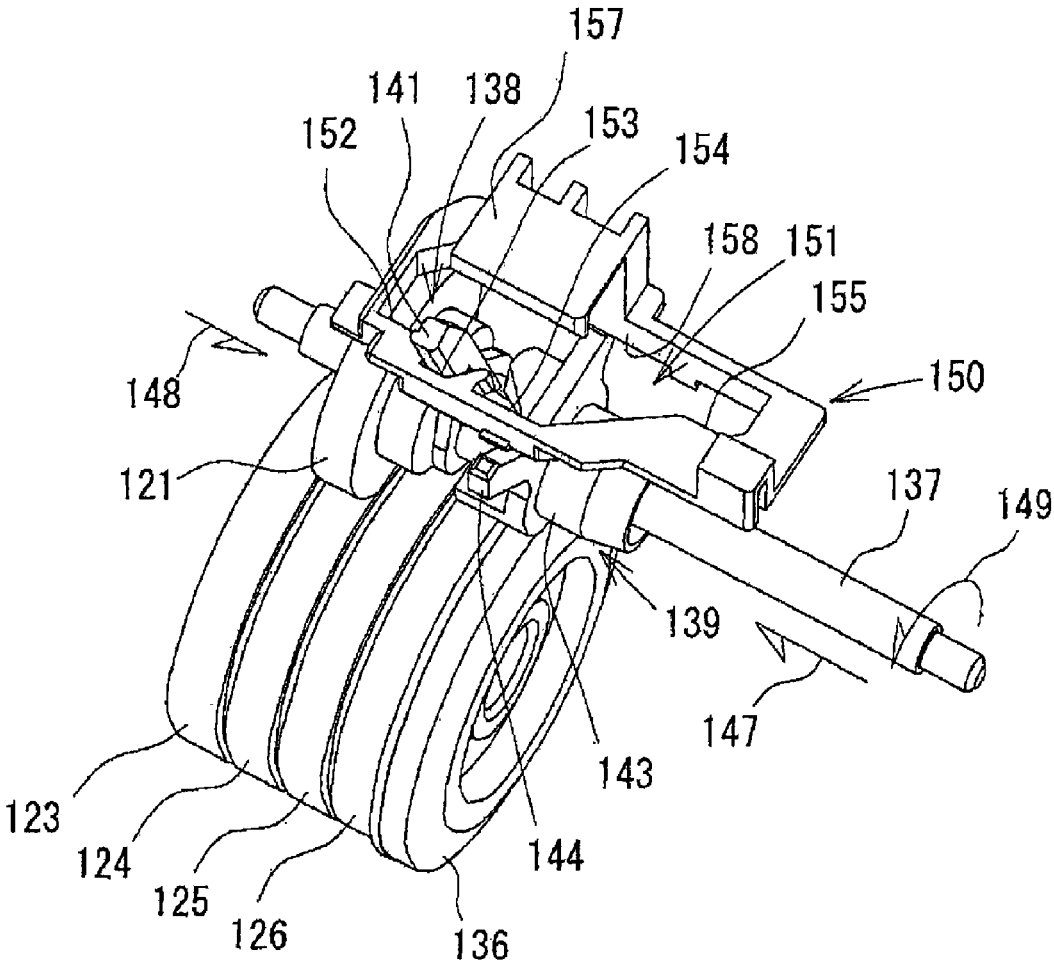
FIG. 16 is a perspective view in which the switch gear is engaged with a second transmission gear.
Figure 17:
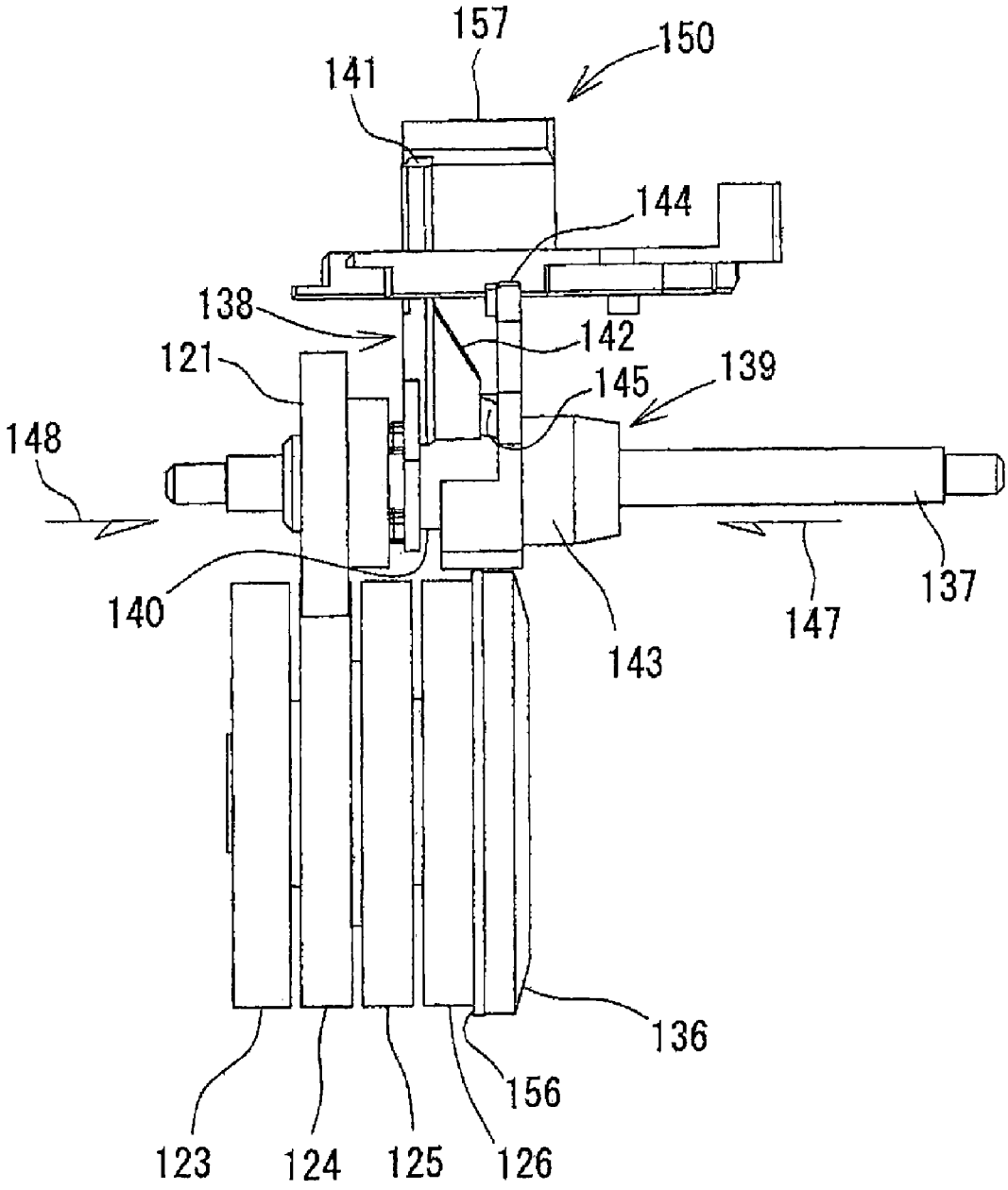
FIG. 17 is a front elevational view corresponding to FIG. 16.
Figure 18:
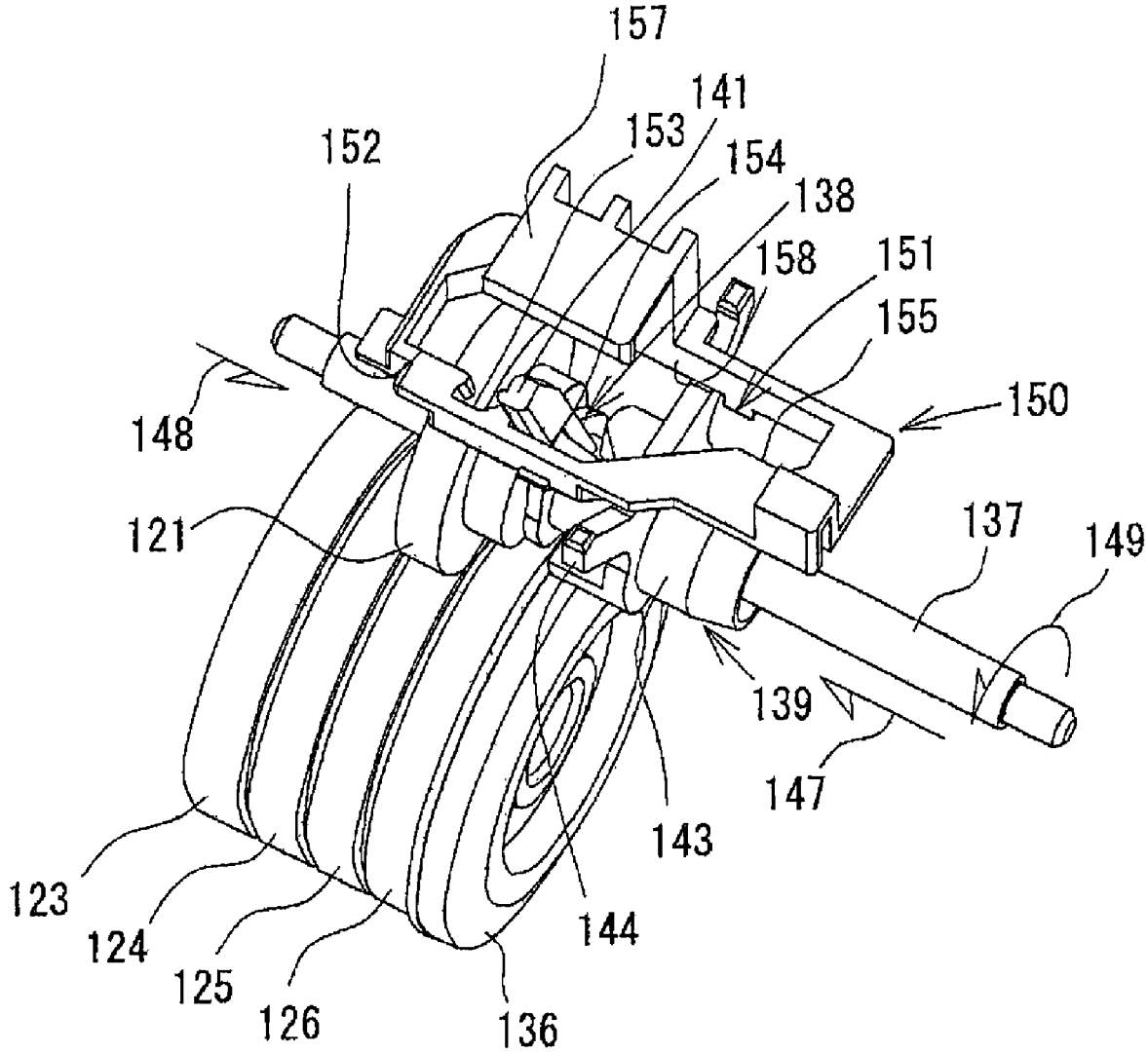
FIG. 18 is a perspective view in which the switch gear is engaged with a third transmission gear.
Figure 19:
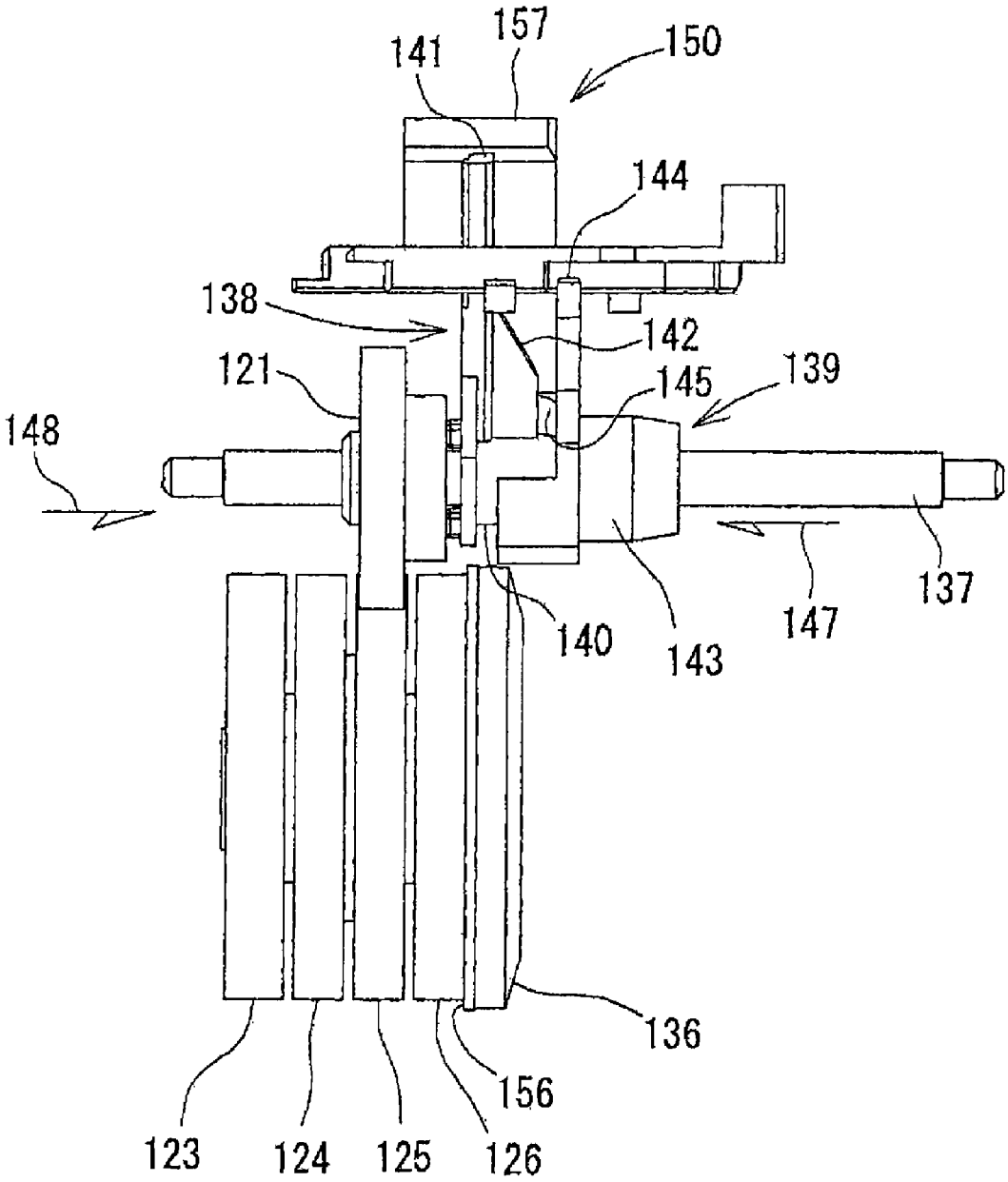
FIG. 19 is a front elevational view corresponding to FIG. 18.
Figure 20:
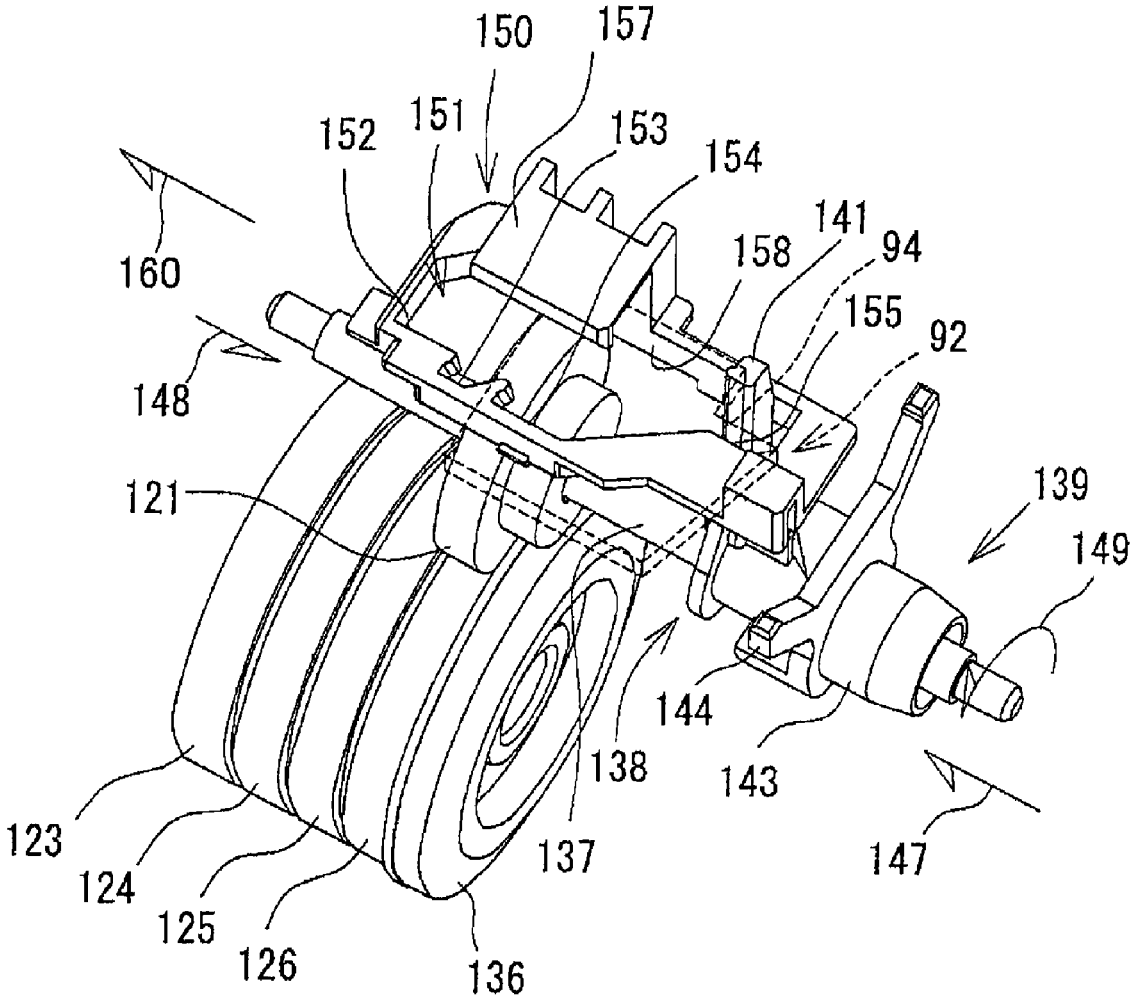
FIG. 20 is a perspective view in which the switch gear is engaged with a fourth transmission gear.
Figure 21:
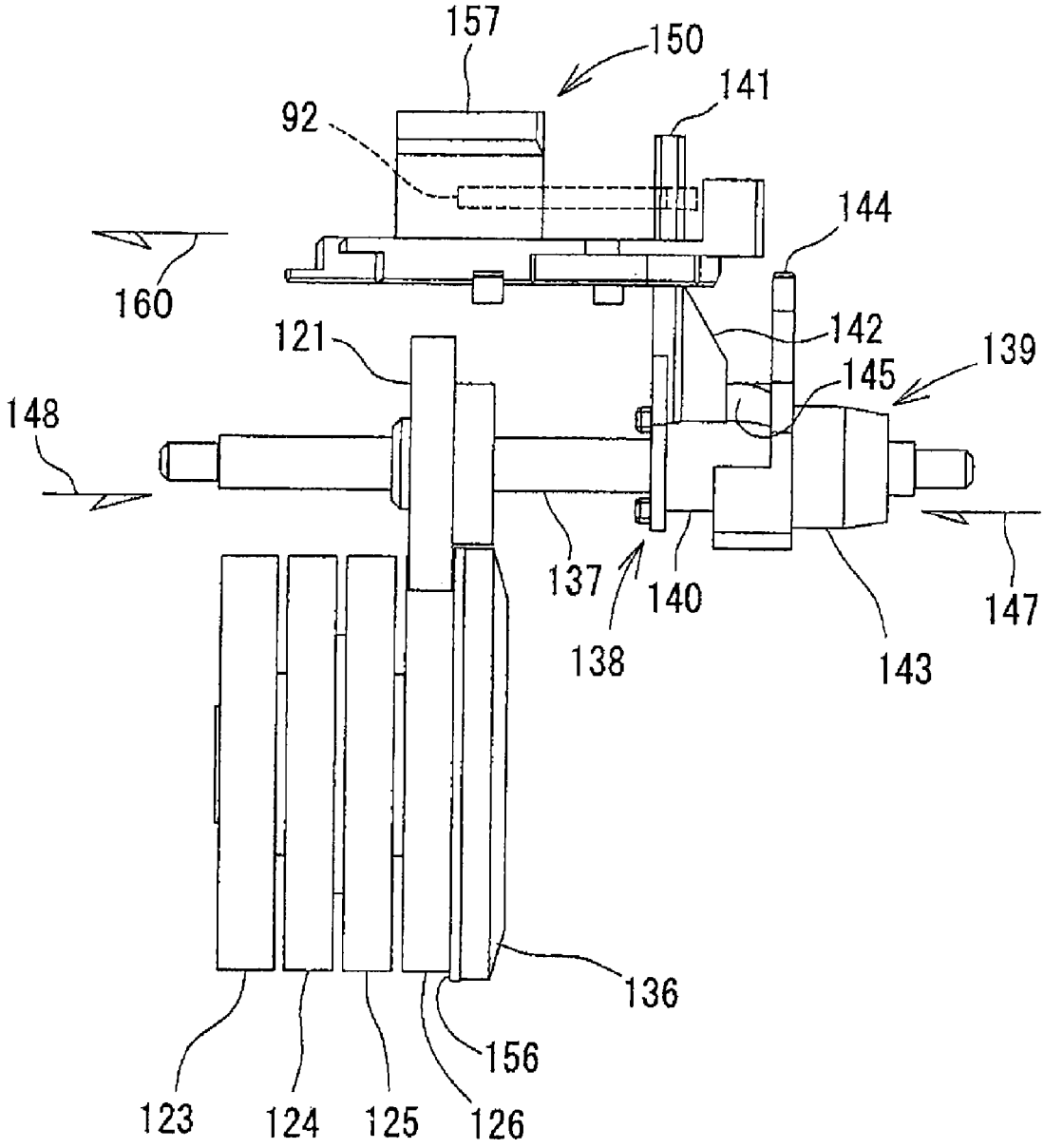
FIG. 21 is a front elevational view corresponding to FIG. 20.
Figure 22:
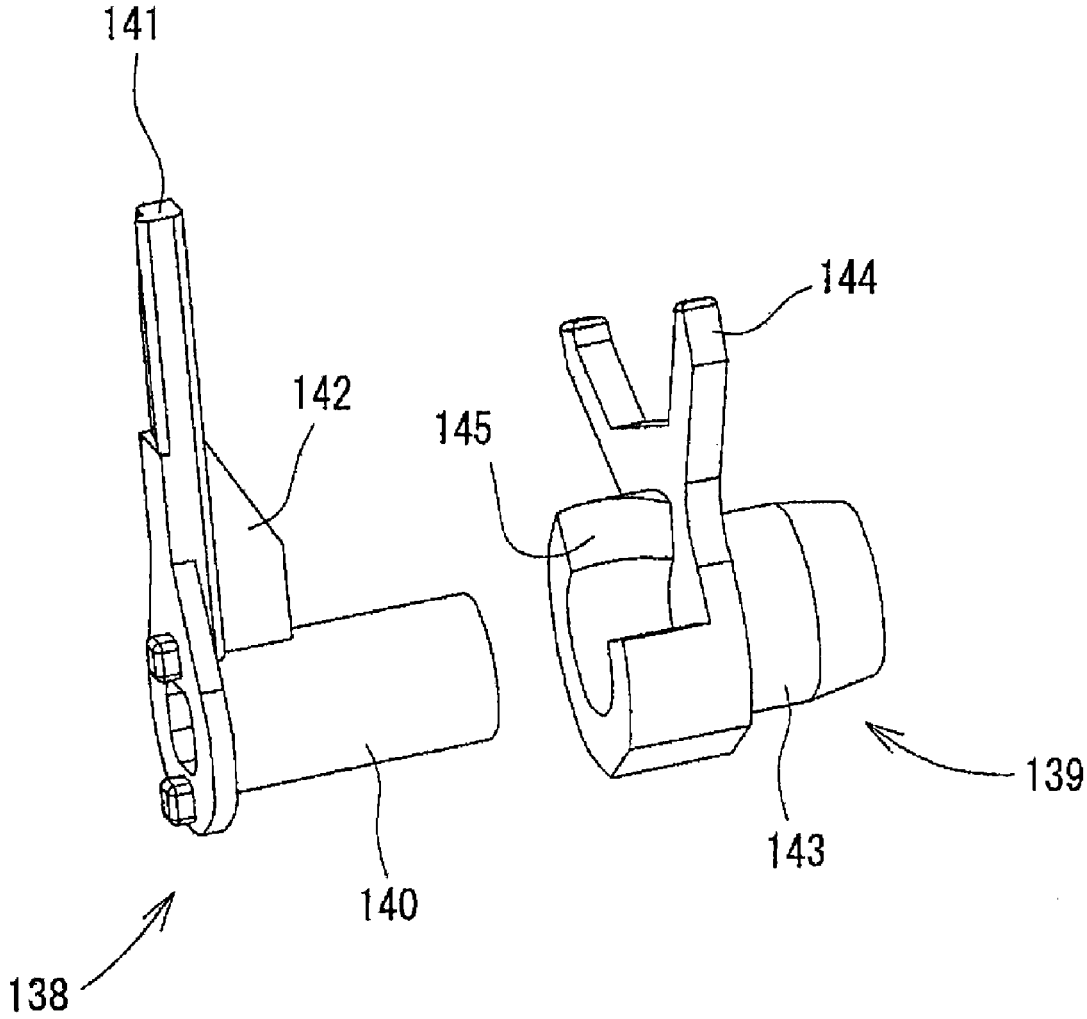
FIG. 22 is an exploded perspective view showing an input lever and a biasing member in the printer portion.

There will be described the drive switching mechanism in more detail. The drive switching mechanism is mainly composed of the switch gear 121, the first to fourth transmission gears 123-126, an input lever 138, a biasing member 139, and a lever guide 150. FIG. 14 is a perspective view of the drive switching mechanism in a state where the switch gear 121 is in meshing engagement with the first transmission gear 123. FIG. 15 is a front elevational view corresponding to FIG. 14. FIG. 16 is a perspective view of the drive switching mechanism in a state where the switch gear 121 is in meshing engagement with the second transmission gear 124. FIG. 17 is a front elevational view corresponding to FIG. 16. FIG. 18 is a perspective view of the drive switching mechanism in a state where the switch gear 121 is in meshing engagement with the third transmission gear 125. FIG. 19 is a front elevational view corresponding to FIG. 18. FIG. 20 is a perspective view of the drive switching mechanism in a state where the switch gear 121 is in meshing engagement with the fourth transmission gear 126. FIG. 21 is a front elevational view corresponding to FIG. 20. FIG. 22 is an exploded perspective view showing the input lever 138 and the biasing member 139.

As shown in FIGS. 8, 11, 14, the switch gear 121 is mounted on a support shaft 137 such that the switch gear 121 is slidable in an axial direction of the support shaft 137. The support shaft 137 is supported by the frame 40 and horizontally extends. On the support shaft 137, the switch gear 121 is slid in order to selectively engage with one of the first to fourth transmission gears 123-126. The input lever 138 and the biasing member 139 are slidably mounted on the support shaft 137 at a position on the outer side of the switch gear 121 with respect to the direction of reciprocation of the carriage 38. A combination of the input lever 138 and the biasing member 139 is one form of an input mechanism according to the invention. It is noted that the "direction of reciprocation of the carriage 38" is the lateral direction as seen in FIGS. 14 and 15, and the "outer side with respect to the direction of reciprocation of the carriage 38" is the right side in the same drawings.

As FIG. 22 shows, the input lever 138 has a hollow cylinder portion 140 fitted on the support shaft 137, and an arm 141 protruding radially outward from the hollow cylinder portion 140. The hollow cylinder portion 140 is fitted on the support shaft 137 to be axially slidable and rotatable relative to the support shaft 137. That is, the input lever 138 is slidable in the axial direction of the support shaft 137 and rotatable around the support shaft 137. From a proximal end portion of the arm 141, a rib 142 extends in an axial direction of the hollow cylinder portion 140.

The biasing member 139 includes a boss portion 143 and a slide guide 144. The boss portion 143 is a hollow cylindrical portion, and fitted on the hollow cylinder portion 140 of the input lever 138. The slide guide 144 protrudes radially outward from the boss portion 143 in a Y-like shape, that is, the slide guide 144 includes two arm portions at its upper side. As shown in FIG. 15, the boss portion 143 of the biasing member 139 is fitted on the hollow cylinder portion 140 of the input lever 138, such that the boss portion 143 is slidable and rotatable relative to the hollow cylinder portion 140. Hence, the biasing member 139 is rotatable around an axis of the support shaft 137, but the two arm portions of the slide guide 144 are located on horizontally opposite sides of the lever guide 150 (shown in FIG. 14) with upper end surfaces of the arm portions being held in contact with an under surface of the guide rail 43 (shown in FIG. 11), and therefore rotation of the biasing member 139 around the axis of the support shaft 137 is actually prevented. Hence, the biasing member 139 slides in a direction parallel to the axis of the support shaft 137 with a rotational position of the biasing member 139 relative to the support shaft 137 being invariable. At an end of the boss portion 143 of the biasing member 139 on the side of the input lever 138, a cutout is formed to provide a slant guide surface 145 spirally extending from the end of the boss portion 143 around an axis of the boss portion 143 or of the support shaft 137. The biasing member 139 is biased in a direction indicated by an arrow 147 by an elastic force of a compression coil spring 147*a*, as shown in FIG. 15, and the input lever 138 is biased in a direction indicated by an arrow 148, by an elastic force of a compression coil spring 148*a* via the switch gear 121. Hence, the rib 142 of the input lever 138 is held pressed against the slant guide surface 145 of the biasing member 139, whereby the input lever 138 is normally under a rotation torque in a direction. An effect of this torque will be described later.

By receiving the biasing forces in the directions of the arrows 147, 148, the switch gear 121, the input lever 138, and the biasing member 139 are together movable in contact with one another, on the support shaft 137. The biasing force exerted on the biasing member 139 in the direction of the arrow 147 by the compression coil spring 147*a* is set to be larger than the biasing force exerted on the switch gear 121 in the direction of the arrow 148 by the compression coil spring 148*a*. Hence, while receiving no external forces, the switch gear 121, the input lever 138, and the biasing member 139 are held at a leftmost position as seen in FIG. 15 in a range of sliding thereof on the support shaft 137.

As shown in FIGS. 14 and 15, the lever guide 150 is disposed above the support shaft 137. The lever guide 150 is fixed in position by being fitted in a fitting hole 91 (shown in FIG. 3, in which the lever guide 150 is not depicted, however) formed in the guide rail 43 on the side of the purge mechanism 51. The lever guide 150 is a plate-like member, at a middle portion of which a guide hole 151 of a particular shape is formed. Into the guide hole 151, the arm 141 of the input lever 138 is inserted to protrude to the upper side of the guide rail 43. As described above, the rotational position of the biasing member 139 relative to the support shaft 137 is invariant and the input lever 138 is held under a rotation torque to rotate relative to the biasing member 139. Hence, the arm 141 inserted in the guide hole 151 is pressed against an edge of the guide hole 151 at the near side as seen in FIG. 14 or at the front side of the multifunction apparatus 1, as long as no external forces are exerted thereon. Further, the arm 141 is biased in the direction of the arrow 147 due to a difference between the biasing forces of the compression coil springs 147*a* and 148*a*. Therefore, while receiving no external forces, the arm 141 is held at a corner of the guide hole 151 on the side of the first transmission gear 123, as shown in FIG. 14. This position of the arm 141, i.e., at the corner, corresponds to a first guide position 152 for engaging the switch gear 121 with the first transmission gear 123. That is, the first state according to the invention is established when the arm 141 is located at the first guide position 152 to engage the switch gear 121 with the first transmission gear 123.

First to fourth guide positions 152-155 are set or defined along the edge of the guide hole 151 such that the guide positions 152-155 are arranged along the axial direction of the support shaft 137 and in an ascending order of the reference numerals in the direction of the arrow 148. The second guide position 153 is defined by a cutout, or a portion of the guide hole 151 where the guide hole 151 is enlarged in a direction indicated by an arrow 149 as compared with the first guide position 152. Similarly, the third guide position 154 is defined by another cutout or another portion of the guide hole 151 where the guide hole 151 is enlarged in the direction of the arrow 149 as compared to the first guide position 152. That is, the second and third guide positions 153, 154 are defined on opposite sides of a protrusion as a part of the lever guide 150. This protrusion provides a slant surface for guiding and smoothing a movement of the arm 141 from the second guide position 153 to the third guide position 154. When located at either of the second and third guide positions 153, 154, the arm 141 of the input lever 138 is engaged with the cutout or enlarged portion of the guide hole 151, and thereby inhibited from further being rotated in the direction of the arrow 149 due to the rotation torque produced by the slant guide surface 145 the compression coil spring 147*a* and further being moved in the direction of the arrow 147 due to the difference between the biasing forces of the compression coil springs 147*a*, 148*a*. As shown in FIGS. 16 and 17, when the arm 141 is located at the second guide position 153, the switch gear 121 is engaged with the second transmission gear 124. As shown in FIGS. 18 and 19, when the arm 141 is located at the third guide position 154, the switch gear 121 is engaged with the third transmission gear 125. That is, the second state according to the invention is established when the arm 141 is located at the third guide position 154 to engage the switch gear 121 with the third transmission gear 125.

The fourth guide position 155 is spaced from the third guide position 154 in the direction of the arrow 148 much more widely than between the guide positions 152 and 153, and between the guide positions 153 and 154. The fourth guide position 155 is formed at an end of the guide hole 151 in the axial direction of the support shaft 137 on the side opposite to the first guide position 152. At the fourth guide position 155, the guide hole 150 is narrowed in a direction opposite to the direction of the arrow 149, such that a slant surface is provided between the third and fourth guide positions 154, 155. Guided by this slant surface, the arm 141 is smoothly movable from the third guide position 154 to the fourth guide position 155. When located at the fourth guide position 155, the arm 141 is not engaged with respect to the direction of the arrow 147, that is, not inhibited from moving due to the biasing force that is exerted on the input lever 138 in the direction of the arrow 147 based on the elastic force of the compression coil spring 147*a*. Hence, in order to hold the arm 141 at the fourth guide position 155, a guide plate 92 (described later) is used. As shown in FIGS. 20 and 21, when the arm 141 is at the fourth guide position 155, the arm 141 or the input lever 138 is in a state rotated against the rotation torque of the direction of the arrow 149 which is based on the biasing force in the direction of the arrow 147. The fourth transmission gear 126 has a stop surface 156 on the side of a bevel gear 136. The stop surface 156 extends radially outward from the fourth transmission gear 126 such that the switch gear 121 is contacted with the stop surface 156 when the switch gear 121 is engaged with the fourth transmission gear 126, thereby inhibiting the switch gear 121 from further moving in the direction of the arrow 148. Hence, when the switch gear 121, the input lever 138, and the biasing member 139 are held pushed together in the direction of the arrow 148 even after the switch gear 121 is brought into contact with the stop surface 156, the switch gear 121 is separated from the input lever 138 and the biasing member 139 and the meshing engagement between the switch gear 121 and the fourth transmission gear 126 is maintained.

At another edge 158 of the guide hole 151 that is opposed to the second and third guide positions 153, 154, a return guide 157 is formed. The return guide 157 has a hook-like shape that includes a first vertical portion extending vertically upward from the edge 158 of the guide hole 151, a horizontal portion that extends horizontally from an upper end of the first vertical portion to a position corresponding to a middle portion of the guide hole 151, and a second vertical portion that extends vertically downward from an end of the horizontal portion on the side opposite to the upper end of the first vertical portion, to a vertical position lower than an upper end of the arm 141. The return guide 157 guides the arm 141 returning from the fourth guide position 155 to the first guide position 152 in order to prevent the arm 141 from engaging with the cutouts of the second and third guide positions 153, 154. A width of the return guide 157 corresponds to a range between the second guide position 153 and a position slightly to the left (as seen in FIG. 14) of the fourth guide position 155.

As shown in FIGS. 3, 14 and 15, from an end of the carriage 38 on the upstream side in the feeding direction, a guide plate 92 extends horizontally to the upstream side in the feeding direction. The guide plate 92 is reciprocated with the carriage 38, but the carriage 38 is not depicted in FIGS. 14, 15, 20 and 21. The guide plate 92 is brought into contact with the arm 141 at a lateral side thereof. At a proximal portion (i.e., a portion on the side of the carriage 38) of the side of the guide plate 92, an oblique surface 93 is formed. At a distal portion (i.e., a portion remote from the carriage 38) of the side of the guide plate 92, an engaging portion 94 is formed.

The oblique surface 93 is brought into contact with the arm 141 when the arm 141 is located at one of the first to third guide positions 152-154. The oblique surface 93 is inclined in a direction to push the arm 141 to the side of the first to third guide positions 152-154, that is, in a direction to further rotate or turn the input lever 138 as rotated in the direction of the arrow 149 by being guided by and along the guide surface 145 of the biasing member 139. Hence, when the guide plate 92 is moved with the carriage 38 in the direction indicated by an arrow 159 (shown in FIGS. 14 and 15), the oblique surface 93 is brought into contact with the arm 141 located at one of the first to third guide positions 152-154, to push the arm 141 in the direction of the arrow 148 as well as bias the arm 141 to rotate the arm 141 in the direction of the arrow 149, thereby stably moving the arm 141 to one of the second to fourth guide positions 153-155 which is adjacent in the direction of the arrow 148 to the one guide position 152-154.

As FIGS. 20 and 21 show, the engaging portion 94 of the guide plate 92 is engaged with the arm 141 when the arm 141 is located at the fourth guide position 155. More specifically, the arm 141 is rotated in the direction opposite to the direction of the arrow 149 when moved from the third guide position 154 to the fourth guide position 155. When thus located at the fourth guide position 155, the arm 141 is engaged with the engaging portion 94 of the guide plate 92, as shown in FIGS. 20 and 21. While the guide plate 92 is held at this position, the arm 141 is halted at the fourth guide position 155 against the biasing force of the direction of the arrow 147. In this state, the arm 141 is biased in the direction of the arrow 149 by the effect of the guide surface 145 of the biasing member 139 on the basis of the biasing force in the direction of the arrow 147. With the arm 141 thus biased, the engagement between the arm 141 and the engaging portion 94 is maintained. When the guide plate 92 is moved with the carriage 38 in the direction of an arrow 160 (shown in FIGS. 20 and 21) in this state, the arm 141 in engagement with the engaging portion 94 is moved with the guide plate 92 in the direction of the arrow 160 under the biasing force in the direction of the arrow 147. During this movement, the input lever 138 is brought into contact with the switch gear 121 in meshing engagement with the fourth transmission gear 126, and then the switch gear 121, the input lever 138, and the biasing member 139 move together in the direction of the arrow 160. The arm 141 is guided by and along the return guide 157 to move parallel to the edge 158 of the guide hole 151 to a position corresponding to the first guide position 152 in order that the arm 141 eventually reaches an end of the guide hole 151, in other words, the arm 141 is brought into contact with an inner circumferential surface of the lever guide 150 that defines the guide hole 151, by and after which the arm 141 is disengaged from the engaging portion 94. The arm 141 disengaged from the engaging portion 94 is biased by the guide surface 145 of the biasing member 139 to rotate in the direction of the arrow 149, thereby being located at the first guide position 152. In this way, by controlling reciprocation of the carriage 38, the input lever 138 is moved in the direction of the arrangement of the first to fourth transmission gears 123-126, to be placed at one of the first to fourth guide positions 152-155, and the switch gear 121 is accordingly selectively engaged with one of the first to fourth transmission gears 123-126.

There will be described an operation of the printer portion 2. The printer portion 2 records an image on a recording sheet 9 that is fed in a selected one of the following three ways: (i) fed from the sheet supply tray 20 and in the normal feeding mode, (ii) fed from the sheet supply tray 20 and in the high-speed feeding mode, and (iii) fed from the sheet supply cassette 11 and in the normal feeding mode. In addition, the printer portion 20 performs a maintenance operation for the recording head 39. Among these, the image recording with a recording sheet 9 fed from the sheet supply tray 20 and in the normal feeding mode will be described first.

Figure 23:
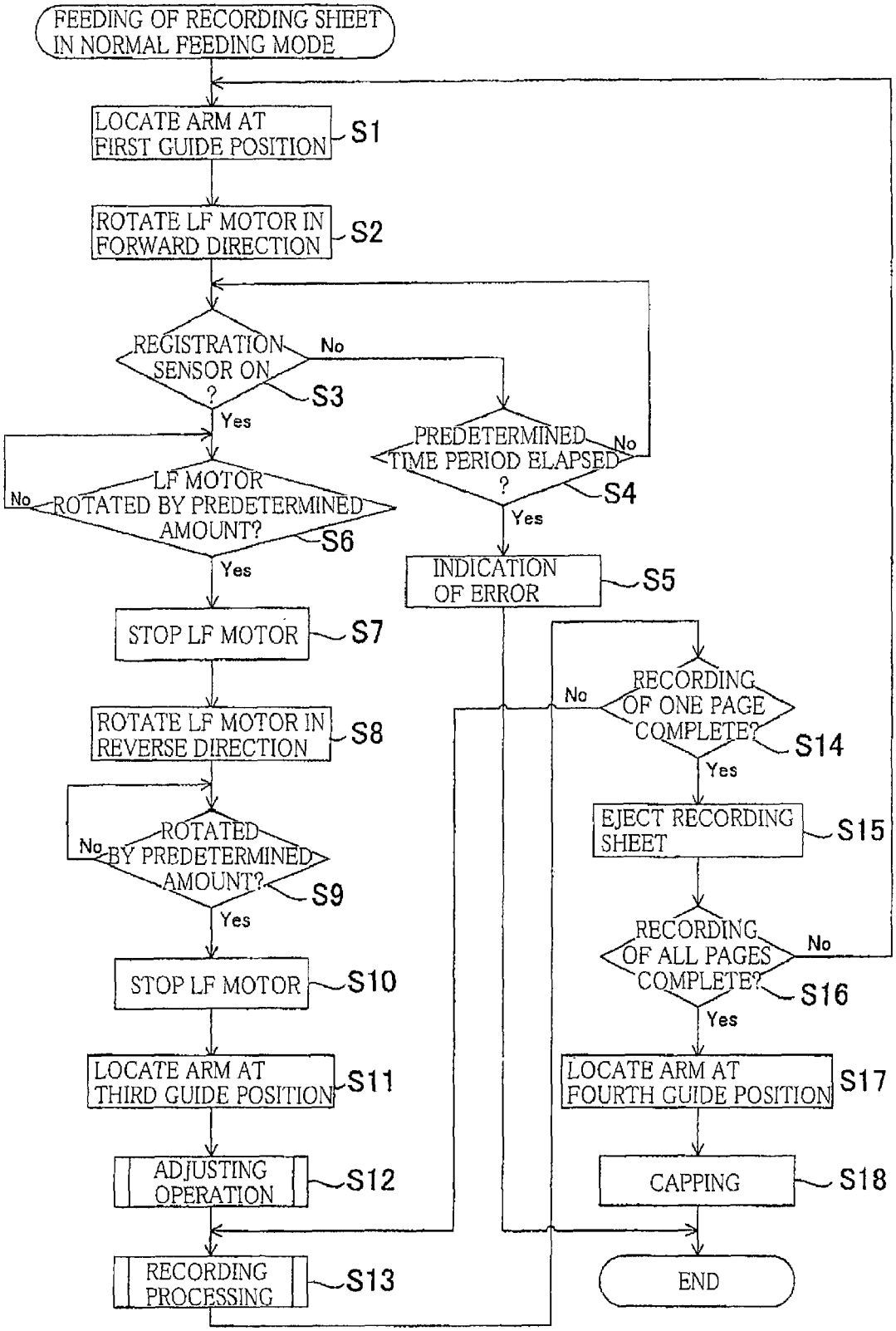
FIG. 23 is a flowchart of a control routine executed when a sheet is fed from a sheet supply tray in the normal feeding mode.

FIG. 23 is a flowchart illustrating a control routine according to which the image recording with a recording sheet 9 fed from the sheet supply tray 20 in the normal feeding mode is implemented. FIGS. 24-28 schematically illustrate an operation of the printer portion 2 according to the control routine. When an instruction to perform the image recording with a recording sheet 9 fed from the sheet supply tray 20 in the normal feeding mode is inputted through the operation panel 5 of the multifunction apparatus 1, the printer portion 2 starts operating accordingly. In place of the instruction input through the operation panel 5, the printer portion 2 may be operated in response to an instruction transmitted from an external information apparatus.

Figure 24:
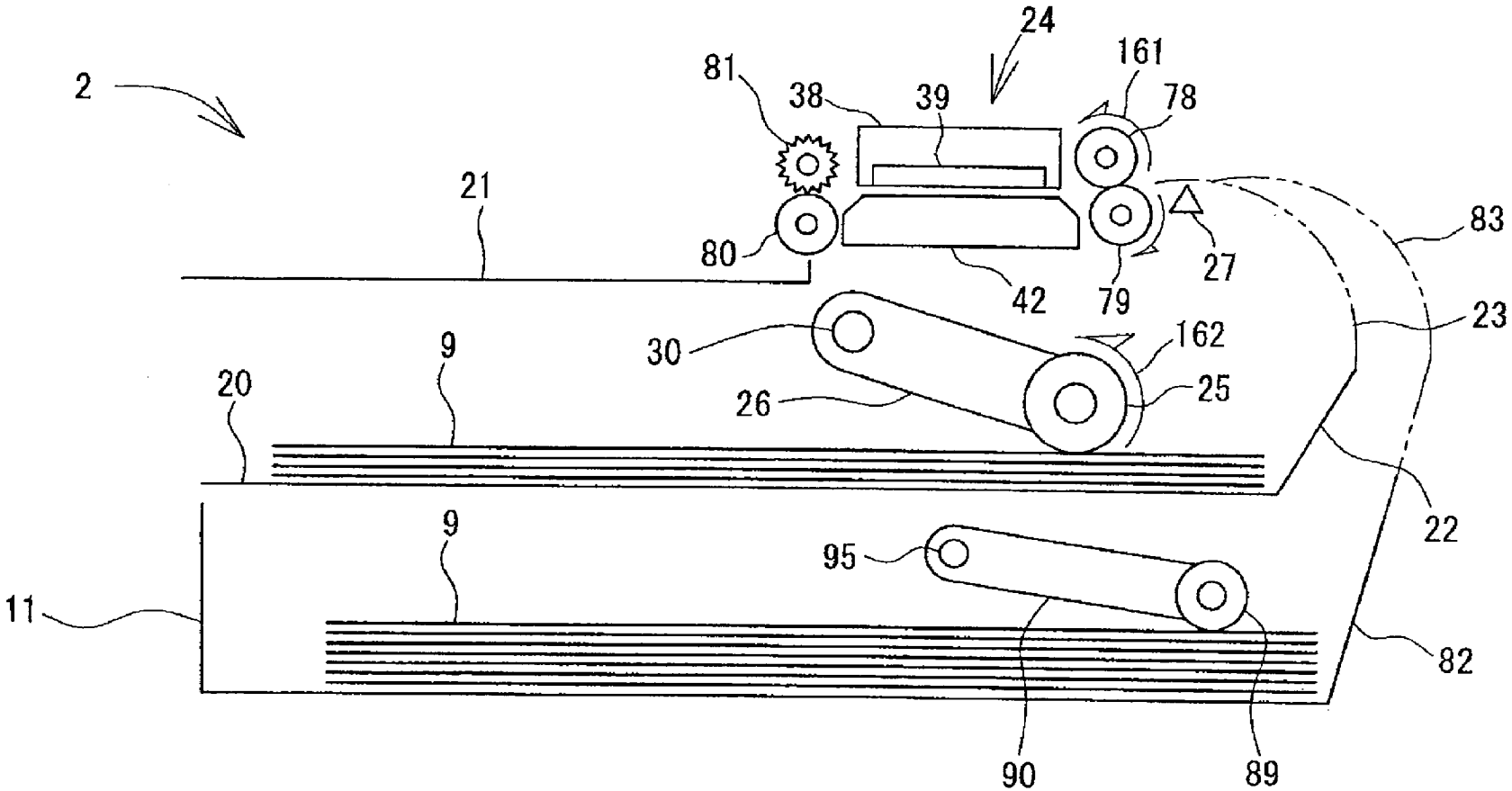

Upon receiving the instruction, the control portion 100 starts executing the control routine, which begins with step S1, in which the control portion 100 operates the CR motor 109 to move the carriage 38 in order to locate the arm 141 of the input lever 138 at the first guide position 152, as shown in FIGS. 14 and 15. Hence, the switch gear 121 is brought into meshing engagement with the first transmission gear 123, that is, the drive switching mechanism is placed in the first state. In the next step S2, the control portion 100 rotates the LF motor 107 in the forward direction. As shown in FIG. 24, the forward rotation of the LF motor 107 is transmitted to the feeder roller 78, which thus rotates in the direction opposite to the sheet feed direction, as indicated by an arrow 161. The forward rotation of the LF motor 107 transmitted to the feeder roller 78 is further transmitted sequentially to the drive gear 120, the switch gear 121, the first transmission gear 123, the first transmission assembly 170, and ultimately to the first pickup roller 25. The first pickup roller 25 thus receiving a torque based on the forward rotation of the LF motor 107 rotates in the sheet supply direction, as indicated by an arrow 162. By this rotation of the first pickup roller 25, the topmost one of the stack of the recording sheets 9 on the sheet supply tray 20 is supplied from the sheet supply tray 20 into the first feed path 23. It is noted that since the forward rotation of the LF motor 107 is not transmitted to the second pickup roller 89, a recording sheet 9 is not supplied from the sheet supply cassette 11 is not implemented.

Figure 25:
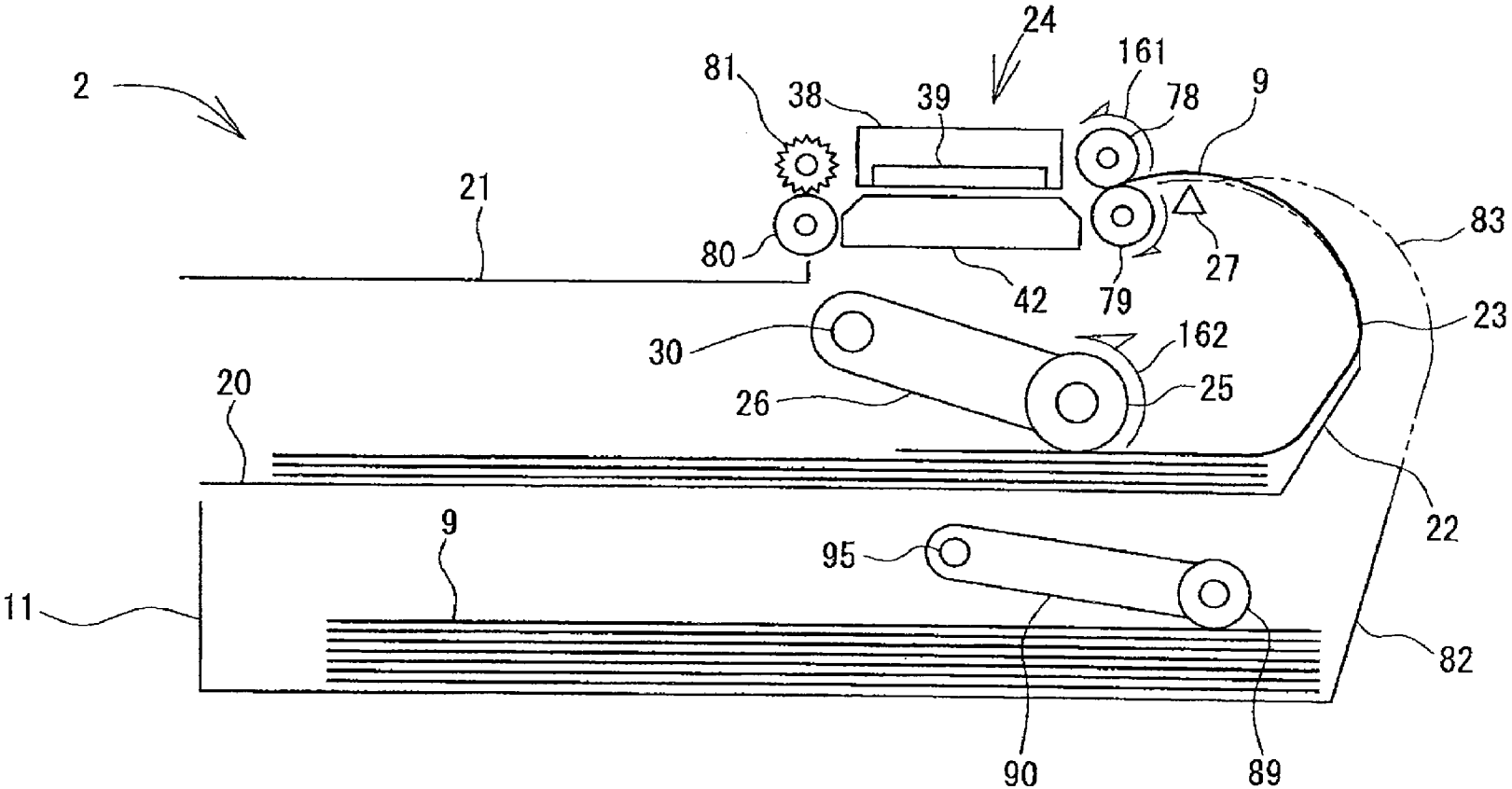

As FIG. 25 shows, the recording sheet 9 supplied into the first feed path 23 by the first pickup roller 25 is then fed in and along the first feed path 23, during which the recording sheet 9 is detected by the registration sensor 27, and thereafter the leading edge of the recording sheet 9 is brought into contact with the feeder roller 78 and the pinch roller 79. In the next step S3, the control portion 100 determines whether the registration sensor 27 detects the leading edge of the recording sheet 9 and outputs an ON signal. When an affirmative decision (YES) is made in step S3, the control flow goes to step S6. On the other hand, when a negative decision (NO) is made in step S3, the control flow goes to step S4 in which the control portion 100 determines whether a predetermined time period has elapsed. If a negative decision (NO) is made in step S4, the control flow returns to step S3 to again determine whether the registration sensor 27 detects the leading edge. That is, the control portion 100 repeats the determination of step S3 until an affirmative decision (YES) is made in step S3, unless the predetermined time period has elapsed since the forward rotation of the LF motor 107 was started. That is, where the recording sheet 9 is supplied from the sheet supply tray 20 into the first feed path 23 and fed along the first feed path 23 without any abnormality, the registration sensor 27 detects the leading edge of the recording sheet 9 and outputs an ON signal within the time period. On the other hand, where the recording sheet 9 is not supplied from the sheet supply tray 20 into the first feed path 23, or where a paper jam occurs and the recording sheet 9 is caught in the first feed path 23, the recording sheet 9 does not reach a position corresponding to the registration sensor 27 before the time period elapses, and an affirmative decision (YES) is made in step S4. In the latter case, the control flow goes to step S5 in which the control portion 100 presents on the operation panel 5 an indication of error such as "error in sheet supply" or "error in sheet feeding", and the feeding of the recording sheet 9 is terminated. The time period used in the determination of step S4 in association with the detection by the registration sensor 27 is predetermined by taking account of various factors including a distance of feeding of the recording sheet 9 from the sheet supply tray 20 to the registration sensor 27, and a speed at which the recording sheet 9 is fed.

When an affirmative decision (YES) is made in step S3, that is, when the control portion 100 determines that the registration sensor 27 detects the leading edge of the recording sheet 9 and outputs an ON signal, the control flow goes to step S6 in which the control portion 100 rotates the LF motor 107 in the forward direction by a predetermined amount, and then to step S7 in which the control portion 100 stops the LF motor 107. After passing by the registration sensor 27, the leading edge of the recording sheet 9 comes to contact the feeder roller 78 and the pinch roller 79, as shown in FIG. 25, but the recording sheet 9 is further driven in the feeding direction by the first pickup roller 25. At this time, the feeder roller 78 and the pinch roller 79 are rotating in the direction opposite to the sheet feed direction. Hence, the recording sheet 9 is not nipped between the feeder roller 78 and the pinch roller 79 but the leading edge is held in contact with the circumferential surfaces of the feeder roller 78 and the pinch roller 79. Meanwhile, the first pickup roller 25 feeds the recording sheet 9 in the sheet feed direction. Therefore, the recording sheet 9 bends with respect to the feeding direction with the leading edge thereof held in contact with the circumferential surfaces of the feeder roller 78 and the pinch roller 79, whereby the recording sheet 9 is deskewed by using the circumferential surfaces of the feeder roller 78 and the pinch roller 79 as reference.

Figure 26:
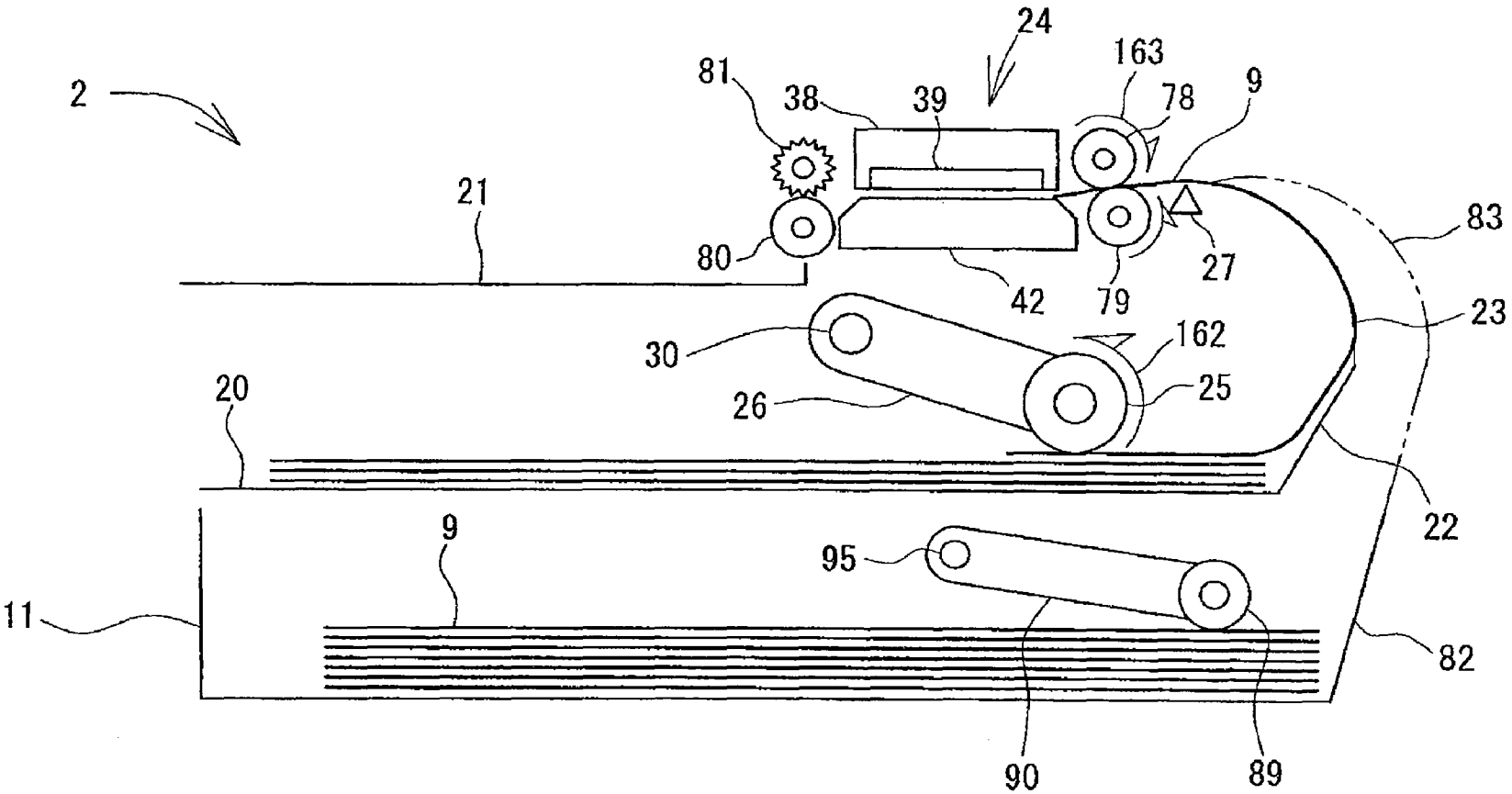

After the LF motor 107 is stopped in step S7, the control routine goes to step S8 in which the control portion 100 rotates the LF motor 107 in the reverse direction by a predetermined amount, in order that the reverse rotation of the LF motor 107 is transmitted to the feeder roller 78 and the pinch roller 79 that accordingly rotate in the sheet feed direction, i.e., a direction indicated by an arrow 163, as shown in FIG. 26. That is, in step S9, the control portion 100 determines whether the LF motor 107 has been rotated in the reverse direction by the predetermined amount, and when a negative decision (NO) is made in step S9, the control flow returns to step S8. That is, step S8 is repeated until an affirmative decision (YES) is made in step S9. By the reverse rotation of the LF motor 107 in step S8, the leading edge of the recording sheet 9 having been deskewed is nipped between the feeder roller 78 and the pinch roller 79 and thereby fed to the position over the platen 42. The reverse rotation of the LF motor 107 transmitted to the feeder roller 78 is further transmitted sequentially to the drive gear 120, the switch gear 121, and the first transmission gear 123. When transmitted to the first transmission assembly 170, the reverse rotation of the LF motor 107 in the predetermined amount is absorbed at the play in the fitting between the keys 177 and the recesses 178 and the driving torque is not transmitted to the first pickup roller 25, until the keys 177 come to contact with walls of the corresponding recesses 178 on one of the two opposite sides. When the keys 177 come to contact with the walls of the recesses 178 at last, the first pickup roller 25 is rotated in the sheet supply direction, i.e., the direction of the arrow 162, by friction between the first pickup roller 25 and the recording sheet 9 being fed. The play in the fitting between the keys 177 and the recesses 178 is set to correspond to the predetermined amount that is used in step S9 in the determination in association with the reverse rotation of the LF motor 107. When an affirmative decision (YES) is made in step S9, that is, when it is determined that the control portion 100 has reversely rotated the LF motor 107 by the predetermined amount, the control flow goes to step S10 in which the control portion 100 stops the LF motor 107. The predetermined amount by which the LF motor 107 is reversely rotated in step S8 is preferably set to correspond to an amount of feeding of the recording sheet 9 such that the leading edge of the recording sheet 9 is nipped between the feeder roller 78 and the pinch roller 79 but does not reach a position on the platen 42 from which recording is initiated.

After the stop of the reverse rotation of the LF motor 107 in step S10, the control flow goes to step S11 in which the control portion 100 operates the CR motor 109 in order to move the carriage 38 to locate the arm 141 of the input lever 138 at the third guide position 154, as shown in FIGS. 18 and 19. The switch gear 121 is accordingly brought into meshing engagement with the third transmission gear 125, that is, the drive switching mechanism is placed in the second state.

Then, the control flow goes to step S12 in which the control portion 100 implements an adjusting operation. The adjusting operation is implemented to stably move the switch gear 121 to one of four positions to engage with one of the first to fourth transmission gears 123-126. For instance, as described above, when the arm 141 of the input lever 138 is moved from the first guide position 152 to the third guide position 154, the switch gear 121 is biased by the compression coil spring 148*a* in the direction of the arrow 148 as seen in FIG. 19 and starts to slide on the support shaft 137. However, unless the teeth of all the transmission gears 123, 124 and 125 are aligned in their circumferential direction, a side surface of the switch gear 121 comes to contact a side surface of the second or third transmission gear 124, 125, thereby disabling smooth sliding of the switch gear 121 on the support shaft 137 and accordingly smooth engagement between the switch gear 121 and the third transmission gear 125. Therefore, in the adjusting operation of this embodiment, the control portion 100 repeats to slightly move the LF motor 107 alternately in the forward and reverse directions, in order to repeatedly rotate the switch gear 121 alternately in the forward and reverse directions, during which teeth of the switch gear 121 mesh with those of the second and third transmission gears 124, 125 and thus the switch gear 121 can smoothly slide on the support shaft 137.

Figure 27:
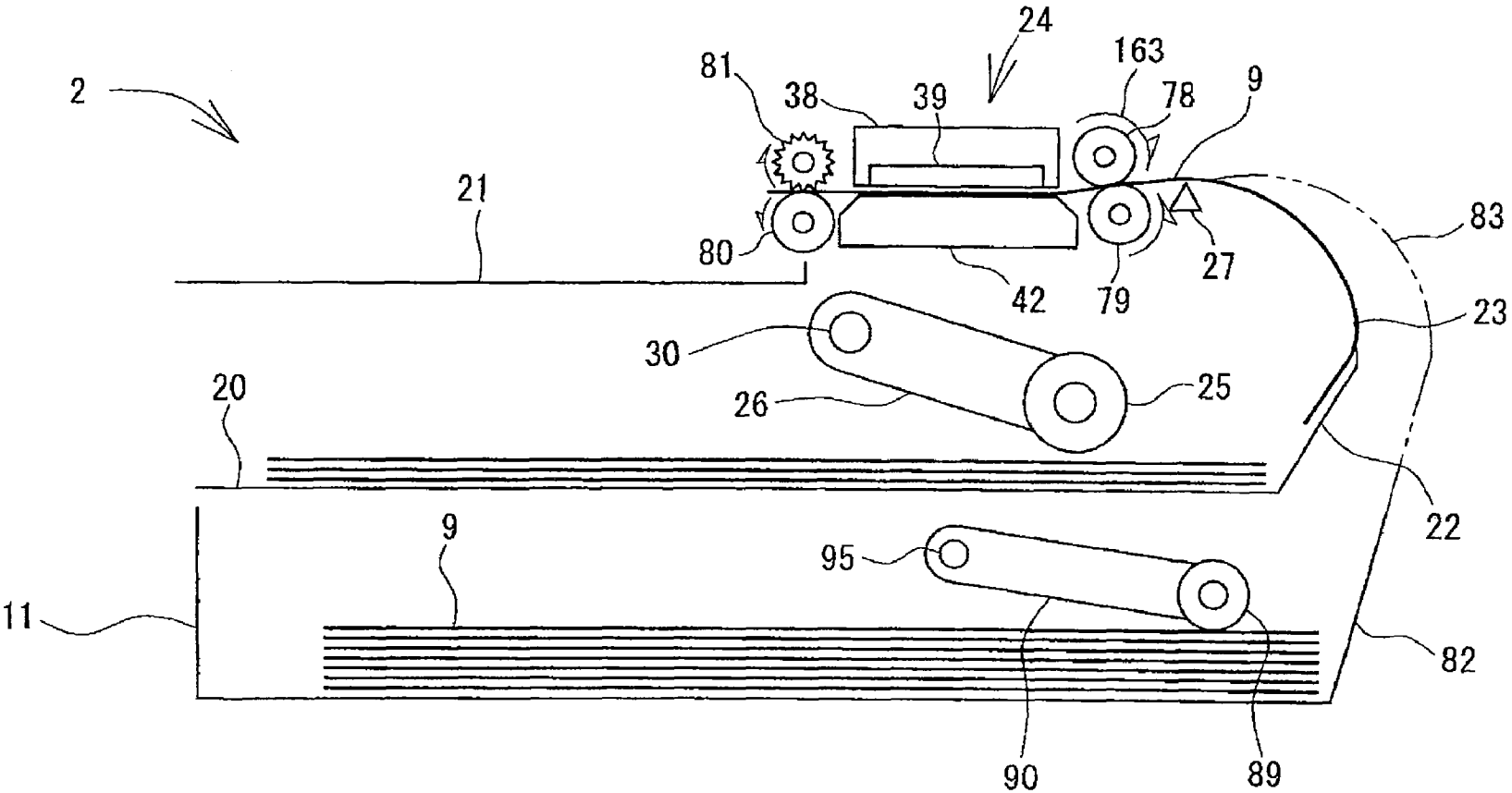

As FIG. 27 shows, after the adjusting operation of step S12 is complete, the control flow goes to step S13 in which the control portion 100 implements a recording processing. In the recording processing, the control portion 100 intermittently rotates the LF motor 107 in the reverse direction, by a predetermined amount at a time. Hence, the recording sheet 9 is intermittently fed over the platen 42 in a predetermined amount at a time, by the feeder roller 78 and the pinch roller 79. While the LF motor 107 is intermittently operated, the control portion 100 makes the recording head 39 eject droplets of designated inks at predetermined timings as well as operates the CR motor 109 to reciprocate the carriage 38. The ink droplets ejected from the recording head 39 land on the recording sheet 9 located over the platen 42. The control portion 100 alternately repeats the intermittent feeding of the recording sheet 9 and the ejection of the ink droplets from the recording head 39 for the number of times corresponding to one page, thereby recoding a desired image on the recording sheet 9. That is, in step S14, it is determined whether recording of one page is complete. In step S13, the reverse rotation of the LF motor 107 transmitted to the feeder roller 78 is further transmitted sequentially to the drive gear 120, the switch gear 121, the third transmission gear 125, and the second transmission assembly 180, at which the transmission of the driving torque is disconnected by a movement of the planetary gear 182. Hence, the driving torque is not transmitted to the second pickup roller 89. Thus, a recording sheet 9 is not supplied from the sheet supply cassette 11 into the second feed path 83. Since at this time the driving torque is not transmitted to the first pickup roller 25 either, the first pickup roller 25 in contact with the recording sheet 9 being fed is rotated in the sheet supply direction by the recording sheet 9, by friction between the first pickup roller 25 and the recording sheet 9.

The above-described operation of the printer portion 2 is implemented in a case where it is desired that the first pickup roller 25 is rotated by the recording sheet 9 that is being fed in contact with the first pickup roller 25 during the recording processing. However, depending on the conditions such as the material of the recording sheet 9, there is a case where such a demand does not exist. In the latter case, the embodiment may be modified such that in response to an instruction inputted through the operation panel 5, the control portion 100 skips switching of the drive switching mechanism to the second state and the adjusting operation. That is, after stopping the LF motor 107 in step S10, the control portion 100 skips steps S11 and S12 and directly proceeds to step S13 for implementing the recording processing. When the recording processing is started in this way, the recording sheet 9 is fed by the feeder roller 78 and the pinch roller 79 in the feeding direction, while the first pickup roller 25 is rotated in the direction opposite to the sheet feed direction. Hence, due to frictional resistance between the recording sheet 9 and the first pickup roller 25, a torque to upward move the first swing arm 26 occurs, whereby the first swing arm 26 jumps up to get off of the recording sheet 9 and then falls to contact the recording sheet 9, and this vertical movement (or jumping and falling) is repeated thereafter. As long as this vertical movement of the swing arm 26 substantially does not adversely affect the image recording on the recording sheet 9, the recording processing is preferably implemented in this modified manner since according to this modification the switching to the second state and the adjusting operation are omitted and the efficiency of recording is thus improved.

Figure 28:
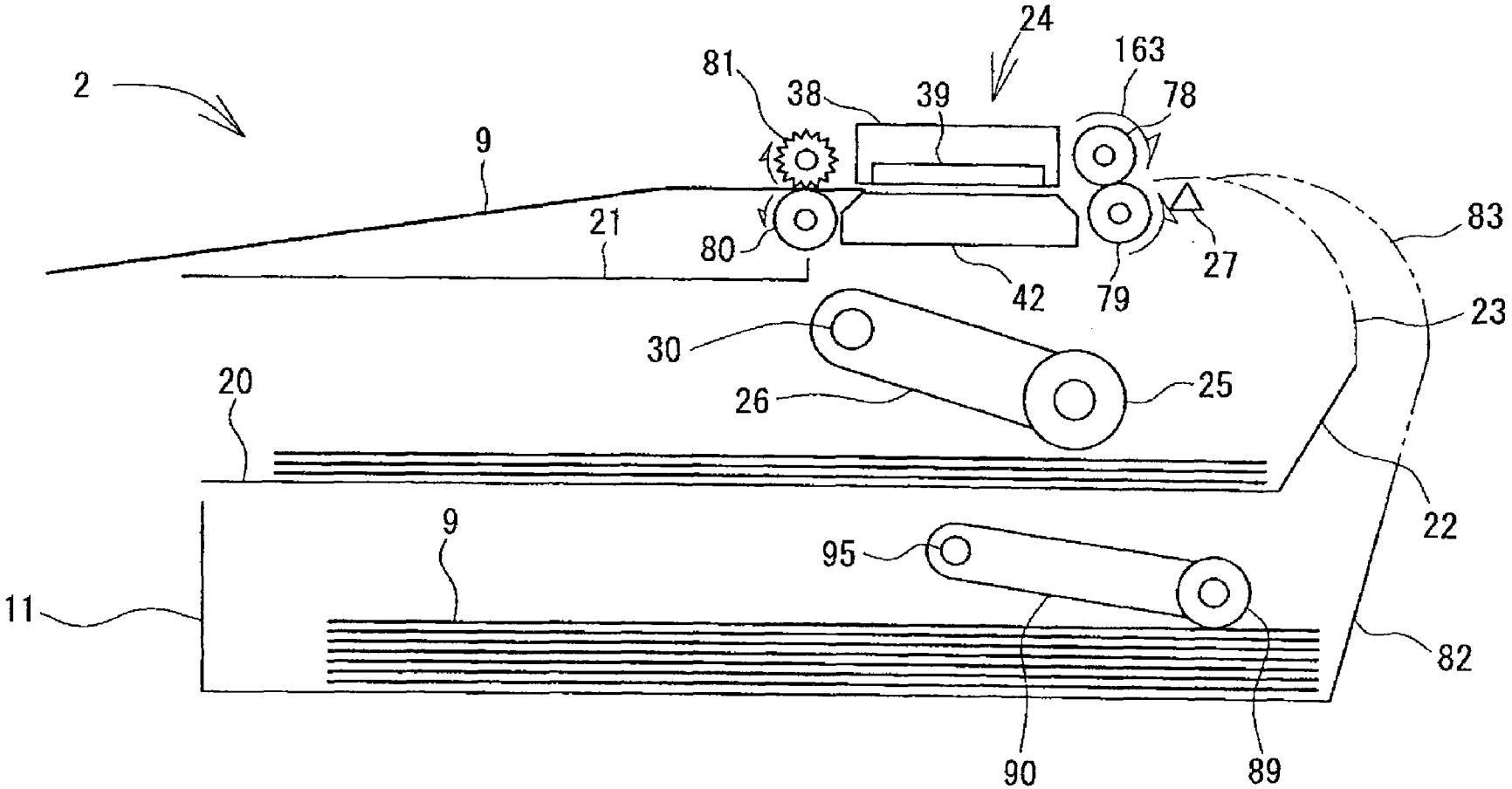

When an affirmative decision is made in step S14, that is, when it is determined that recording of one page is complete, the control flow goes to step S15 in which the control portion 100 reversely and consecutively rotates the LF motor 107 in order to eject the recording sheet 9 onto the sheet catch tray 21, as shown in FIG. 28. As described above, at this time the reverse rotation of the LF motor 107 is not transmitted to the first and second pickup rollers 25, 89.

Then, the control flow goes to step S16 in which the control portion 100 determines whether recording of all the pages is complete. When a negative decision (NO) is made in step S16, that is, when it is determined that recording of all the pages is not complete, the control flow returns to step S1, namely, the control portion 100 operates the CR motor 109 to move the carriage 38 in order to locate the arm 141 of the input lever 138 at the first guide position 152, as shown in FIGS. 14 and 15. Hence, the switch gear 121 is brought into meshing engagement with the first transmission gear 123, that is, the drive switching mechanism is placed in the first state. It is noted that although an adjusting operation is not implemented at this time, the same adjusting operation as that in step S12 may be implemented, if needed. Then, the control flow goes to step S2 in which the control portion 100 rotates the LF motor 107 in the forward direction, in order to supply the next recording sheet 9 from the sheet supply tray 20, in the same way as described above with respect to step S2 in the previous cycle.

On the other hand, when an affirmative decision (YES) is made in step S16, that is, when it is determined that recording of all the pages is complete, the control flow goes to step S17 in which the control portion 100 operates the CR motor 109 to move the carriage 38 in order to locate the arm 141 of the input lever 138 at the fourth guide position 155, as shown in FIGS. 20 and 21. Hence, the switch gear 121 is brought into meshing engagement with the fourth transmission gear 126. It is noted that although an adjusting operation is not implemented at this time, the same adjusting operation as that in step S12 may be implemented, if needed. The control flow then goes to step S18 in which the control portion 100 further moves the carriage 38 and lifts the nozzle cap 52 and the air-outlet cap 53, as shown in FIG. 6, in order to cap or cover the recording head 39. Then, the control routine of this cycle is terminated.

There will be now described the image recording with a recording sheet 9 fed from the sheet supply tray 20 and in the high-speed feeding mode. Upon receiving an instruction to perform image recording in the high-speed feeding mode, the control portion 100 operates the CR motor 109 to move the carriage 38 in order to locate the arm 141 of the input lever 138 at the second guide position 153, as shown in FIGS. 16 and 17. Hence, the switch gear 121 is brought into meshing engagement with the second transmission gear 124. Then, the control portion 100 reversely rotates the LF motor 107.

When the switch gear 121 is in meshing engagement with the second transmission gear 124, a rotation of the drive gear 120 in synchronization with a rotation of the feeder roller in the sheet feed direction is transmitted to the first pickup roller 25 as a rotation thereof in the sheet supply direction. Hence, the topmost recording sheet 9 in the sheet supply tray 20 is supplied into the first feed path 23. A leading edge of the thus supplied recording sheet 9 is detected by the registration sensor 27, and then reaches the feeder roller 78 and the pinch roller 79. Since at this time the feeder roller 78 and the pinch roller 79 are rotating in the sheet feed direction, the leading edge of the recording sheet 9 is immediately nipped between the feeder roller 78 and the pinch roller 79 and fed to the position over the platen 42. That is, the recording sheet 9 is not deskewed.

A rotation speed of the feeder roller 78 is higher than that of the first pickup roller 25. Hence, the recording sheet 9 is fed by a combination of the feeder roller 78 and the pinch roller 79 at a speed higher than the rotation speed of the first pickup roller 25. A nip force with which the feeder roller 78 and the pinch roller 79 nips the recording sheet 9 therebetween is sufficiently larger than a contact force between the first pickup roller 25 and the recording sheet 9. Hence, a force rotating the first pickup roller 25 in the sheet supply direction is overcome by a forward force from the recording sheet 9 as being fed by the combination of the feeder roller 78 and the pinch roller 79, and the first swing arm 26 vertically moves, or alternately jumps up and falls. When a rear edge of the recording sheet 9 has passed a position of contact with the first pickup roller 25, the next recording sheet contacts the first pickup roller 25, whereby the next recording sheet is supplied from the sheet supply tray 20 into the first feed path 23. Since the rotation speed of the feeder roller 78 is higher than that of the first pickup roller 25, as described above, the rear edge of the recording sheet 9 and a leading edge of the next recording sheet are gradually separated from each other by a distance corresponding to a difference of the rotation speeds of the feeder roller 78 and the first pickup roller 25. Thus, it is prevented that two recording sheets are together fed one on another.

When the recording sheet 9 has been fed by the feeder roller 78 and the pinch roller 79 to the position over the platen 42 from which recording is initiated, the same recording processing as described above with respect to the image recording in the normal feeding mode is performed. Since when recording of a first page is complete, the next recording sheet for a second page is already supplied, the control portion 100 can immediately start recording the second page. Hence, in the high-speed feeding mode, the printer portion 2 performs image recording at a higher speed than in the normal feeding mode.

There will be next described the image recording with a recording sheet 9 fed from the sheet supply cassette 11 and in the normal feeding mode. Upon receiving an instruction to perform image recording with a recording sheet fed from the sheet supply cassette 11, the control portion 100 operates the CR motor 109 to move the carriage 38 in order to locate the arm 141 of the input lever 138 at the third guide position 154, as shown in FIGS. 18 and 19. Hence, the switch gear 121 is brought into meshing engagement with the third transmission gear 125. Then, the control portion 100 rotates the LF motor 107 in the forward direction. The forward rotation of the LF motor 107 is transmitted to the feeder roller 78, which in turn rotates in the direction opposite to the sheet feed direction. The forward rotation of the LF motor 107 transmitted to the feeder roller 78 is further transmitted sequentially to the drive gear 120, the switch gear 121, the third transmission gear 125, the second transmission assembly 180, and ultimately to the second pickup roller 89. The second pickup roller 89 thus rotates in the sheet supply direction. By the rotation of the second pickup roller 89, the topmost recording sheet 9 in the sheet supply cassette 11 is supplied into the second feed path 83.

The recording sheet 9 supplied into the second feed path 83 then proceeds into the first feed path 23 in which the recording sheet 9 is detected by the registration sensor 27. Then, a leading edge of the recording sheet 9 comes to contact the feeder roller 78 and the pinch roller 79. The recording sheet 9 is deskewed in the same way as described above with respect to the case where image recording is performed with a recording sheet fed from the sheet supply tray 20 in the normal feeding mode. Thereafter, the control portion 100 reversely rotates the LF motor 107. The reverse rotation of the LF motor 107 rotates the feeder roller 78 and the pinch roller 79 in the sheet feed direction. The reverse rotation of the LF motor 107 transmitted to the feeder roller 78 is further transmitted sequentially to the drive gear 120, the switch gear 121, the third transmission gear 125, and the second transmission assembly 180. However, at the second transmission assembly 180, the transmission of the driving torque is disconnected by a movement of the planetary gear 182, and not transmitted to the second pickup roller 89. Hence, the second pickup roller 89 is rotated in the sheet supply direction by the recording sheet 9 being fed. When the recording sheet 9 has been fed, by the combination of the feeder roller 78 and the pinch roller 79, to the position over the platen 42 from which recording is initiated, the same recording processing as described above with respect to the case of the image recording with a recording sheet fed from the sheet supply tray 20 and in the normal feeding mode.

In the maintenance operation, the control portion 100 operates the CR motor 109 to move the carriage 38 in order to locate the arm 141 of the input lever 138 at the fourth guide position 155, as shown in FIGS. 20 and 21. Hence, the switch gear 121 is brought into meshing engagement with the fourth transmission gear 126. As shown in FIG. 8, the bevel gear 136 is disposed on the outer side of, and integrally with, the fourth transmission gear 126 such that the bevel gear 136 is rotated with the fourth transmission gear 126. The bevel gear 136 is engaged with the bevel gear 62 (shown in FIG. 4) of the purge mechanism 51. Hence, when the switch gear 121 is engaged with the fourth transmission gear 126, a rotation of the drive gear 120 is transmitted to the bevel gear 62 of the purge mechanism 51. Receiving a driving torque from the bevel gear 62, the pump gear of the pump 54 of the purge mechanism 51 rotates, whereby the pump 54 performs the sucking operation. Although not shown in FIG. 8, it may be arranged such that a driving torque is transmitted from the fourth transmission gear 126 to the port switching mechanism 59 in order to operate the cam of the port switching mechanism 59 on the basis of a rotation of the drive gear 120.

According to the present embodiment, the printer portion 2 of the multifunction apparatus 1 includes the sheet supply tray 20 and the sheet supply cassette 11, and a recording sheet is supplied selectively from one of the sheet supply tray 20 and the sheet supply cassette 11 by use of the drive switching mechanism including the four transmission gears 123-126. However, the sheet supply cassette 11, the second pickup roller 89, the second swing arm 90, and the second transmission assembly 180 are not essential for the multifunction apparatus 1, but the multifunction apparatus 1 may be such that these 11, 89, 90, 180 are optionally settable therein.

The structure of the transmission gears 123-126 of the drive switching mechanism may be modified in accordance with the option settings or the model of the multifunction apparatus 1. For instance, in the multifunction apparatus 1, the high-speed feeding mode in which the first pickup roller 25 is used, and the sheet supply cassette 11, are optionally includable, depending on the option settings and model. In other words, feeding from the sheet supply tray 20 in the normal feeding mode, and the purge mechanism 51, are normally and commonly included in all the models. That is, the first and third transmission gears 123, 125 are essential for the multifunction apparatus 1, but the second transmission gear 124 for transmitting a driving torque to the first pickup roller 25 in the image recording with a recording sheet fed from the sheet supply tray 20 in the high-speed feeding mode, and the third transmission gear 125 for transmitting a driving torque to the second pickup roller 89 in the recording with a recording sheet fed from the sheet supply cassette 11, are included if desired, depending on the option settings and other conditions. In a case where a driving torque is transmitted to the purge mechanism 51 along another transmission path that is not described above, the fourth transmission gear 126 may be omitted.

Figure 29A:
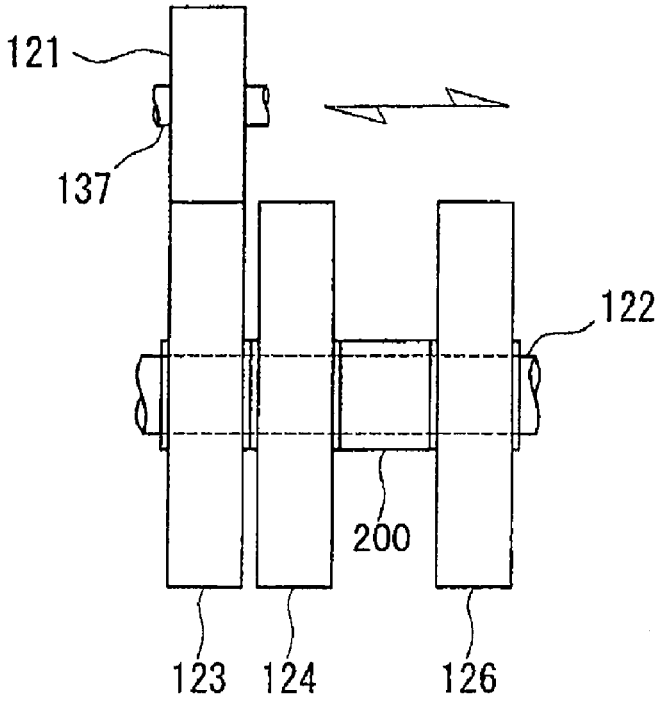
FIGS. 29A and 29B are front elevational views of a drive switching mechanism in a multifunction apparatus according to a modification of the embodiment where a sheet supply cassette is not included.
Figure 29B:
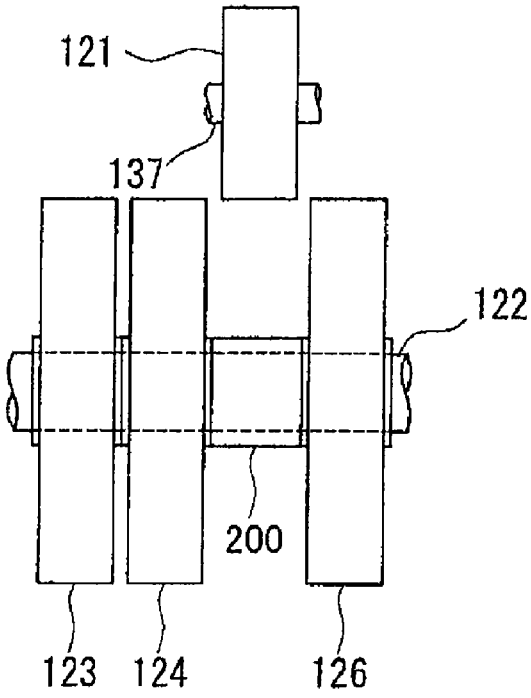

FIGS. 29A and 29B illustrate a principal structure of a drive switching mechanism of a multifunction apparatus according to a modification of the embodiment, where the sheet supply cassette 11 included in the above-described embodiment is omitted. Although the multifunction apparatus of the modification also includes an input lever 138 and a lever guide 150 identical with those in the above-described embodiment, they are not depicted in FIGS. 29A and 29B. Since the multifunction apparatus of the modification does not include the sheet supply cassette 11, the third transmission gear 125 included in the above-described embodiment is not included in this drive switching mechanism, either. It is noted that the multifunction apparatus of the modification is of a model capable of the image recording with a recording sheet fed from the sheet supply tray 20 in the high-speed feeding mode, and thus includes the second transmission gear 124. In the description of the multifunction apparatus of the modification below, the same reference numerals as used in the above description are used for denoting the corresponding elements or parts.

As shown in FIGS. 29A and 29B, in the multifunction apparatus of the modification and at a position where the third transmission gear 125 is disposed in the multifunction apparatus of the above-described embodiment, a spacer 200 is disposed. The spacer 200 is fitted on a shaft 122. The spacer 200 is in abutting contact at its two opposite sides with a side surface of the second transmission gear 124 and a side surface of the fourth transmission gear 126, thereby forming a space between the second and fourth transmission gears 124, 126. This space positionally corresponds to the third transmission gear 125 in the above-described embodiment. Hence, even though the third transmission gear 125 is not included, the first, second and fourth transmission gears 123, 124, 126 are positioned on the shaft 122 at respective predetermined positions, and selectively engaged with a switch gear 121 that is slid on a support shaft 137 to be located at one of a first guide position 152, a second guide position 153, and a fourth guide position 155 in the drive switching mechanism.

As shown in FIG. 29B, when an arm 141 of an input lever 138 is located at the third guide position 154, the switch gear 121 is disposed at a position corresponding to the space produced as a result of the disposition of the spacer 200, without meshing with any of the first, second and fourth transmission gears 123, 124, 126. That is, when located at the third guide position 154, the switch gear 121 does not transmit a driving torque to a first transmission assembly 170. Hence, even in the multifunction apparatus of the modification that does not including the sheet supply cassette 11, a control portion 100 can implement the image recording with a recording sheet fed from the sheet supply tray 20 in the normal feeding mode as illustrated in FIG. 23. Thus, when designing the multifunction apparatus of the modification where the sheet supply cassette 11 and other members are optionally included, it is not necessary to modify the control routine depending on whether the optionally includable members are actually included in the multifunction apparatus or not.

It is noted that even in the modification of the embodiment where the third transmission gear 125 is not disposed, engaging the switch gear 121 with the first transmission gear 123 establishes the first state where a rotation of a LF motor 107 is transmitted to a first pickup roller 25, and a rotation of the LF motor 107 is not transmitted to the first pickup roller 25 in a second state identical with that in the above-described embodiment. However, in the second state of the above-described embodiment, a driving torque is transmittable to the second pickup roller 89 by engaging the switch gear 121 with the third transmission gear 125 (although only a reverse rotation of the LF motor 107 is actually transmittable due to presence of the planetary gear and arm). In the multifunction apparatus of the modification contrast, on the other hand, the second state is established when the switch gear 121 is located at the position corresponding to the spacer 200, and thus simply and merely a rotation of the LF motor 107 is not transmitted to the first pickup roller 25.

According to the multifunction apparatus 1 of the embodiment and its modification, there is provided a simple arrangement for supplying a recording sheet 9 from the sheet supply tray 20 by the first pickup roller 25 on the basis of a forward rotation of the LF motor 107, and feeding the recording sheet 9 by the feeder roller 78 and the pinch roller 79 on the basis of a reverse rotation of the LF motor 107. Further, in the case where the multifunction apparatus 1 is designed to be able to optionally include the sheet supply cassette 11 and others, it is not necessary to modify the control routine depending on whether the optionally includable members are actually included or not.

Although there has been described one embodiment of the invention and its modification, it is to be understood that the invention is not limited to the details thereof but may be otherwise embodied with various other modifications and improvements that may occur to those skilled in the art, without departing from the scope and spirit of the invention defined in the appended claims.

What is claimed is:

1. A sheet feeding apparatus comprising:

a first sheet holding portion which holds a sheet;

a feed path which guides the sheet supplied from the first sheet holding portion;

a driving source which can rotate in two opposite directions;

a feeder roller which is disposed in the feed path and rotated by a driving torque of the driving source;

a first pickup roller which can rotate in contact with the sheet held in the first sheet holding portion;

a switchable transmission mechanism which is disposed between the first pickup roller and the driving source, and is switchable at least between a first state for transmitting to the first pickup roller a rotation of the driving source in a forward direction, and a second state for not transmitting a rotation of the driving source to the first pickup roller, the forward direction in which the driving source is rotated in the first state being a direction opposite to a direction in which the driving source is rotated to rotate the feeder roller in a sheet feed direction which is a direction to feed the sheet, the switchable transmission mechanism includes:

a first transmission assembly which is disposed between the first pickup roller and the driving source, and transmits the rotation of the driving source in the forward direction to the first pickup roller, and a drive switching mechanism which is switchable at least between a first state for transmitting the driving torque of the driving source to the first transmission assembly, and a second state for not transmitting the driving torque of the driving source to the first transmission assembly, the first state and the second state of the drive switching mechanism respectively corresponding to the first state and the second state of the switchable transmission mechanism; and a control portion which (i) rotates the driving source in the forward direction to rotate the first pickup roller in a sheet supply direction which is a direction to supply the sheet and to rotate the feeder roller in a direction opposite to the sheet feed direction, and switches the switchable transmission mechanism to the first state, when the sheet is supplied from the first sheet holding portion, and (ii) rotates the driving source in the direction opposite to the forward direction, and switches the switchable transmission mechanism to the second state, when the sheet is fed by the feeder roller;

a second sheet holding portion which is another sheet holding portion other than the first sheet holding portion, and which holds a sheet;

a second pickup roller which is another pickup roller other than the first pickup roller, and which is rotatable in contact with the sheet held in the second sheet holding portion;

a second transmission assembly which is another transmission assembly other than the first transmission assembly, which is disposed between the second pickup roller and the drive switching mechanism, and which transmits at least the rotation of the driving source in the forward direction to the second pickup roller; and the drive switching mechanism transmitting the rotation of the driving source to the second transmission assembly, when the drive switching mechanism is placed in the second state.

2. The sheet feeding apparatus according to claim 1, wherein the second transmission assembly does not transmit to the second pickup roller a rotation of the driving source in a reverse direction that is opposite to the forward direction.

3. The sheet feeding apparatus according to claim 2, wherein the second transmission assembly includes:

a sun gear;

a driven gear which is disposed to be rotatable around a rotation axis which is separated from the sun gear and parallel to a rotation axis of the sun gear;

a swing arm pivotable around the rotation axis of the sun gear; and a planetary gear which is held on the swing arm to be rotatable around a rotation axis parallel to the rotation axis of the sun gear, the planetary gear being in meshing engagement with the sun gear and movable between a position to engage with the driven gear and a position to disengage from the driven gear in accordance with pivoting movement of the swing arm.

4. The sheet feeding apparatus according to claim 1, wherein the drive switching mechanism includes:

a first gear which is driven by the driving torque of the driving source;

a second gear which is connected to the first pickup roller;

a fourth gear which is connected to the second pickup roller; and a third gear which is in meshing engagement with the first gear, and selectively and disengageably engageable with one of the second gear and the fourth gear.

5. The sheet feeding apparatus according to claim 4, wherein the second gear and the fourth gear are mounted in series on a support shaft parallel to an axis of the first gear such that the second gear and the fourth gear are individually rotatable, and wherein the third gear is moved in meshing engagement with the first gear in a direction parallel to the support shaft in order to be selectively engaged with one of the second gear and the fourth gear.

6. The sheet feeding apparatus according to claim 5, wherein the second gear is normally included in the sheet feeding apparatus, and wherein the fourth gear is optionally includable in the sheet feeding apparatus, depending on whether the second sheet holding portion, the second pickup roller, and the second transmission assembly are included in the sheet feeding apparatus or not.

7. The sheet feeding apparatus according to claim 6, wherein the third gear is moved by an input mechanism in a direction parallel to a direction in which the second gear and the fourth gear are arranged, the input mechanism being selectively moved to at least two positions respectively corresponding to the first state and the second state.

8. An image recording apparatus comprising:

the sheet feeding apparatus according to claim 7; and a carriage on which a recording head is mounted, and which is reciprocated in a direction intersecting a direction in which the sheet is fed, and wherein the input mechanism is selectively moved to one of the at least two positions on the basis of a movement of the carriage.

9. The sheet feeding apparatus according to claim 5, wherein the third gear is moved by an input mechanism in a direction parallel to a direction in which the second gear and the fourth gear are arranged, the input mechanism being selectively moved to at least two positions respectively corresponding to the first state and the second state.

10. An image recording apparatus comprising:

the sheet feeding apparatus according to claim 9; and a carriage on which a recording head is mounted, and which is reciprocated in a direction intersecting a direction in which the sheet is fed, and wherein the input mechanism is selectively moved to one of the at least two positions on the basis of a movement of the carriage.

11. The sheet feeding apparatus according to claim 4, wherein the second gear is normally included in the sheet feeding apparatus, and wherein the fourth gear is optionally includable in the sheet feeding apparatus, depending on whether the second sheet holding portion, the second pickup roller, and the second transmission assembly are included in the sheet feeding apparatus or not.

12. The sheet feeding apparatus according to claim 11, wherein the third gear is moved by an input mechanism in a direction parallel to a direction in which the second gear and the fourth gear are arranged, the input mechanism being selectively moved to at least two positions respectively corresponding to the first state and the second state.

13. An image recording apparatus comprising:

the sheet feeding apparatus according to claim 12; and a carriage on which a recording head is mounted, and which is reciprocated in a direction intersecting a direction in which the sheet is fed, and wherein the input mechanism is selectively moved to one of the at least two positions on the basis of a movement of the carriage.

* * * * *